US008678244B2

(12) United States Patent
Yang et al.

(10) Patent No.: US 8,678,244 B2
(45) Date of Patent: Mar. 25, 2014

(54) SOAP DISPENSING UNITS WITH ANTI-DRIP VALVE

(75) Inventors: Frank Yang, Rancho Palos Verdes, CA (US); David Wolbert, Redondo Beach, CA (US); Joseph Sandor, Newport Beach, CA (US); Orlando Cardenas, Laguna Niguel, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 13/411,373

(22) Filed: Mar. 2, 2012

(65) Prior Publication Data

US 2012/0248150 A1 Oct. 4, 2012

Related U.S. Application Data

(60) Provisional application No. 61/449,588, filed on Mar. 4, 2011, provisional application No. 61/594,960, filed on Feb. 3, 2012.

(51) Int. Cl.
*B65D 88/54* (2006.01)

(52) U.S. Cl.
USPC ..... 222/333; 222/321.9; 222/380; 222/41; 222/571; 222/63

(58) Field of Classification Search
USPC ..... 222/63, 424, 385, 333, 181.3, 372, 571, 222/478, 494, 1; 137/511, 455, 843, 844
See application file for complete search history.

(56) References Cited

U.S. PATENT DOCUMENTS 2,651,545 A 9/1953 Shotton
2,697,446 A 12/1954 Harrington
2,772,817 A 12/1956 Jauch
3,023,922 A 3/1962 Arrington
3,149,754 A 9/1964 Wolf et al.

(Continued)

FOREIGN PATENT DOCUMENTS

CA 141847 4/2012
CA 144016 4/2012

(Continued)

OTHER PUBLICATIONS

U.S. Appl. No. 29/357,570, filed Mar. 13, 2010, Yang et al.

(Continued)

*Primary Examiner* — Frederick C Nicolas
*Assistant Examiner* — Bob Zadeh
(74) *Attorney, Agent, or Firm* — Knobbe, Martens, Olson & Bear, LLP

(57) ABSTRACT

A soap dispenser can be configured to dispense an amount of liquid soap, for example, upon detecting the presence of an object. Certain embodiments of the dispenser include a housing, reservoir, pump, and nozzle. In some embodiments, the dispenser includes a bypass passage, which can facilitate priming of the pump. In certain embodiments, the dispenser is configured to inhibit or avoid the formation of an air bubble that could obstruct the liquid soap from entering the pump. In some embodiments, the pump includes engaging gears, which can include a plurality of teeth with substantially pointed tips. In certain embodiments, the nozzle comprises a one-way valve, such as a duckbill valve. Some embodiments of the one-way valve are shaped or otherwise configured to provide certain biases to the valve, which can, for example, facilitate rapid opening and closing of the valve.

33 Claims, 35 Drawing Sheets

(56) References Cited

U.S. PATENT DOCUMENTS

| | | | | |
|---|---|---|---|---|
| 3,220,954 | A | 11/1965 | Malbe | |
| 3,631,736 | A | 1/1972 | Saari | |
| 3,701,482 | A | 10/1972 | Sachnik | |
| 4,046,289 | A | 9/1977 | Teranishi | |
| 4,056,050 | A | 11/1977 | Brown | |
| 4,113,147 | A * | 9/1978 | Frazier et al. | 222/131 |
| 4,217,993 | A | 8/1980 | Jess et al. | |
| 4,498,843 | A | 2/1985 | Schneider et al. | |
| 4,524,805 | A * | 6/1985 | Hoffman | 137/846 |
| 4,693,854 | A | 9/1987 | Yau | |
| 4,722,372 | A | 2/1988 | Hoffman et al. | |
| 4,915,347 | A | 4/1990 | Iqbal et al. | |
| 4,921,131 | A | 5/1990 | Binderbauer et al. | |
| 4,938,384 | A | 7/1990 | Pilolla | |
| 4,967,935 | A | 11/1990 | Celest | |
| 5,028,328 | A | 7/1991 | Long | |
| 5,082,150 | A | 1/1992 | Steiner et al. | |
| 5,169,040 | A | 12/1992 | Wiley | |
| 5,186,360 | A | 2/1993 | Mease et al. | |
| 5,199,118 | A | 4/1993 | Cole et al. | |
| 5,271,528 | A | 12/1993 | Chien | |
| 5,305,916 | A | 4/1994 | Suzuki et al. | |
| 5,466,131 | A * | 11/1995 | Altham et al. | 417/420 |
| 5,472,719 | A | 12/1995 | Favre | |
| 5,477,984 | A | 12/1995 | Sayama et al. | |
| 5,632,414 | A | 5/1997 | Merriweather, Jr. | |
| 5,771,925 | A | 6/1998 | Lewandowski | |
| 5,823,390 | A | 10/1998 | Muderlak et al. | |
| 5,829,636 | A | 11/1998 | Vuong et al. | |
| 5,836,482 | A | 11/1998 | Ophardt et al. | |
| 5,960,991 | A | 10/1999 | Ophardt | |
| D416,154 | S | 11/1999 | Diehl | |
| 5,988,451 | A | 11/1999 | Hanna | |
| 6,021,705 | A | 2/2000 | Dijs | |
| 6,021,960 | A | 2/2000 | Kehat | |
| 6,036,056 | A | 3/2000 | Lee et al. | |
| D426,093 | S | 6/2000 | Cayouette | |
| D426,413 | S | 6/2000 | Kreitemier et al. | |
| 6,126,290 | A | 10/2000 | Veigel | |
| D438,041 | S | 2/2001 | Huang | |
| 6,209,752 | B1 | 4/2001 | Mitchell et al. | |
| RE37,173 | E | 5/2001 | Jefferson, Jr. et al. | |
| 6,269,735 | B1 * | 8/2001 | Rolfes | 99/279 |
| 6,279,460 | B1 | 8/2001 | Pope | |
| 6,279,777 | B1 | 8/2001 | Goodin et al. | |
| 6,311,868 | B1 * | 11/2001 | Krietemeier et al. | 222/1 |
| 6,325,604 | B1 | 12/2001 | Du | |
| 6,375,038 | B1 | 4/2002 | Daansen et al. | |
| 6,443,328 | B1 | 9/2002 | Fehl et al. | |
| 6,444,956 | B1 | 9/2002 | Witcher et al. | |
| 6,557,584 | B1 | 5/2003 | Lucas et al. | |
| 6,594,105 | B1 | 7/2003 | Brittner | |
| D483,974 | S | 12/2003 | Reed | |
| 6,698,616 | B2 | 3/2004 | Hidle et al. | |
| 6,722,265 | B2 | 4/2004 | Priley | |
| D490,262 | S | 5/2004 | Graves et al. | |
| 6,748,850 | B1 | 6/2004 | Kraan | |
| 6,777,007 | B2 | 8/2004 | Cai | |
| 6,805,042 | B2 | 10/2004 | Mordini et al. | |
| 6,832,542 | B2 | 12/2004 | Hu et al. | |
| 6,892,899 | B2 | 5/2005 | Minard et al. | |
| 6,929,150 | B2 | 8/2005 | Muderlak et al. | |
| 7,008,073 | B2 | 3/2006 | Stuhlmacher, II | |
| D530,954 | S | 10/2006 | Snell | |
| D531,440 | S | 11/2006 | Lo | |
| D531,845 | S | 11/2006 | Christianson | |
| D534,753 | S | 1/2007 | Christianson | |
| 7,178,746 | B2 | 2/2007 | Gross | |
| D554,412 | S | 11/2007 | Yang et al. | |
| 7,296,765 | B2 | 11/2007 | Rodrian | |
| D564,273 | S | 3/2008 | Yang et al. | |
| 7,337,635 | B2 | 3/2008 | Cerruti et al. | |
| D565,878 | S | 4/2008 | Krus | |
| 7,354,015 | B2 | 4/2008 | Byrd et al. | |
| D581,193 | S | 11/2008 | Ghiorghie | |
| D582,187 | S | 12/2008 | Yang et al. | |
| 7,479,000 | B2 * | 1/2009 | Klassen | 418/206.5 |
| D593,784 | S | 6/2009 | Chan | |
| 7,540,397 | B2 | 6/2009 | Muderlak et al. | |
| 7,637,893 | B2 * | 12/2009 | Christensen et al. | 604/167.04 |
| D608,578 | S | 1/2010 | Yang et al. | |
| D626,365 | S | 11/2010 | Yang et al. | |
| 8,087,543 | B2 | 1/2012 | Yang et al. | |
| 8,096,445 | B2 | 1/2012 | Yang et al. | |
| 8,109,411 | B2 | 2/2012 | Yang et al. | |
| D659,452 | S | 5/2012 | Yang et al. | |
| D659,454 | S | 5/2012 | Fritz et al. | |
| D661,531 | S | 6/2012 | Tompkin | |
| D663,983 | S | 7/2012 | Yang et al. | |
| D674,636 | S | 1/2013 | Yang et al. | |
| D693,597 | S | 11/2013 | Yang et al. | |
| 2002/0179643 | A1 | 12/2002 | Knight et al. | |
| 2002/0185002 | A1 * | 12/2002 | Herrmann | 92/129 |
| 2004/0032749 | A1 | 2/2004 | Schindler et al. | |
| 2004/0050875 | A1 | 3/2004 | Kobayashi | |
| 2004/0103792 | A1 | 6/2004 | Cirigliano et al. | |
| 2004/0134924 | A1 | 7/2004 | Hansen et al. | |
| 2004/0226962 | A1 | 11/2004 | Mazursky et al. | |
| 2005/0139612 | A1 | 6/2005 | Matthews et al. | |
| 2006/0067546 | A1 | 3/2006 | Lewis et al. | |
| 2006/0173576 | A1 | 8/2006 | Goerg et al. | |
| 2006/0243740 | A1 | 11/2006 | Reynolds et al. | |
| 2007/0000941 | A1 * | 1/2007 | Hadden et al. | 222/52 |
| 2007/0138208 | A1 * | 6/2007 | Scholz et al. | 222/179 |
| 2007/0158359 | A1 | 7/2007 | Rodrian | |
| 2007/0274853 | A1 | 11/2007 | Merendeiro et al. | |
| 2008/0185396 | A1 | 8/2008 | Yang et al. | |
| 2008/0185398 | A1 * | 8/2008 | Yang et al. | 222/52 |
| 2008/0277421 | A1 | 11/2008 | Zlatic et al. | |
| 2009/0026225 | A1 | 1/2009 | Lickstein | |
| 2009/0088836 | A1 * | 4/2009 | Bishop et al. | 623/2.1 |
| 2009/0140004 | A1 | 6/2009 | Scorgie | |
| 2010/0031982 | A1 * | 2/2010 | Hornsby et al. | 134/169 R |
| 2010/0282772 | A1 | 11/2010 | Ionidis | |
| 2011/0114669 | A1 | 5/2011 | Yang et al. | |
| 2013/0200097 | A1 | 8/2013 | Yang et al. | |
| 2013/0200109 | A1 | 8/2013 | Yang et al. | |

FOREIGN PATENT DOCUMENTS

| | | | |
|---|---|---|---|
| CA | 147357 | | 4/2013 |
| CN | 302362836 | S | 3/2013 |
| EP | 455431 | | 11/1991 |
| EP | 2322068 | A2 | 5/2011 |
| EP | 001342687-000 | | 9/2012 |
| JP | H07-23876 | | 1/1995 |
| JP | D1117308 | | 6/2001 |
| JP | D1266683 | | 2/2006 |
| KR | 3002845520000 | | 11/2001 |
| WO | WO 2008/095187 | | 8/2008 |
| WO | WO 2008/103300 | A2 | 8/2008 |
| WO | WO 2013/119642 | A1 | 8/2013 |
| WO | WO 2013/119874 | A1 | 8/2013 |

OTHER PUBLICATIONS

U.S. Appl. No. 29/386,854, filed Mar. 4, 2011, Yang et al.
U.S. Appl. No. 29/415,437, filed Mar. 9, 2012, Yang et al.
U.s. Appl. No. 29/415,443, filed Mar. 9, 2012, Yang et al.
International Search Report in corresponding International Patent Application No. PCT/US2012/027602, Aug. 20, 2012, 16 pages.
Manring et al, "The Theoretical Flow Ripple of an External Gear Pump," Transactions of the ASME, vol. 125, Sep. 2003, pp. 396-404.
The Sharper Image, Soap Genie™ S1335 Instructions, 8 pages, © 2005, 2006.
U.S. Appl. No. 29/447,095, filed Feb. 28, 2013, Yang et al.
International Preliminary Report on Patentability in corresponding PCT Application No. PCT/US2012/027602, mailed Sep. 19, 2013, in 11 pages.

* cited by examiner

SOAP DISPENSING UNITS WITH ANTI-DRIP VALVE

CROSS-REFERENCE TO RELATED APPLICATIONS

This application claims the priority benefit under 35 U.S.C. §119(e) of U.S. Provisional Patent Application No. 61/449,588, filed Mar. 4, 2011, and U.S. Provisional Patent Application No. 61/594,960, filed Feb. 3, 2012, the entirety of each of which is incorporated herein by reference.

BACKGROUND

1. Field

The present disclosure relates to soap dispensers, and more particularly, some embodiments relate to soap dispensers with anti-drip valves.

2. Description of the Related Art

Users of modern public washroom facilities increasingly desire that each of the fixtures in the washroom operate automatically without being touched by the user's hand. This is important in view of increased user awareness of the degree to which germs and bacteria may be transmitted from one person to another in a public washroom environment. Today, it is not uncommon to find public washrooms with automatic, hands-free operated toilet and urinal units, hand washing faucets, soap dispensers, hand dryers, and door opening mechanisms. This automation allows the user to avoid touching any of the fixtures in the facility, and therefore lessens the opportunity for the transmission of disease-carrying germs or bacteria resulting from manual contact with the fixtures in the washroom.

SUMMARY

An aspect of some of the embodiments disclosed herein includes the realization that in the art of discharge nozzles for viscous fluids, certain valves provide enhanced anti-drip and primability benefits over other valves. For example, some flap-type valves (e.g., reed valves, duckbill valves, or other valves that include a deflectable flap) tend to perform better in preventing unintended dripping from the discharge nozzle of a viscous fluid source, such as a liquid soap dispenser. Further, some valves can allow for the pump of a soap-dispensing system to be primed more easily yet still dispense the same amount or more soap with the same amount of energy as compared to soap pumps having different kinds of anti-drip valves.

For example, it has been found that anti-drip valves on electric soap dispensers which are formed by a valve seat and a spring-loaded valve body often times are configured to require 2.5 to 3 psi of liquid soap pressure before the spring biased valve body will move away from the valve seat to allow liquid soap to flow out. In this configuration, the spring provides sufficient force for pressing the valve body against the valve seat to prevent dripping when the pump is not operating. A significant amount of electrical energy, however, is required to generate pressures up to 2.5 to 3 psi in the viscous liquid soap. In contrast, flap-type valves, such as duckbill-type valves, can be configured to open at lower pressures, such as about 0.2 to about 0.3 psi of pressure, thereby requiring less electrical energy before soap will be discharged.

Another aspect of certain embodiments disclosed herein includes the realization that certain types of valves, such as the flap-type valves discussed above, can allow a liquid soap dispenser system to be configured for easier pump priming.

For example, in systems using flap-type valves, the high pressure side of the liquid soap pump can include a bypass passage directly connecting the discharge side to the associated liquid reservoir. In such a configuration, when the pump is at rest, the liquid soap from the reservoir can flow directly into the high pressure side of the pump and flow into the discharge side of the liquid soap discharge system. In some embodiments, the soap pump can remain primed at all times after the initial soap loading or at least between consecutive soap dispensing procedures. Such a passage also allows for some loss of efficiency when the soap pump is running; pressurized soap is forced back into the reservoir. However, even with such a loss of efficiency, the total electrical energy required for dispensing soap can be lower than that required for systems using other types of valves which require a higher soap pressure to open the valve.

In accordance with some embodiments, a portable soap dispenser includes a housing including a reservoir configured to store a volume of liquid soap. The dispenser can also include a fluid passage disposed in the housing. The fluid passage can have an inlet and an outlet. Further, the dispenser can include a vent in fluid communication with the volume of liquid soap in the reservoir. The vent can be configured to allow air to pass therethrough. A motor can be disposed in the housing and be configured to a drive a pump in fluid communication with the reservoir. The pump can be configured to encourage a flow of the liquid soap into the inlet and out of the outlet of the fluid passage. Certain variants have a nozzle in fluid communication with the outlet of the fluid passage. The nozzle can be supported by the housing and project outward from the housing so as to be at least partly visible to an observer outside of the dispenser. Certain embodiments of the dispenser include liquid soap.

In some embodiments, the nozzle comprises a flange and a duckbill valve. The flange can be configured to mate with an annular surface of the housing, thereby forming a generally liquid tight seal therebetween. In certain implementations, the duckbill valve includes a first deflectable member and a second deflectable member with a slit therebetween. The first deflectable member and the second deflectable member can be biased toward each other, thereby inhibiting soap from being dispensed from the dispenser until the bias has been overcome.

In certain variants, the first and second deflectable members, when viewed along the slit, form a generally hourglass shape. The first and second deflectable members can be configured such that the generally hourglass shape increases the bias between the first and second deflectable members. In some embodiments, at least one of the first and second deflectable members further comprises a notch generally aligned with the slit. The notch can be configured to facilitate overcoming the bias of the first and second deflectable members.

In accordance with some embodiments, the nozzle has an indentation and the fluid passage has a protrusion configured to receive at least a portion of the protrusion, thereby orienting the nozzle with respect to the fluid passage. In certain variants, the fluid passage has an angled member and the housing has a recess configured to receive at least a portion of the angled member, thereby orienting the fluid passage and the nozzle with respect to the housing.

In certain embodiments, the dispenser comprises a front and a back with a front-to-back axis therebetween. The nozzle can be positioned at or near the front of the dispenser and the slit being oriented substantially perpendicular to the front-to-back axis.

In some embodiments, the dispenser is configured to reverse the flow of soap after an amount of soap has been dispensed, thereby drawing an amount of soap in the nozzle toward the outlet of the fluid passage. In certain variants, the dispenser is configured to reverse the flow of soap after an amount of soap has been dispensed, thereby facilitating closure of the valve (e.g., duckbill valve). For example, in some embodiments, the dispenser reverses the flow of soap for a time period that is less than or equal to about: 0.1 second, 0.2 second, 0.3 second, 0.4 second, 0.5 second, 0.6 second, 0.7 second, 0.8 second, 0.9 second, 1.0 second, 1.5 seconds, 2.0 seconds, values in between, or otherwise. In certain implementations, the housing includes a body portion and an upper portion cantilevered from the body portion. The body portion can include the reservoir. The upper portion can include the nozzle. The nozzle can project downwardly from an end of the upper portion.

In certain embodiments, a soap dispenser has a housing including a reservoir configured to store a volume of liquid soap. Some variants have a fluid passage disposed in the housing. The fluid passage can have an inlet and an outlet. The dispenser can include a vent in fluid communication with the volume of liquid soap in the reservoir. The vent can be configured to allow air to pass therethrough. Some embodiments include a motor disposed in the housing. A pump mechanism can be disposed in the pump body and configured to be driven by the motor. Certain implementations have a staging chamber in fluid communication with the pump mechanism. Some embodiments include liquid soap.

Certain implementations have a pump body aperture in fluid communication with the reservoir and the staging chamber. The pump body aperture can be configured to facilitate a flow of the liquid soap into the staging chamber. The pump body aperture can be configured to inhibit the trapping of an air bubble within the staging chamber that impedes liquid soap from flowing through the pump body aperture and into the staging chamber. In some embodiments, the pump body aperture is connected directly with the reservoir.

The staging chamber can be configured to receive a primed volume of liquid soap. The staging chamber can be configured to retain the primed volume of liquid soap for a period of time. The staging chamber can be configured to dispense at least some of the primed volume of liquid soap to the pump mechanism during operation of the dispenser.

In certain embodiments, the pump mechanism includes a pump outlet having a centerline. The pump body aperture can have a first dimension and a second dimension. The first dimension can be generally parallel with the centerline and the second dimension can be substantially perpendicular to the centerline. In some embodiments, the first dimension is greater than the second dimension. In some embodiments, the second dimension is greater than the first dimension.

Some embodiments have a flexible cushion. The flexible cushion can be configured, for example, to inhibit noise emitted by the pump mechanism from being transmitted into the ambient environment. Some variants of the flexible cushion have a void configured to correspond with the pump body aperture. In certain embodiments, some or all of the reservoir is positioned at a higher elevation than the pump body aperture.

In accordance with some embodiments, a soap dispenser includes a housing and a reservoir positioned in the housing. The reservoir can be configured to store a volume of liquid soap. The dispenser can further include a fluid passage positioned in the housing. The fluid passage can have a fluid inlet and a fluid outlet. A vent can be disposed in fluid communication with the reservoir. The vent can be configured to allow air to pass therethrough.

A pump body can be positioned in the housing and can comprise a pump inlet and a pump outlet. In some implementations, a gear pump assembly is positioned in the pump body. The gear pump assembly can have a first gear and a second gear. In some embodiments, the first and second gears are substantially identical. In certain embodiments, some or all of the first and second gears include a plurality of teeth. Some or all of the teeth can have a tip with a substantially pointed peak.

A motor can be positioned in the housing. The motor can be configured to rotate the first gear. The first gear can be configured to matingly engage the second gear such that rotation of the first gear results in rotation of the second gear. The first and second gears can thereby cooperate to encourage a flow of the liquid soap into the pump body via the pump inlet and out of the pump body via the pump outlet.

In some embodiments, the substantially pointed peak comprises a tip radius. In some embodiments, the tip radius can be less than or equal to about 0.5 mm.

In certain variants, some or all of the first and second gears comprise a root intermediate adjacent pairs of the teeth. In some implementations, the tip radius is less than the root radius. For example, in certain embodiments, the tip radius is less than or equal to about 1/20 of the root radius.

In some embodiments, some or all of the teeth comprise a tooth width and a tip width. At least one of the teeth can have a tip width that is less than or equal to about 1/10 of the tooth width.

In certain implementations, the dispenser includes a duckbill valve in fluid communication with the pump outlet. The duckbill valve can be supported by the housing and project outward from the housing so as to be at least partly visible to an observer outside of the dispenser.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure.

DETAILED DESCRIPTION

A variety of soap dispensers are described below to illustrate various examples that may be employed to achieve one or more desired improvements. These examples are only illustrative and not intended in any way to restrict the general inventions presented and the various aspects and features of these inventions. Furthermore, the phraseology and terminology used herein is for the purpose of description and should not be regarded as limiting. No features, structure, or step disclosed herein is essential or indispensible.

Figure 1:
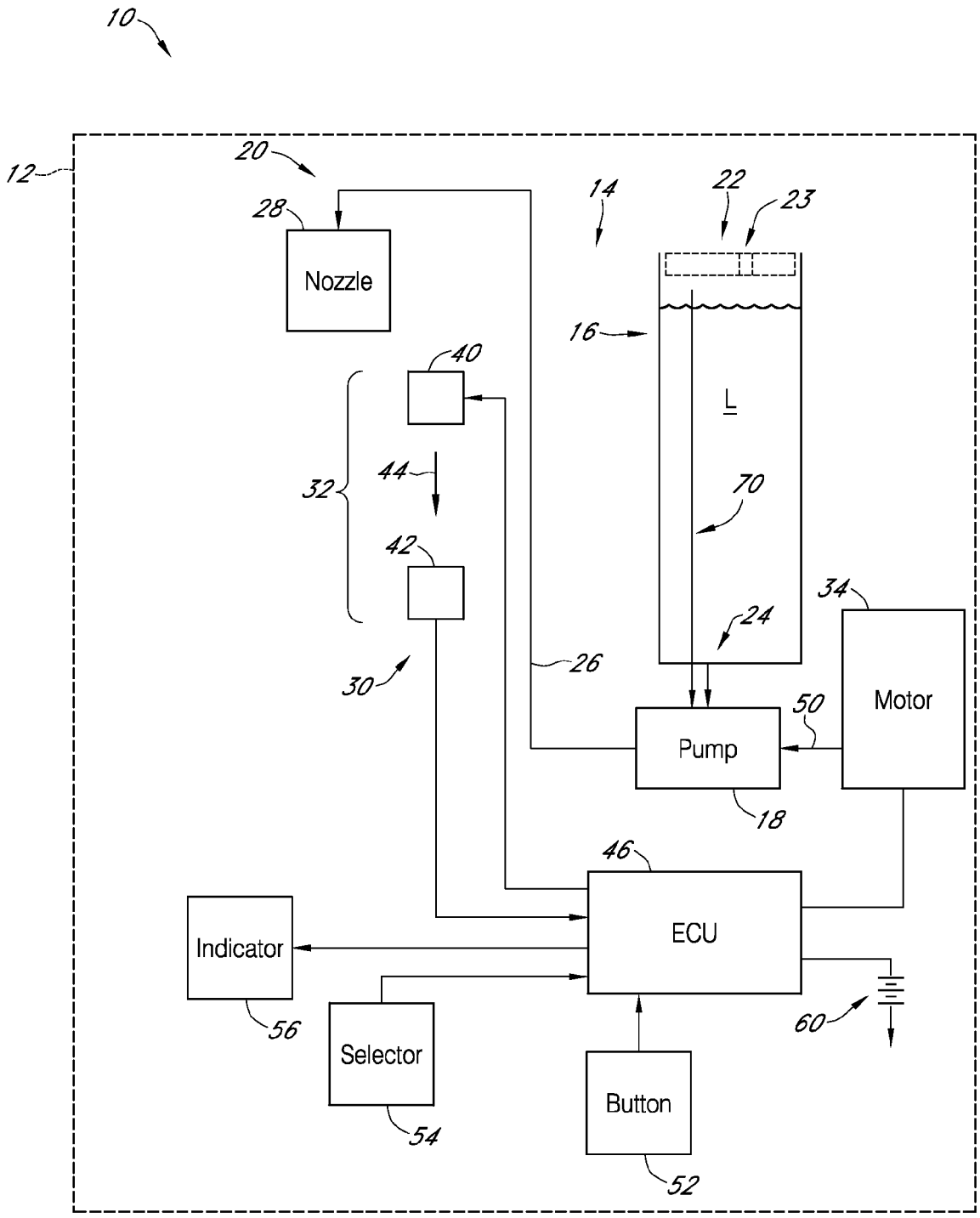
FIG. 1 schematically illustrates an automatic liquid soap dispenser.

With reference to FIG. 1, a liquid soap dispenser 10 can include a housing 12, which can take any shape. The dispenser 10 can also include a liquid handling system 14. The liquid handling system 14 can include a reservoir 16, a pump 18, and a discharge assembly 20.

The reservoir 16 can be any type of container. In the illustrated embodiment, the reservoir 16 is configured to contain a volume of liquid soap L, such as for hand washing. In some embodiments, the reservoir 16 can include a lid 22 configured to form a seal at the top of the reservoir 16 for maintaining the liquid soap L within the reservoir 16. Additionally, in some embodiments, the lid 22 can include an air vent 23, which can allow air to enter the reservoir 16 as the level of liquid soap L falls within the reservoir 16.

The reservoir 16 can also include an outlet 24 disposed at a lower end of the reservoir 16. In certain embodiments, the reservoir 16 can be connected to the pump 18 through the opening 24.

In some embodiments, the pump 18 can be disposed below (e.g., directly below) the outlet 24 of the reservoir 16. In certain embodiments, the pump 18 can be automatically primed due to the force of gravity drawing liquid soap L into the pump 18 through the opening 24. The pump 18 can be connected to the discharge system 20 with a conduit 26. Any type or diameter of conduit can be used.

In certain embodiments, the discharge assembly 20 includes a flap-type discharge nozzle 28, as described in further detail below. The discharge nozzle 28 can be configured to provide the appropriate flow rate and/or resistance against flow of liquid soap L from the pump 18.

In some embodiments, the nozzle 28 can be disposed at a location spaced from the lower portion of the housing 12 so as to make it more convenient for a user to place their hand or other body part under the nozzle 28.

The dispenser 10 can also include a power supply 60. In some embodiments, the power supply 60 is a battery. In certain embodiments, the power supply 60 includes electronics for accepting AC or DC power. In some implementations, the power supply 60 is configured to interface with a standard domestic electrical supply (e.g., 120 volt alternating current).

In certain embodiments, the dispenser 10 has a pump actuation system 30, which in turn includes a sensor device 32 and a light receiving portion 42. In some embodiments, a beam of light 44 can be emitted from the light emitting portion 40 and received by the light receiving portion 42.

The sensor 32 can be configured to emit a trigger signal when the light beam 44 is blocked. For example, if the sensor 32 is activated, and the light emitting portion 40 is activated, but the light receiving portion 42 does not receive the light emitted from the light emitting portion 40, then the sensor 32 can emit a trigger signal. This trigger signal can be used for controlling operation of the motor or an actuator 34, described in greater detail below. This type of sensor can provide further advantages.

For example, because in some embodiments the sensor 32 is an interrupt-type sensor, it can be triggered when a body is disposed in the path of the beam of light 44. The sensor 32 is not or need not be triggered by movement of a body in the vicinity of the beam 44. Rather, in some embodiments, the sensor 32 can be triggered only if the light beam 44 is interrupted. To provide further or alternative prevention of unintentional triggering of the sensor 32, the sensor 32, including the light emitting portion 40 and the light receiving portion 42, can be recessed in the housing 12.

In addition to these advantages, other advantages can also be provided. For example, the sensor 32 only requires enough power to generate the low power beam of light 44, which may or may not be visible to the human eye, and to power the light receiving portion 42. These types of sensors require far less power than infrared or motion-type sensors. Additionally, the sensor 32 can be operated in a pulsating mode. For example, the light emitting portion 40 can be powered on and off in a cycle such as, for example, for short bursts lasting for any desired period of time (e.g., less than or equal to about 0.01 second, less than or equal to about 0.1 second, or less than or equal to about 1 second) at any desired frequency (e.g., once per half second, once per second, once per ten seconds). These different time characteristics can be referred to as an activation period or frequency, which corresponds to the periodic activation of the sensor 32. Thus, an activation frequency of four times per second would be equivalent to an activation period of once per quarter second.

The other aspect of this characteristic can be referred to as an activation duration. Thus, if the sensor 32 is activated for 50 microseconds, 50 microseconds is the activation duration time period. Cycling can greatly reduce the power demand for powering the sensor 32. In operation, cycling does not degrade performance in some embodiments because the user generally maintains his or her body parts or other appendage or device in the path of the light beam 44 long enough for a detection signal to be generated and to trigger the sensor 32.

The sensor 32 can be connected to a circuit board, an integrated circuit, or other device for triggering the actuator 34. In the illustrated embodiment, the sensor 32 is connected to an electronic control unit ("ECU") 46. However, other arrangements can also be used.

The ECU 46 can include one or a plurality of circuit boards, which can provide hard wired feedback control circuits, a processor and memory devices for storing and performing control routines, or any other type of controller. In some embodiments, the ECU 46 can include an H-bridge transistor/MOSFET hardware configuration which allows for bidirectional drive of an electric motor, and a microcontroller such as Model No. PIC16F685 commercially available from Microchip Technology Inc., and/or other devices.

The actuator 34 can be any type of actuator. For example, the actuator 34 can be an AC or DC electric motor, stepper motor, server motor, solenoid, stepper solenoid, or any other type of actuator. In some embodiments, the actuator 34 can be connected to the pump 18 with a transmitter device 50. For example, the transmitter device 50 can include any type of gear train or any type of flexible transmitter assembly.

The dispenser 10 can also include a user input device 52. The user input device 52 can be any type of device allowing a user to input a command into the ECU 46. In some embodiments, the input device 52 is in the form of a button configured to allow a user to depress the button so as to transmit a command to the ECU 46. For example, the ECU 46 can be configured to actuate the actuator 34 to drive the pump 18 any time the input device 52 is actuated by a user. The ECU 46 can also be configured to provide other functions upon the activation of the input device 52, described in greater detail below.

The dispenser 10 can also include a selector device 54. The selector device 54 can be any type of configuration allowing the user to input a proportional command to the ECU 46. For example, the selector can have at least two positions, such as a first position and a second position. The position of the input device 54 can be used to control an aspect of the operation of the dispenser 10.

For example, the input device 54 can be used as a selector for allowing a user to select different amounts of liquid soap L to be dispensed from the nozzle 28 during each dispensation cycle. When the input device 54 is in a first position, the ECU 46 can operate the actuator 34 to drive the pump 18 to dispense a predetermined amount of liquid soap L from the nozzle 28, each time the sensor 32 is triggered. When the input device 54 is in the second position, the ECU 46 can actuate the actuator 34 to dispense a larger amount of liquid soap L from the nozzle 28.

In some embodiments, the input device 54 can provide a virtually continuous range of output values to the ECU 46, or a larger number of steps, corresponding to different volumes of liquid soap L to be dispensed each dispensation cycle performed by the ECU 46. Although the positions of the input device 54 may correspond to different volumes of liquid soap L, the ECU 46 can correlate the different positions of the input device 54 to different duty cycle characteristics or durations of operation of the actuator 34, thereby at times discharging differing or slightly differing volumes of liquid soap L from the nozzle 28.

The dispenser 10 can also include an indicator device 56 configured to issue a visual, aural, or other type of indication to a user of the dispenser 10. For example, in some embodiments, the indicator 56 can include a light and/or an audible tone perceptible to the operator of the dispenser 10. In some embodiments, the ECU 46 can be configured to actuate the indicator 56 to emit a light and/or a tone after a predetermined time period has elapsed after the actuator 34 has been driven to dispense a predetermined amount of liquid soap L from the nozzle 28. The indicator 56 can provide a reminder to a user of the dispenser 10 to continue to wash their hands until the indicator 56 has been activated. This predetermined time period can be at least about 20 seconds, although other amounts of time can also be used. The indicator 56 can be used for other purposes as well.

Further advantages can be achieved where the indicator 56 is activated for a predetermined time after the pump has completed a pumping cycle (described in greater detail below with reference to FIG. 4). For example, the ECU 46 can be configured to activate the indicator 56 for 20 seconds after the pump 18 has been operated to discharge an amount of soap from the nozzle 28. The indicator 56 can be activated at the appropriate time for advising users as to how long they should wash their hands.

In some embodiments, the indicator 56 can be a Light Emitting Diode (LED) type light, and can be powered by the ECU 46 to blink throughout the predetermined time period. Thus, a user can use the length of time during which the indicator 56 blinks as an indication as to how long the user should continue to wash their hands with the soap disposed from the nozzle 28. Other types of indicators and predetermined time periods can also be used.

In operation, the ECU 46 can activate the sensor 32, continuously or periodically, to detect the presence of an object between the light emitting portion 40 and the light receiving portion 42 thereof. When an object blocks the light beam 44, the ECU 46 determines that a dispensing cycle should begin. The ECU 46 can then actuate the actuator 34 to drive the pump 18 to thereby dispense liquid soap L from the nozzle 28.

As noted above, in some embodiments, the ECU 46 can vary the amount of liquid soap L dispensed from the nozzle 28 for each dispensation cycle, depending on a position of the selector 54. Thus, for example, the dispenser 10 can be configured to discharge a first volume of liquid soap L from the nozzle 28 when the selector is in a first position, and to discharge a second different amount of liquid soap L when the selector 54 is in a second position.

As noted above, the indicator 56 can be activated, by the ECU 46, after a predetermined amount of time has elapsed after each dispensation cycle. Further, the ECU 46 can be configured to cancel or prevent the indicator 56 from being activated if the button 52 has been actuated in accordance with a predetermined pattern. For example, the ECU 46 can be configured to cancel the activation of the indicator 56 if the button 52 has been pressed twice quickly. However, any pattern of operation of the button 52 can also be used as the command for canceling the indicator 56. The dispenser 10 can include other input devices for allowing a user to cancel the indicator 56.

In some embodiments, the ECU 46 is configured to continuously operate the actuator 34 or to activate the actuator 34 for a maximum predetermined time when the button 52 is depressed. This can allow an operator of the dispenser 10 to manually operate the dispenser to continuously discharge or discharge larger amounts of liquid soap L when desired. For example, if a user of the dispenser 10 wishes to fill a sink full of soapy water for washing dishes, the user can simply push the button 52 and dispense a larger amount of soap than would normally be used for washing one's hands, such as at least about 3 milliliters or at least about 4 milliliters. However, other configurations can also be used.

Figure 2:
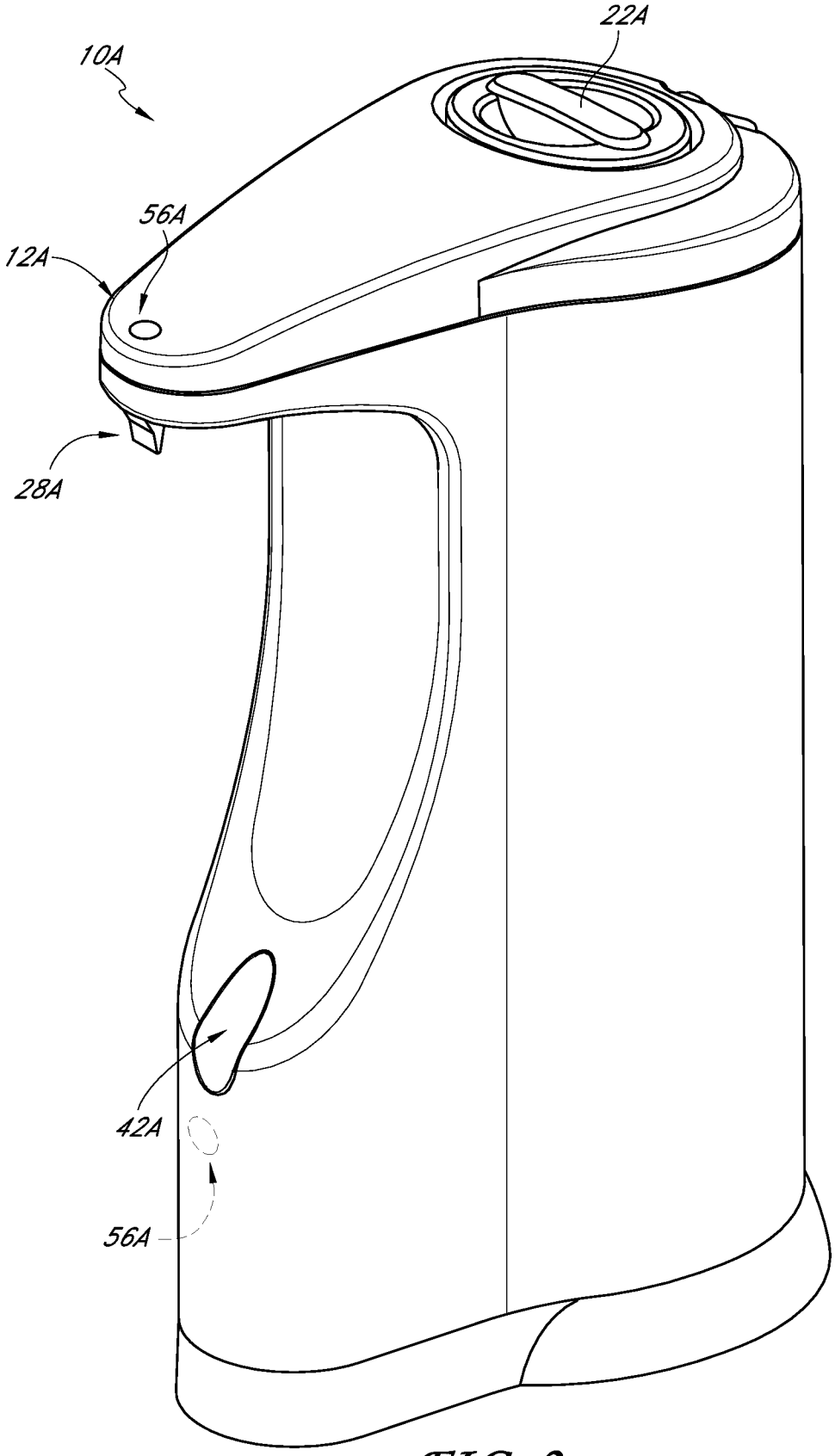
FIG. 2 illustrates a front, top, left side perspective view of an embodiment of an automatic liquid soap dispenser.
Figure 3:
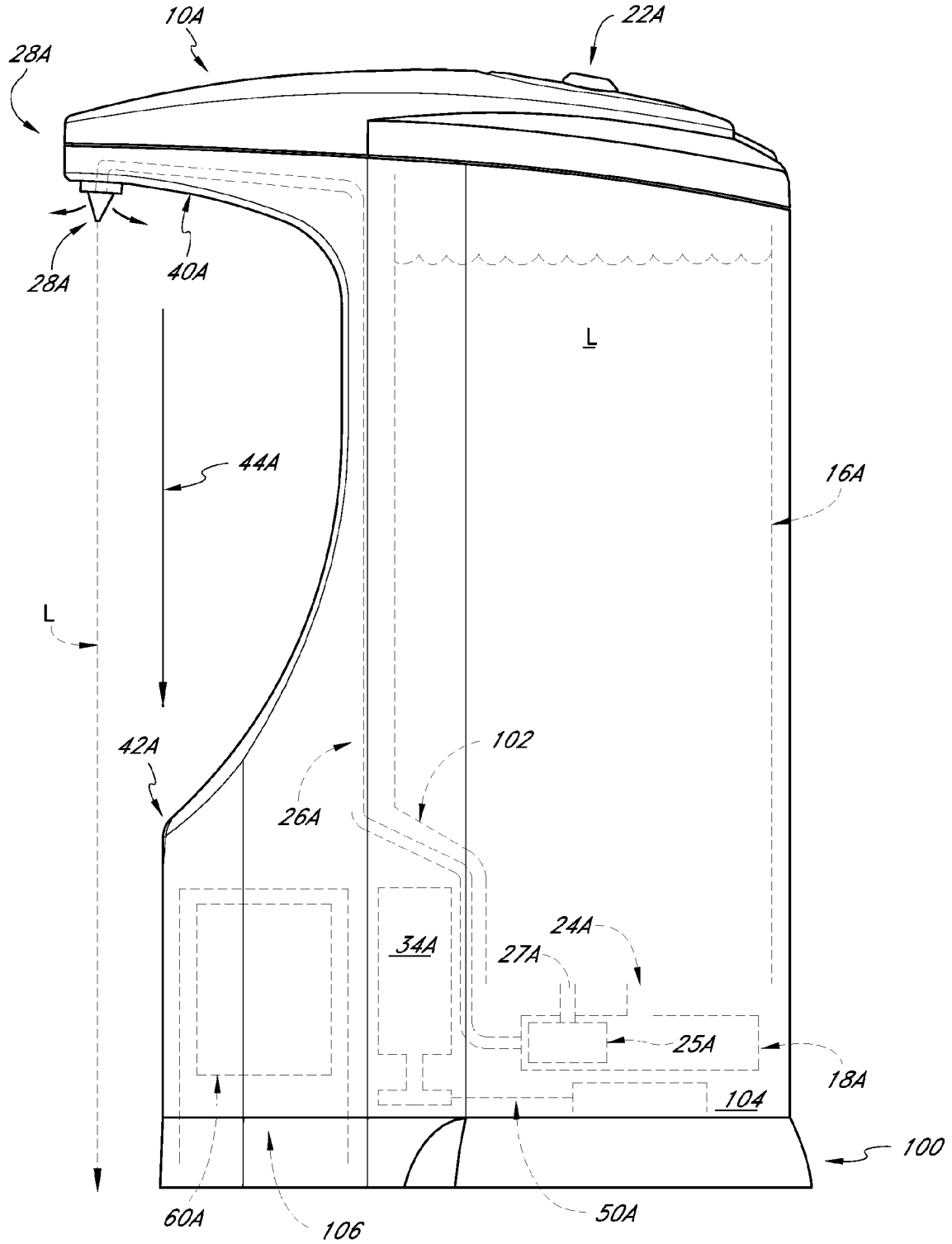
FIG. 3 illustrates a left side elevational view of the liquid soap dispenser of FIG. 2.

FIGS. 2 and 3 illustrate a modification of the dispenser 10, identified generally by the reference numeral 10A. Some of the components of the dispenser 10A can be the same, similar, or identical to the corresponding components of the dispenser 10 illustrated in FIG. 1. These corresponding components are identified with the same reference numeral, except that an "A" has been added thereto.

As shown in FIGS. 2 and 3, the lower portion 100 of the dispenser 10A is designed to support the housing 12A on a generally flat surface, such as those normally found on a countertop in a bathroom or a kitchen. Further, some embodiments of the dispenser 10A are movable. For example, the dispenser 10A can be readily relocated from one position to another position on a countertop. In some implementations, the dispenser 10A is not attached, embedded, or otherwise joined with a surface that supports the dispenser 10A. For example, certain implementations of the dispenser 10A are not mounted to, or recessed in, a countertop or wall.

In some embodiments, the nozzle 28 can be disposed in a manner such that the nozzle 28A extends outwardly from the periphery defined by the lower portion 100. If a user misses soap dispensed from the nozzle 28A, and the soap L falls, it will not strike on any portion of the housing 12A. This helps prevent the dispenser 10A from becoming soiled from dripping soap L. The configuration and functionality of the nozzle 28A is described in greater detail below with reference to FIGS. 10-16.

In some embodiments, the indicator 56, which can be a visual indicator such as an LED light, can be positioned on the outer housing 12A, above the nozzle 28A. As such, the indicator 56A can be easily seen by an operator standing over the pump. Additionally, in some embodiments, the visual type indicator 56A can be disposed on a lower portion of the housing (illustrated in phantom line). However, the indicator 56A can also be positioned in other locations.

As shown in FIG. 3, the reservoir 16A can be disposed within the housing 12A. The pump 18A can be disposed beneath the reservoir 16A such that the outlet 24A of the reservoir 16A feeds into the pump 18A. As noted above, this can help the pump 18A to achieve a self-priming state due to the force of gravity drawing liquid soap L through the outlet 24A into the pump 18A.

In some embodiments, the reservoir 16A can include a recess 102. The actuator 34A can be disposed somewhat nested with the reservoir 16A. This can provide for a more compact arrangement and allow the reservoir 16A to be larger.

In some embodiments, the housing 12A includes a first chamber 104 and a second chamber 106. The pump 18A and actuator 34A can be disposed within the first chamber 104 and the power supply 60A can be disposed in the second chamber 106. In some embodiments, the chambers 104, 106 can be defined by inner walls of the housing 12A and/or additional walls (not shown).

Figure 4:
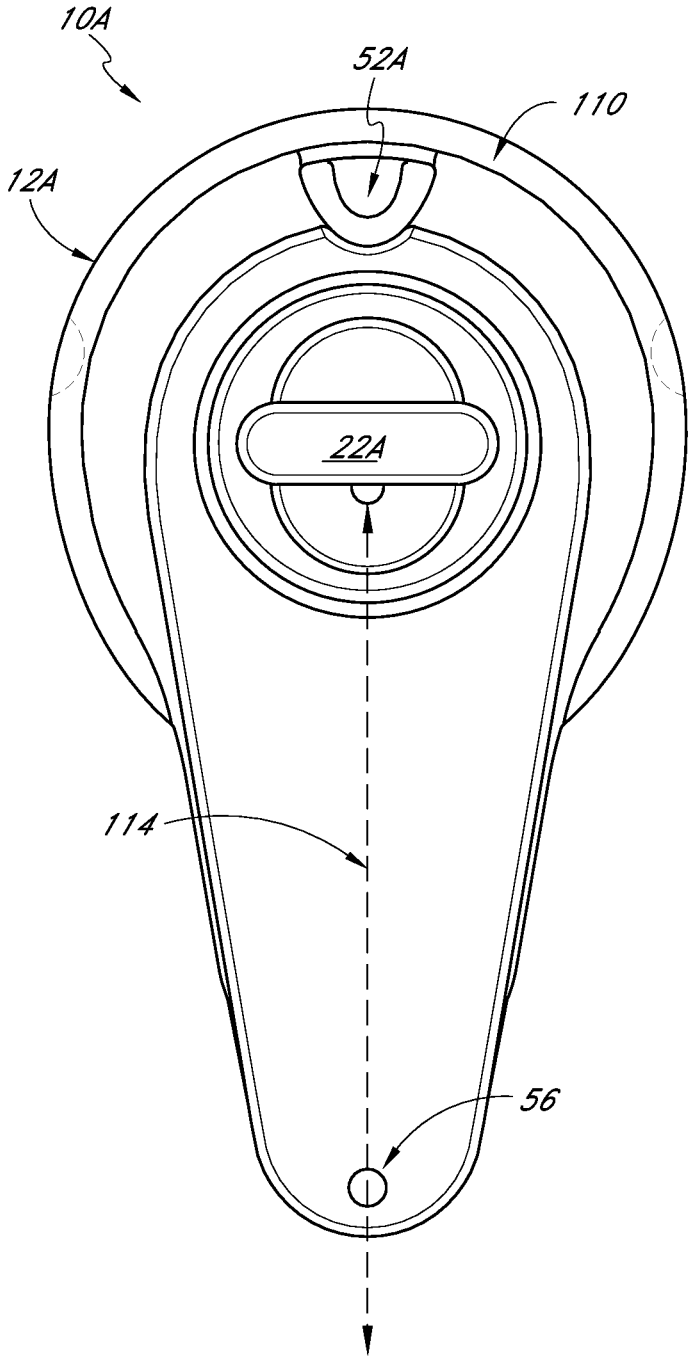
FIG. 4 illustrates a top plan view of the liquid soap dispenser of FIG. 2.
Figure 5:
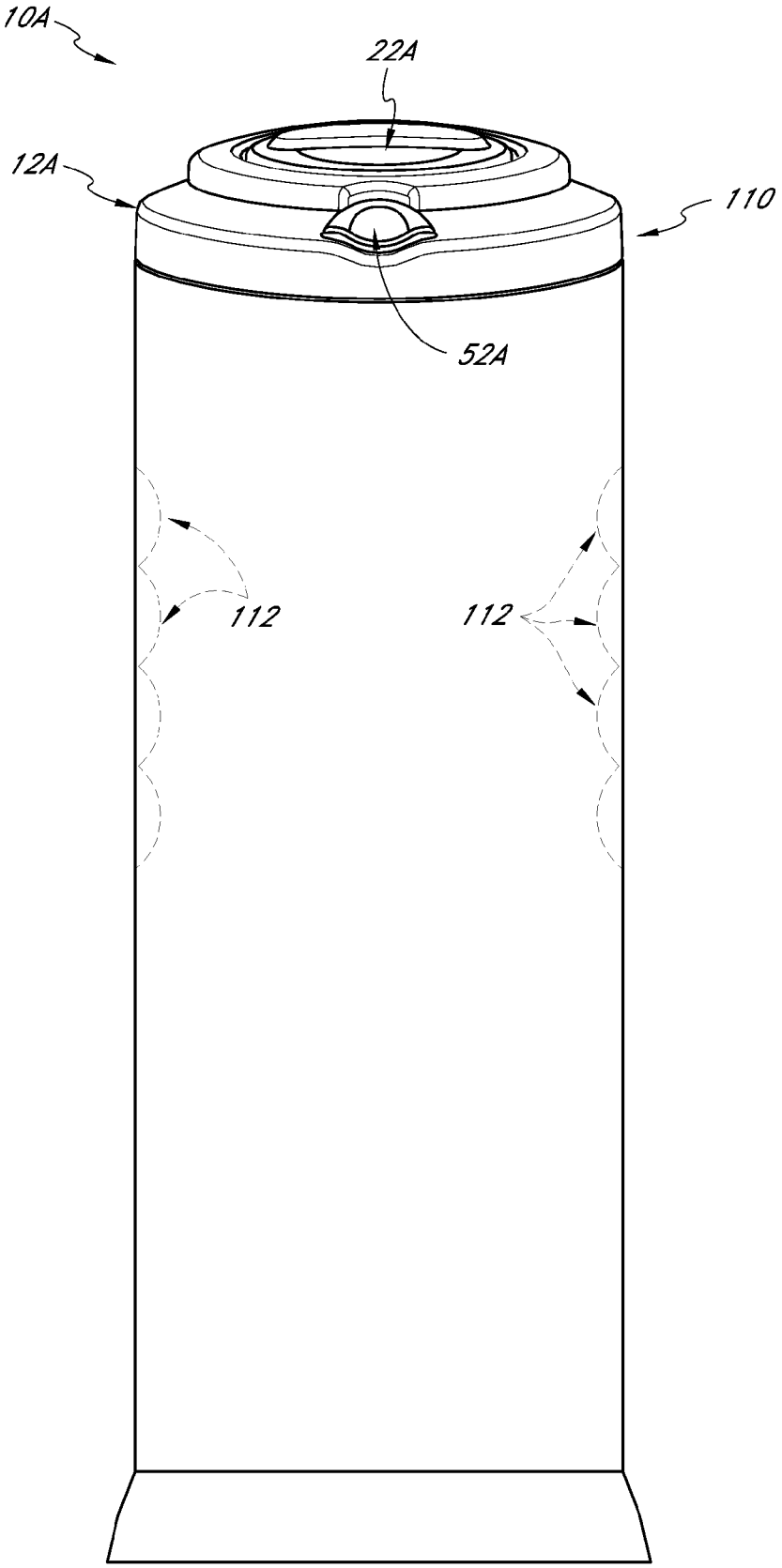
FIG. 5 illustrates a rear elevational view of the liquid soap dispenser of FIG. 2.

With reference to FIGS. 4 and 5, the button 52A can be disposed anywhere on the housing 12A. In some embodiments, as shown in FIGS. 4 and 5, the button 52A can be disposed on an upper portion 110 of the housing 12A. The button 52A can be positioned conveniently for actuation by a user of the dispenser 10A.

Further, in some embodiments, the button 52A can be disposed proximate to an outer periphery of the housing 12A, on the upper portion 110, and approximately centered along a rear surface of the housing 12A. This can provide a location in which a user can easily grasp the outer surface of the housing 12A with three fingers and their thumb, and actuate the button 52A with their index finger.

Certain embodiments of the housing 12A include surface textures 112 configured to allow a user to obtain enhanced grip on the housing 12A when attempting to lift the dispenser 10A and depress the button 52A. Such surface textures 112 can have any configuration, such as ridges, bumps, knurls, groves, divots, holes, or otherwise. In some embodiments, the surface textures 112 are in the form of finger shaped recesses.

Figure 6:
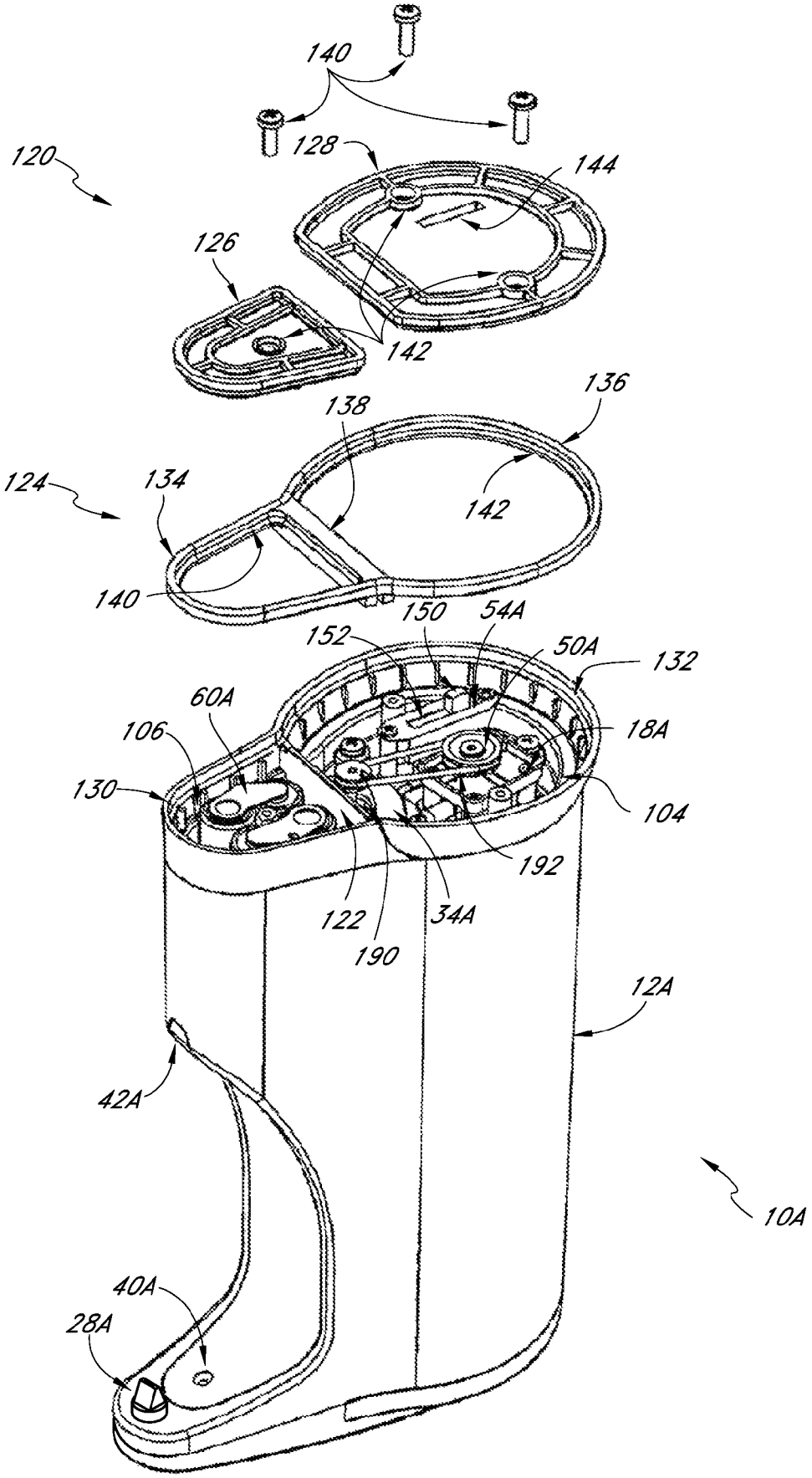
FIG. 6 illustrates a front, bottom, right side exploded perspective view of the liquid soap dispenser in FIG. 2, showing a pump and motor cavity cover member, a battery compartment cover member, and a gasket separated from the main housing thereof.

With reference to FIG. 6, as noted above, the dispensers 10, 10A can include a support member arrangement 120 that can achieve the dual functions of providing a support leg or foot for the associated dispenser and provide a sealing function for internal cavities disposed within the associated dispenser.

As noted above, the dispenser 10A can include first and second chambers 104, 106 for containing the power supply 60A and the pump 18A and actuator 34A, respectively. Certain implementations include an interior compartment. As shown in FIG. 6, an interior wall 122 can be disposed between the chambers 104, 106.

The sealing arrangement 120 can include a gasket member 124 and lid members 126, 128. The gasket 124 can be configured to extend around an opening 130 of the compartment 106 and an opening 132 of the compartment 104. Thus, in some embodiments, the gasket member 124 can include a battery compartment portion 134 and a pump and motor compartment portion 136.

The battery compartment portion 134 can be configured to extend around an interior periphery of the opening 130. However, this is just one configuration that can be used. The portion 134 can be configured to straddle a lower-most edge of the opening 130, or to extend around an outer periphery of the opening 130.

Similarly, the portion 136 can be configured to extend along an inner periphery of the opening 132. In some embodiments, the portions 134, 136 are configured to rest against a shelf defined along the inner peripheries of the openings 130, 132. However, other configurations can also be used.

A center dividing portion 138 of the gasket 124 can be configured to form a seal along the lower-most edge of the wall 122.

The gasket member 124 can be configured to extend around an opening 130 of the chamber 106 and an opening 132 of the chamber 104. The lid members 126, 128 can be configured to rest against inner walls 140, 142 defined by the portions 134, 136, respectively. The lid members 126, 128 can be configured to form seals with the inner peripheral walls 140, 142, respectively. In certain such instances, the seals help protect the components disposed within the chambers 104, 106.

As shown, in some embodiments, the gasket member 124 can include a battery compartment portion 134 and a pump and motor compartment portion 136. The battery compartment portion 134 can be configured to extend around an interior periphery of the opening 130. The portion 134 can be configured to straddle a lower-most edge of the opening 130, or to extend around an outer periphery of the opening 130. Similarly, the motor compartment portion 136 can be configured to extend along an inner periphery of the opening 132. In some embodiments, the portions 134, 136 are configured to rest against a shelf defined along the inner peripheries of the openings 130, 132.

In some embodiments, fasteners 140 can be used to secure the lid members 126, 128 to the housing 12A. For example, the lid members 126, 128 can include apertures 142 through which the fasteners 140 can extend. The fasteners 140 can engage mounting portions disposed within the housing 12A. As such, the lid members 126, 128 can be secured to the housing 12A and form a seal with the gasket member 124.

In certain implementations, at least one of the lid members 126, 128 includes an additional aperture 144 configured to allow access to a device disposed in one of the chambers 104, 106. In the illustrated embodiment, the aperture 144 is in the form of a slot. However, any type of aperture can be used.

The slot 144 can be configured to allow a portion of the selector 54 to extend therethrough. For example, the selector 54A is in the configuration of a slider member 150 slidably disposed in a housing 152. For example, the selector 54 can be in the configuration of a rheostat or other type of input device that allows for a proportional signal.

For example, as noted above, the housing 152 can be configured to allow the slider member 150 to be slid between at least two positions. For example, the two positions can be a first position corresponding to a first amount of liquid soap L to be discharged by the nozzle 28A and a second position corresponding to a second larger volume of liquid soap L to be discharged by the nozzle 28A. The housing 152 can be configured to allow the slider member 150 to be slid between a plurality of steps or continuously along a defined path to provide continuously proportional signals or a plurality of steps.

In some embodiments, with the gasket member 124 and lid member 128 in place, the slider member 150 can be configured to extend through the slot 144 such that a user can conveniently move the slider member 150 with the lid 128 in place. In some embodiments, the slider member 150 can be smaller such that a thin object such as a pen can be inserted into the slot 144 to move the slider member 150. Other configurations can also be used.

With continued reference to FIG. 6, when the lid members 126, 128 and gasket member 124 are in place, the chambers 104, 106 are substantially sealed and thus protected from the ingress of water and/or other substances. Additionally, as noted above, the gasket member 124 can be configured to extend downwardly from the housing 12A such that the gasket member 124 defines the lower-most portion of the device 10A. The gasket member can provide a foot or a leg for supporting the device 10A.

Further, in a configuration in which the lower-most edge of the gasket member 124 is substantially continuous and smooth, the gasket member 124 can provide a suction cup-like effect when it is placed and pressed onto a smooth surface. For example, where the gasket member 124 is made from a soft or resilient material, by pressing the device 10A downwardly when it is resting on a smooth surface, air can be ejected from the space between the lid members 126, 128 and the surface upon which the device 10A is resting. When the device 10A is released, the slight movement of the device 10A upwardly can result in suction within that space, thereby creating a suction cup-like effect. This effect provides a further advantage in helping to secure or otherwise anchor the device 10A in place on a counter, which can become wet and/or slippery during this period.

Figure 8:
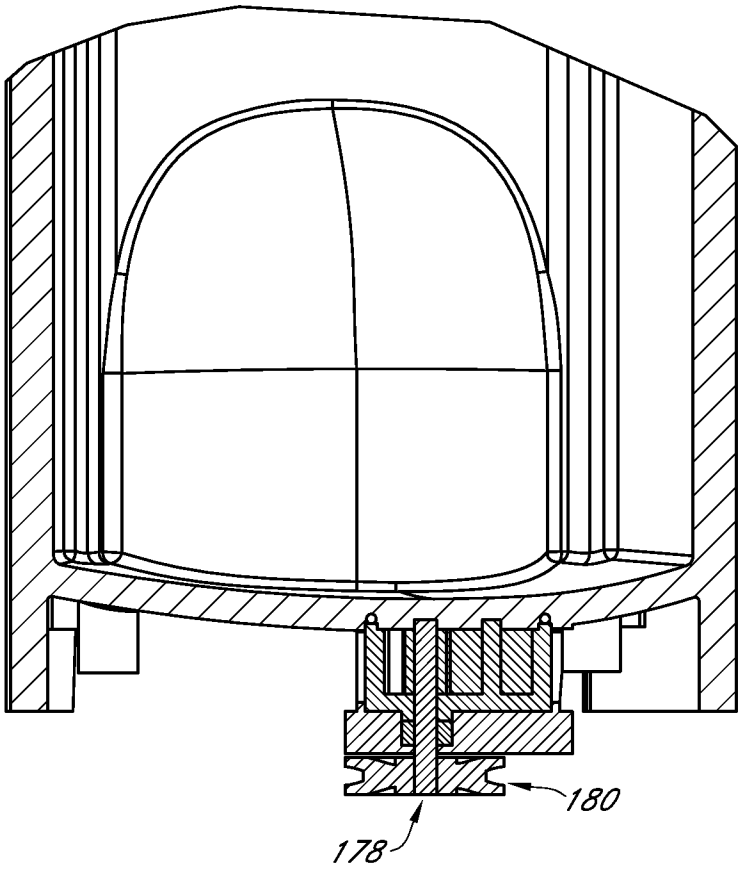
FIG. 8 illustrates another sectional view of the pump, pump cover, and drive sheave illustrated in FIG. 7.
Figure 7:
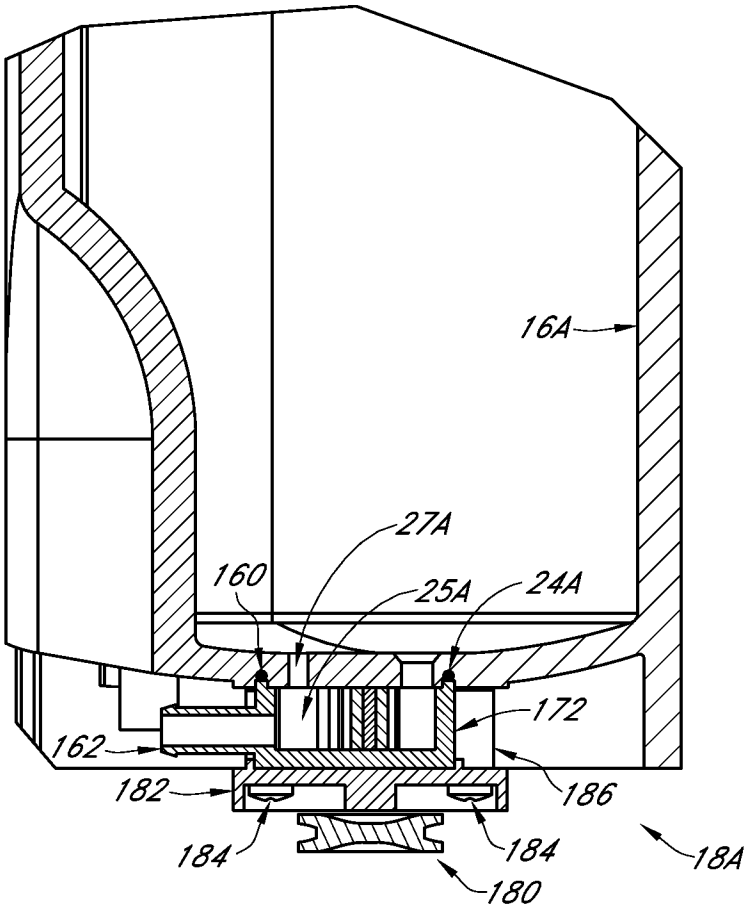
FIG. 7 illustrates a partial sectional view of a liquid soap reservoir of the liquid soap dispenser of FIG. 2, including a portion of the reservoir, pump, pump cover, and drive sheave.
Figure 9:
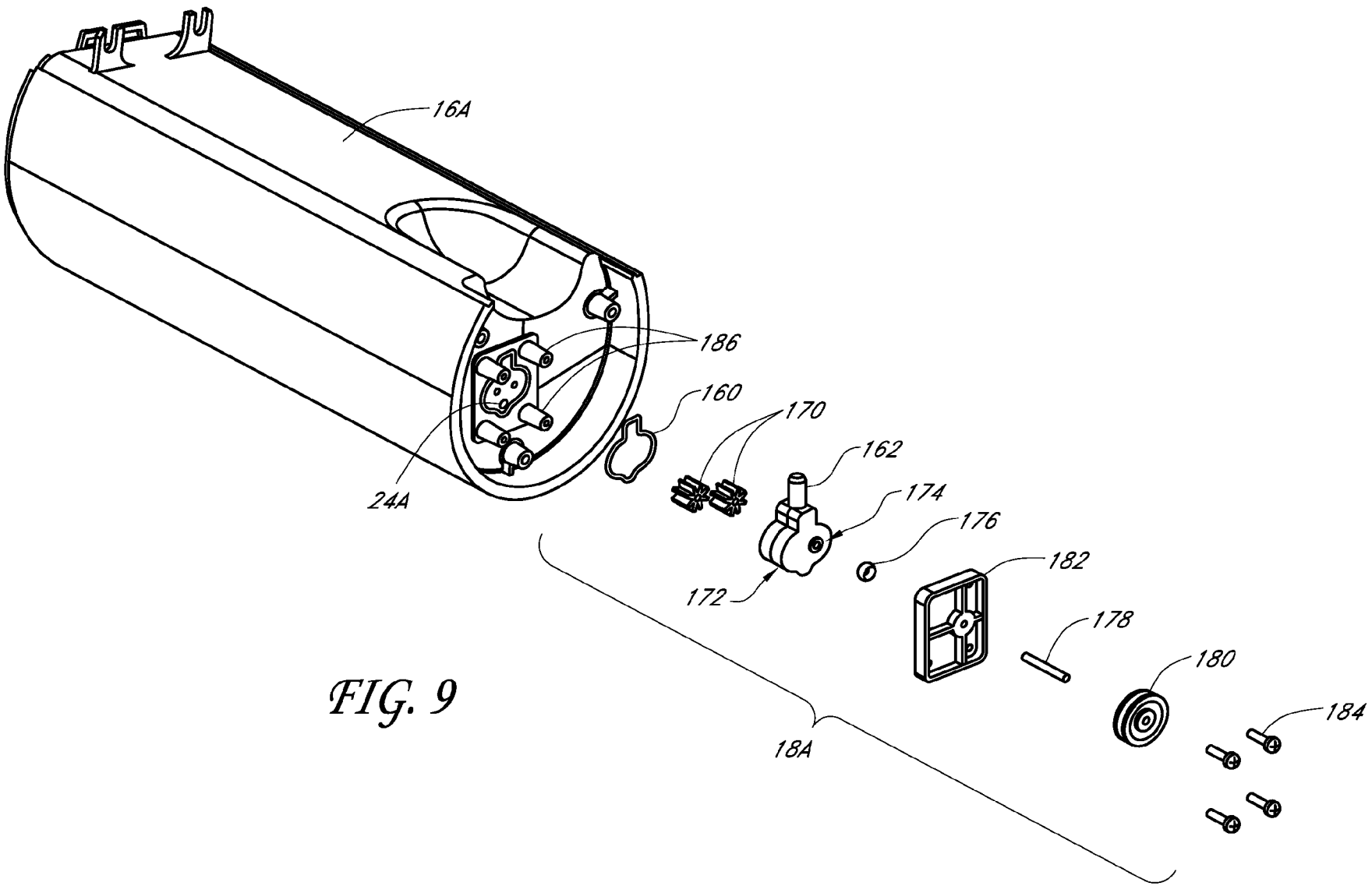
FIG. 9 illustrates a partial front, left, bottom perspective view of the liquid soap dispenser of FIG. 2 with the pump exploded and separated from the bottom of the dispenser.

With reference to FIGS. 7-9, the pump 18A can be configured to be a reversible pump. For example, in the illustrated embodiment, the pump 18A is a gear-type pump. This type of a pump can be operated in forward or reverse modes. In some embodiments, a pump can provide a compact arrangement and can provide a 90 degree turn which provides a particularly compact arrangement in the device 10A. For example, as shown in FIG. 7, the outlet 24A of the reservoir 16A feeds directly into an inlet of the pump 18A. In the illustrated embodiment, a lower-most surface of the reservoir 16A defines an upper wall of the pump 18A. Thus, the outlet 24A also forms the inlet to the pump 18A. A gasket 160 can extend around the outlet 24A and be configured to form a seal with a body of the pump 18A.

With continued reference to FIG. 7, an outlet 162 of the pump 18A is connected to an outlet chamber of the pump 18A. Although not illustrated in FIG. 7, the outlet 162 is connected to the conduit 26A so as to connect the outlet 162 to the nozzle 28A.

Returning to FIG. 3, the pump chamber 18A can include an outlet chamber 25A. The outlet chamber 25A is an area within the pump in which higher pressures of the viscous fluid are generated during pump operation, i.e., pressures that are higher than the pressure at the inlet 24A. Thus, this high pressure area within the pump drives the viscous fluid out of the pump, through the conduit 26A, and through the nozzle 28A.

In some embodiments, the dispenser 10A can include a bypass passage 27A connecting the interior of the reservoir 16A with the outlet chamber 25A. When the pump 18A is not operating, liquid soap L from the reservoir 16A can flow through the bypass passage 27A, into the outlet chamber 25A, then into the conduit 26A. When the dispenser 10A is at rest, liquid soap L flows up into the conduit 26A until it reaches the same height as the level of liquid soap L in the reservoir 16A.

Thus, the pump 18A can remain primed and generally full of liquid soap, even when the pump 18A is off, or at least between soap dispensations and/or right before the pump 18A is turned on.

In some embodiments, the bypass passage 27A can be a hole with a diameter of about 0.4 mm to about 2.1 mm. In some embodiments, the diameter of the hole of the bypass passage 27A can be in the range of about 0.5 mm to about 2.0 mm. Further, in some embodiments, the diameter of the bypass passage 27A can be about 0.7 mm to about 0.8 mm.

In some embodiments, the dispenser 10A can be immediately or rapidly primed without requiring further procedures by simply filling the reservoir 16A with liquid soap L and waiting a short amount of time for liquid soap L to flow through the bypass passage 27A, through the outlet chamber 25A and into the discharge conduit 26A as well as through the inlet 24A down into the pump 18A. In some embodiments, once liquid soap L has flown into these parts of the system, the pump 18A is fully primed and ready to begin pumping liquid soap L at any time, without requiring repriming before the next use.

Additionally, during operation of the pump 18A, some pressurized liquid soap L from the discharge chamber 25A is discharged out of the outlet chamber 25A and back into the reservoir 16A. This discharging from the outlet chamber 25A into the reservoir 16A results in some loss of efficiency of pump operation. However, when this pump design is used in conjunction with an anti-drip valve having a low opening pressure, such as an opening pressure of less than or equal to about 1 psi (liquid soap L in the discharge nozzle 28A having a pressure 1 psi higher than atmospheric on the outside of the nozzle 28A), the loss of efficiency caused by the bypass passage 27A is generally equal to or overcome by the lower energy requirements for pumping the liquid soap L to a pressure much lower than that required for opening spring-biased type valves. It has been found that where the valve 28A is configured to open with a pressure of about 0.3 psi or less, and the diameter of the bypass passage 27A is within the range of about 0.5 mm to about 2 mm, a 40% loss of fluid through the bypass passage 27A still requires about the same amount of energy or results in an overall reduction in energy required for pumping liquid soap L through the pump 18A to the lower opening pressure required to open the valve 28A, compared to valves that are formed of a valve seat and a valve body bias towards the closed position with a spring.

FIG. 9 illustrates an exploded view of the pump 18A. As shown, the gear pump 18A can include a pair of gears 170 and a gear pump body 172, from which the outlet 162 extends. The gears 170 can each include a plurality of teeth 169 (FIG. 9A), which in turn can have flanks 171 and a tip 177. Each of the teeth 169 can also have a tooth width W1 and a tip width W2, as will be discussed in further detail below.

The pump body 172 can comprise a generally continuous loop (e.g., an oval and/or partially figure-eight-shaped chamber) in which the gears 170 rotate. This configuration is well known in the art, and in particular, with regard to devices known as gear pumps. Thus, a further description of the operation of the gear pump 18A is not included herein.

In some embodiments, the body 172 can include a drive shaft aperture 174. A gasket 176 can be configured to form a seal against the aperture 174 and a drive shaft 178. One end of the drive shaft 178 can be connected to a driven sheave 180. The other end of the drive shaft 178 can extend through the gasket 176, the aperture 174, and engage with one of the gears 170. In some embodiments, the other of the gears 170 can engage a boss 179.

In some embodiments, a member 182 can be also used to retain the pump body 172 against the lower face of the reservoir 16A. For example, in the illustrated embodiment, four fasteners 184 extend through corresponding apertures in the member 182 and into engaging portions 186 attached to the lower face of the reservoir 16A.

Figure 9A:
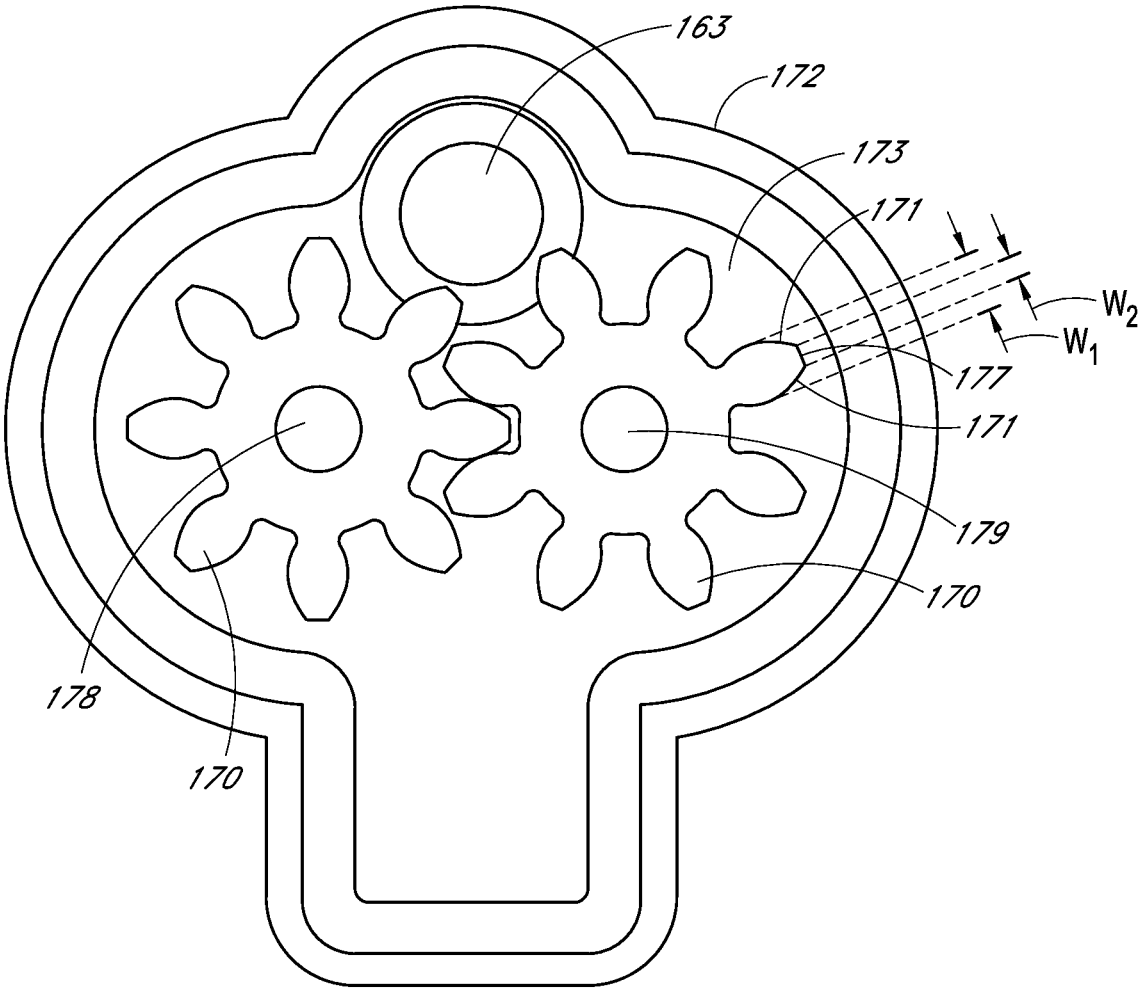
FIG. 9A illustrates a bottom view of the pump of FIG. 9, with a bottom portion of the pump removed to expose the interface of gears in the pump.

As shown in FIG. 9A, in some embodiments, the gears 170 are meshed within the chamber. Thus, when a shaft 178 is rotated to rotate one of the gears 170, the other gear 170 is also rotated. As such, the pump 18A can displace fluid entering the pump body 172 (e.g., through the outlet 24A of the reservoir) and discharge the fluid through the outlet 162. FIG. 9A also shows that the pump body 172 can include an opening 163. In some embodiments, the opening 163 is in fluid communication with the outlet 24A of the reservoir 16A, thereby allowing liquid soap L to flow into the pump body 172 via the opening 163. As shown, in certain implementations, the opening 163 is positioned in the top of the body 172. In some embodiments, a centerline of the opening 163 is substantially parallel with an axis of rotation of at least one of the gears 170. In some embodiments, the opening 163 is directly coupled with the outlet 24A of the reservoir 16A.

With reference again to FIG. 6, the sheave 180 defines a part of the transmitter 50A. The actuator 34A can also include a drive sheave 190 configured to drive the driven sheave 180 through a flexible transmitter 192. The flexible transmitter 192 can be any type of flexible transmitter, such as those well known in this art. For example, the flexible transmitter 192 can be a toothed belt, rubber belt, chain, etc. However, other configurations can also be used.

Figure 10:
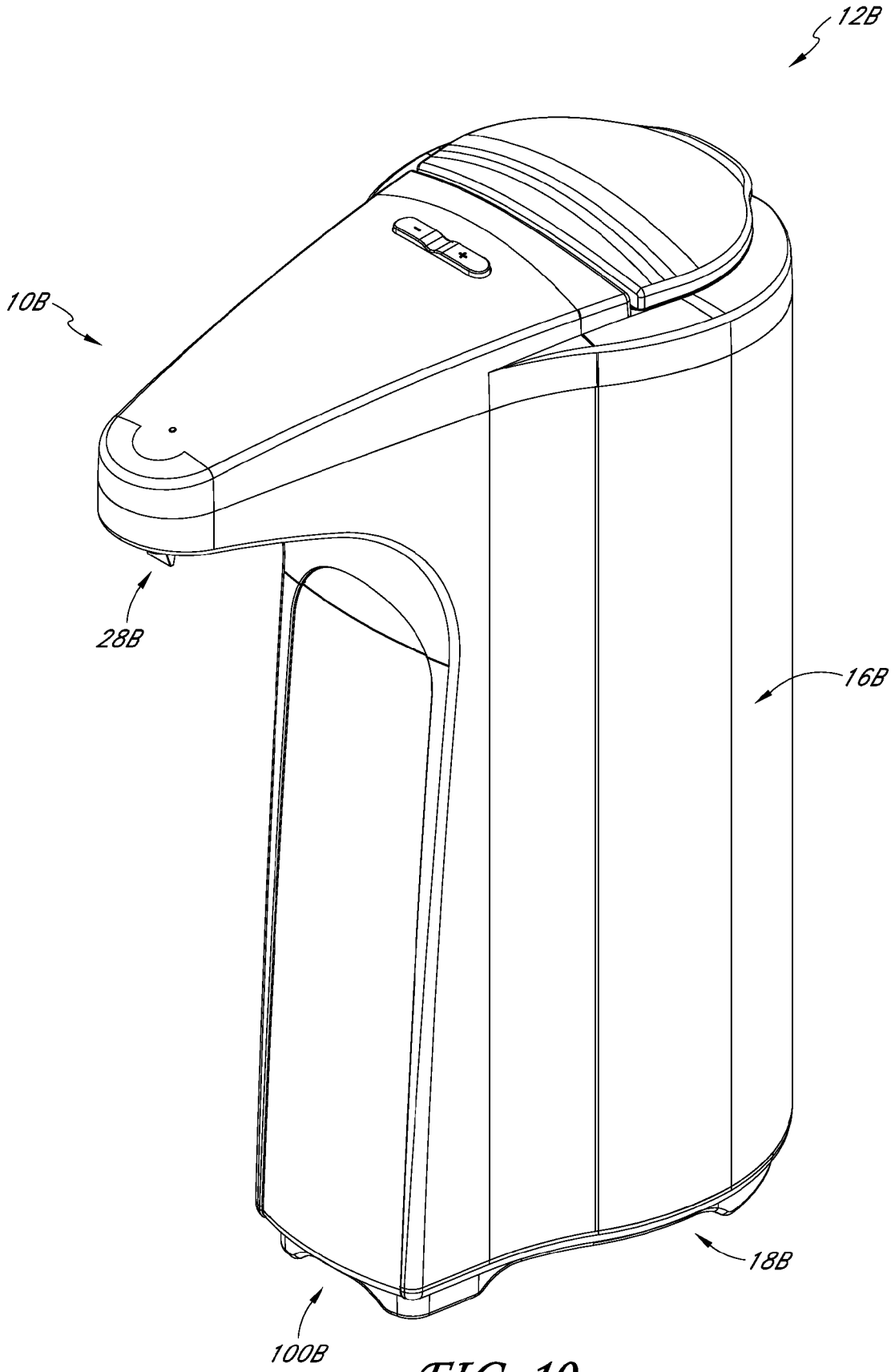
FIG. 10 illustrates a front, top, and left side perspective view of another embodiment of a liquid soap dispenser, including a discharge nozzle.
Figure 11:
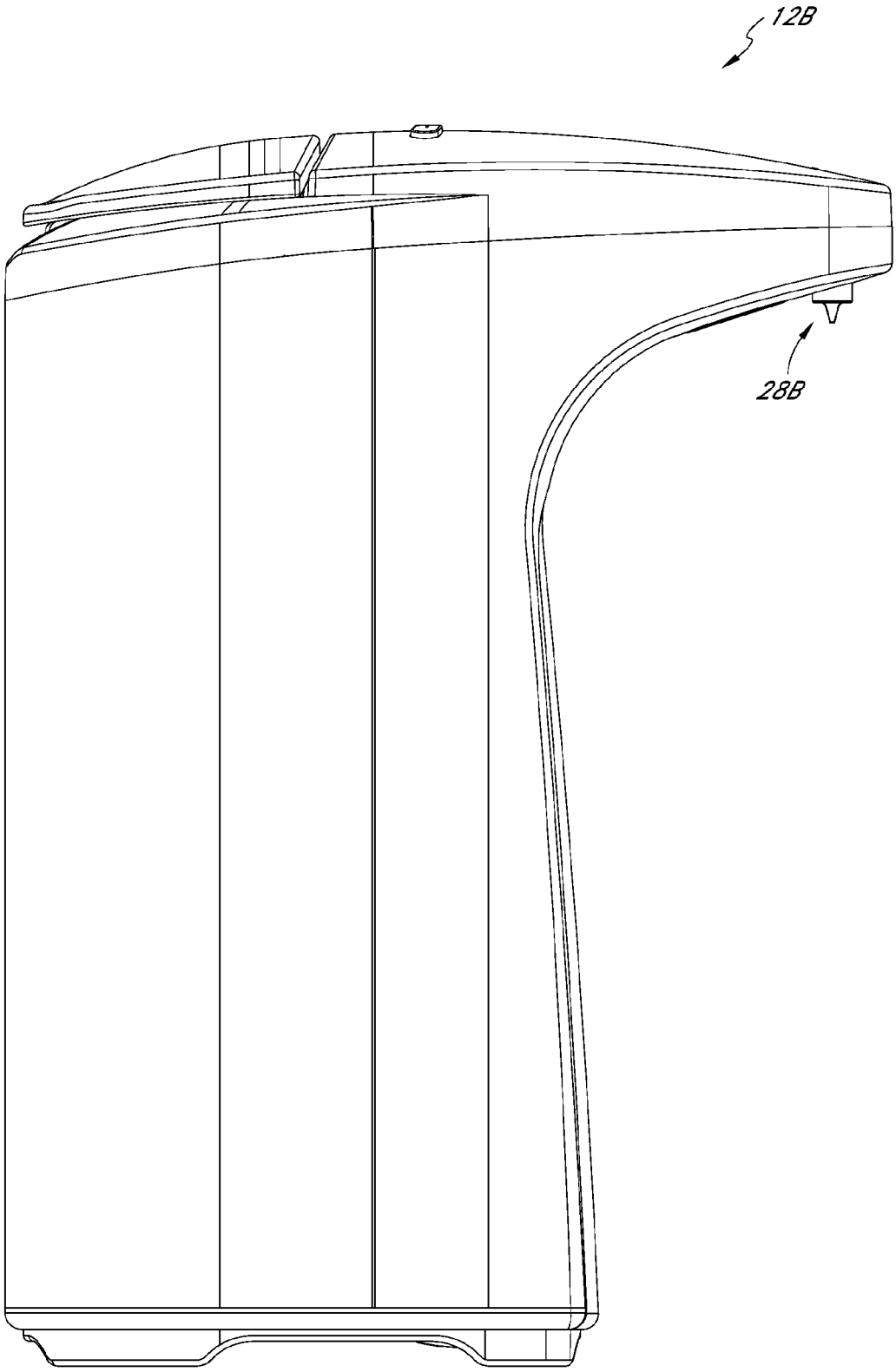
FIG. 11 illustrates a right side elevational view of the dispenser of FIG. 10.

With reference to FIG. 10, another embodiment of a soap dispenser is identified generally by the reference numeral 10B. Some of the components of the dispenser 10B can be the same, similar, or identical to the corresponding components of the dispensers 10 and/or 10A discussed above. Some of these corresponding components are identified with the same reference numeral, except that a "B" has been added thereto and/or has replaced the "A" which was added thereto.

Figure 12:
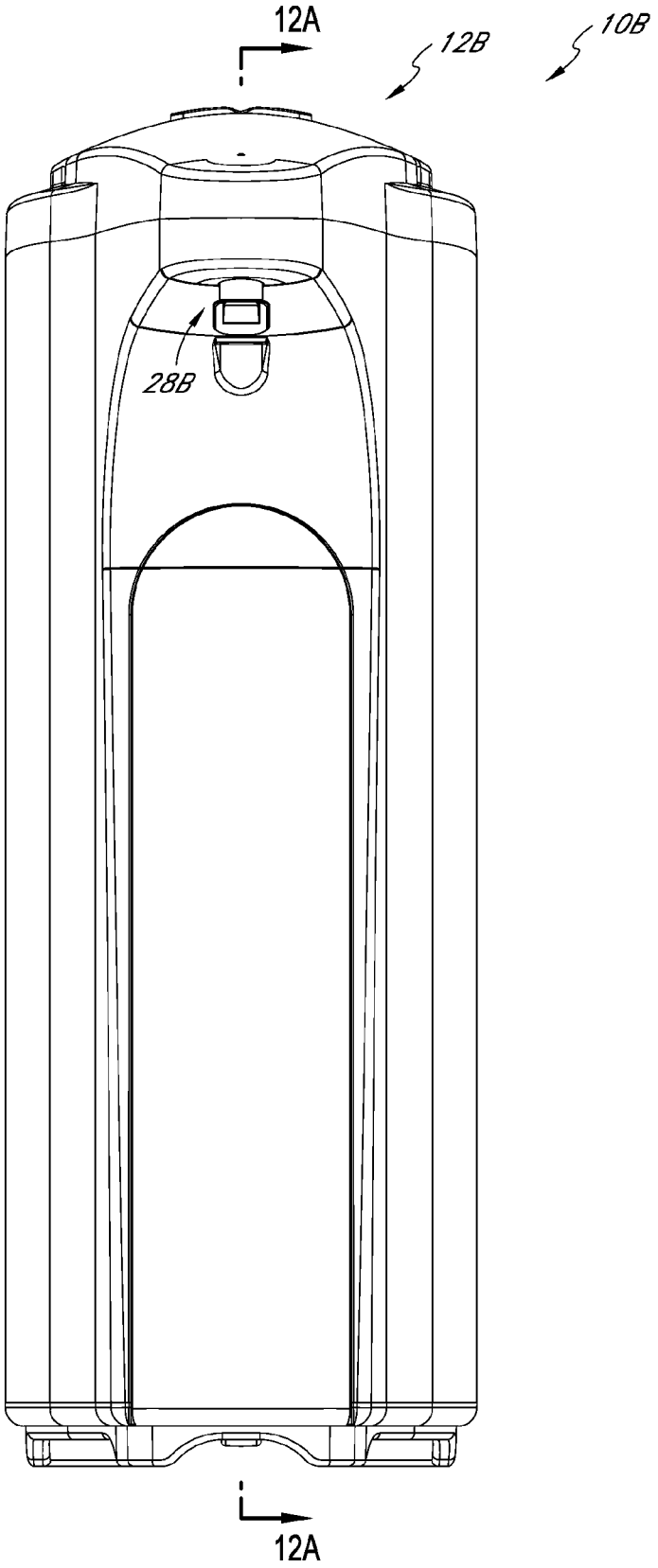
FIG. 12 illustrates a front elevational view of the dispenser of FIG. 10.
Figure 12A:
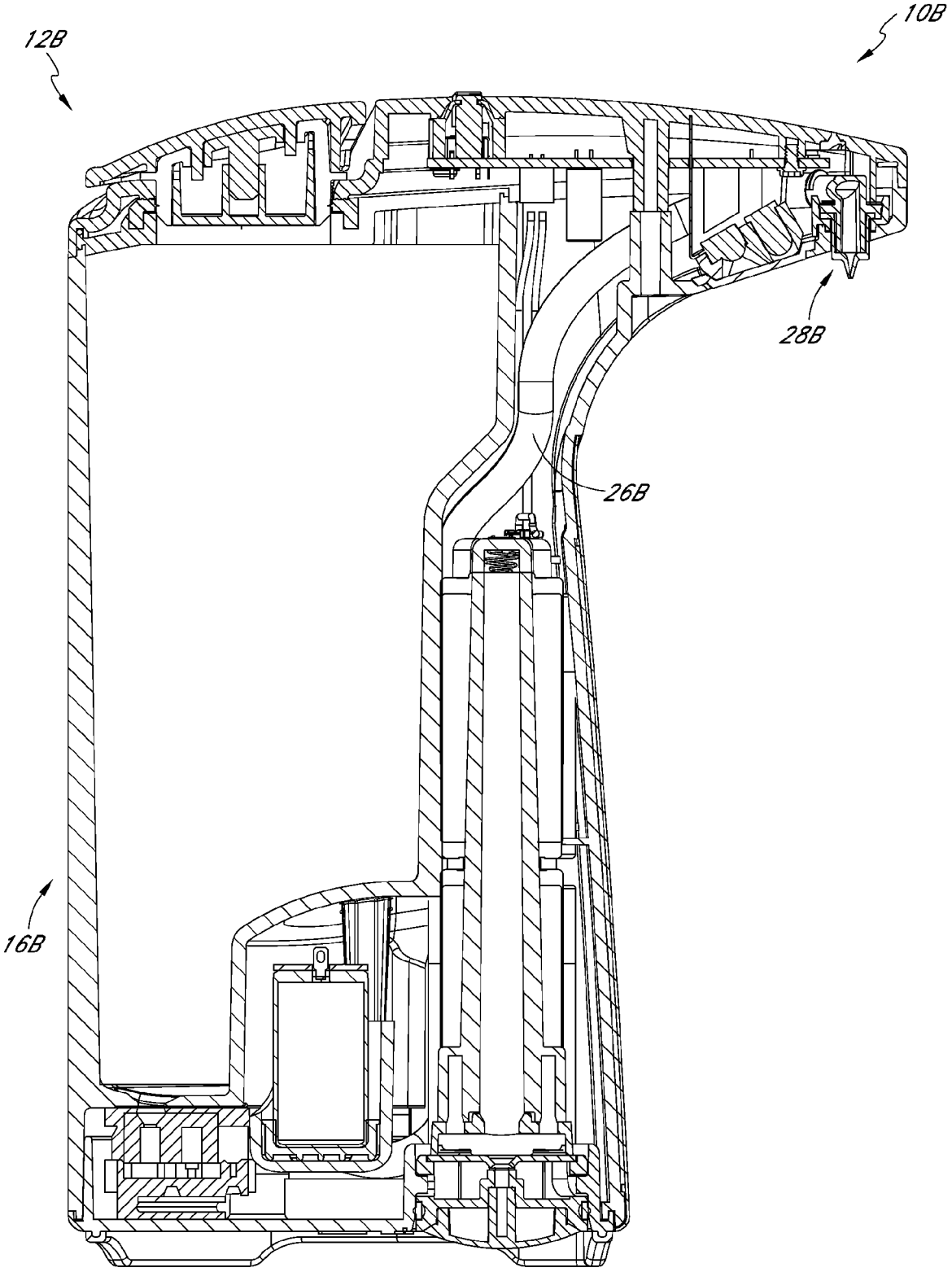
FIG. 12A illustrates a cross-sectional view of the dispenser of FIG. 10 along the line 12A-12A of FIG. 12.

The dispenser 10B can include a housing 12B, which in turn can include a lower portion 100B, reservoir 16B, pump 18B, and a nozzle 28B. In certain implementations, the pump 18B and the nozzle 28B are in fluid communication via a conduit 26B (see FIG. 12A). In some embodiments, the nozzle 28B extends outwardly from a periphery comprising the lower portion 100B. For example, as shown, the housing 12B can include a cantilevered portion that includes the nozzle 28B. In certain configurations, the nozzle 28B is positioned such that any soap that would drip from the nozzle 28B would avoid contacting the housing 12B.

In some embodiments, such as shown in FIGS. 10-12A, the nozzle 28B projects from the housing 12B. For example, the nozzle 28B can be mounted on the exterior of the housing 12B of the dispenser 10B. In some embodiments, the nozzle 28B can be mounted partially within or completely within the housing of the dispenser 10B. Further, in the implementation depicted, the nozzle 28B is positioned substantially vertically (e.g., a longitudinal axis of the nozzle forms a substantially right angle with a plane on which the dispenser rests). Such a configuration can, for example, facilitate (e.g., by force of gravity) outflow of the soap from the nozzle 28B. In some implementations, the nozzle 28B is positioned at another angle. For example, the nozzle 28B can be positioned so as to dispense soap horizontally (e.g., substantially parallel to a plane on which the dispenser 10B rests).

With reference to FIGS. 13-16, the nozzle 28B generally includes a one-way valve 200, which can be in the form of a flap-type valve. Such a configuration can, for example, reduce the likelihood that air or contaminants may enter the valve 200, which could lead to improper soap flow from the nozzle 28B and/or drying of soap disposed in the nozzle 28B. Of course, other types and/or configurations of one-way valve are contemplated, such as flap valves, ball valves, diaphragm valve, lift valves, other kinds of check valves, and the like.

In some embodiments, the nozzle 28B can include an inlet collar 210 with an interior passage 212 having inlet end 214 and an outlet end 216. The valve 200 can be formed with at least a deflectable member 218, such as a flap. In some embodiments, the deflectable member 218 is configured to move toward an open position (illustrated in phantom) when a pressure condition is satisfied. The pressure differential (compared to the ambient pressure acting on an exterior surface of the nozzle 28B) at which the deflectable member 218 begins to move toward the open position, and thus the nozzle 28B begins to open, can be referred to as the "cracking pressure." In some embodiments, the cracking pressure is at least about 0.2 psi and/or equal to or less than about 0.3 psi. In some embodiments, the cracking pressure is less than or equal to about 0.4 psi.

In some embodiments, the valve 200 includes two slanted deflectable members 218, 220 that form an acute angle with each other. Such a configuration is sometimes referred to as a "duckbill valve". However, as previously noted, a duckbill valve is merely one type of deflectable member valves that can be used as the nozzle 28B.

The valve 200 can be formed from any flexible material, For example, the valve 200 can be made of nitrile, nitrile rubber, fluorosilicone, fluorosilicone rubber, ethylene propylene, ethylene propylene diene monomer rubber, silicone, silicone rubber, hydrogenated nitrile rubber, hydrogenated nitrile butadiene rubber, butyl rubber, isobutylene isoprene rubber, fluorocarbon rubber, polyisoprene, industrial rubber, natural rubber, epichlorohydrin, chloroprene, polyurethane, polyurethane, polyether urethane, styrene-butadiene, styrene-butadiene rubber, polyacrylate acrylic, polyacrylate rubber, ethylene acrylic rubber, combinations thereof, or other materials. Some such duckbill valves are commercially available from Vernay Laboratories, Inc., of Yellow Springs, Ohio. In some embodiments, one or both of the deflectable members 218, 220 have a thickness of at least 0.4 mm and/or equal to or less than 0.8 mm. In certain instances, one or both of the deflectable members 218, 220 have a thickness of at least about 0.6 mm.

The valve 200 can include a seal formed between the deflectable members 218, 220. For example, in certain embodiments the deflectable members 218, 220 form a substantially airtight seal therebetween. Some embodiments of the deflectable members 218, 220 form a substantially liquid-tight seal therebetween. Some embodiments have deflectable members 218, 220 that form a seal that is sufficient to inhibit the passage of viscous soap therebetween. In certain embodiments, the valve 200 is configured to inhibit the passage of viscous soap yet permit an amount of ambient air to pass through the valve 200 (e.g., and into the interior of the dispenser 10B). Such a configuration can, for example, reduce the incidence of a pressure differential between the ambient environment and components of the dispenser 10B. For example, certain configurations allow an amount of ambient air to enter the reservoir 16B, thereby avoiding the maintenance of a pressure differential between the ambient environment and the reservoir 16B, which could inhibit opening of the reservoir 16B, e.g., in order to deposit liquid soap into the reservoir.

In some embodiments, the duckbill valve aids in the dispensation of soap, reduces wear, and/or facilitates priming of the dispenser 10B. For example, certain other anti-drip valves have a valve seat and a valve body that is pressed against the valve seat to prevent dripping when the pump is not operating. However, such valves can require a significant pressure (e.g., 2.5 to 3 psi) in the liquid soap before the spring biased valve body will move away from the valve seat to allow liquid soap to flow out. Generating such liquid soap pressure can require a significant amount of electrical energy. In contrast, some duckbill-type embodiments of the valve 200 are configured to open (e.g., deflect one or both of the deflectable members 218, 220) at much lower pressures, such as less than or equal to 0.2 psi and/or greater than or equal to 0.3 psi. As such, certain embodiments of the valve 200 require less electrical energy usage per dispensation, which in turn can prolong the operational life of batteries (or other electrochemical or other electrical energy storage devices) in embodiments of the dispenser 10B so powered. Further, as the actuating pressure is reduced, some embodiments of the valve 200 reduce the wear on the motor 34, pump 18B, and/or other components of the dispenser 10B.

In some embodiments, the reduced actuating pressure of the valve 200 can facilitate priming of the dispenser 10B. In certain other types of valves, during priming of the pump, air present in a pipe connecting the pump and the valve is trapped between the valve and the leading edge of the flow of soap being urged through the pipe. In some such instances, the air is compressed to the actuating pressure of the valve (which, as indicated above, can be relatively high) and expelled out of the valve in a rush, which can cause the air or soap located in the valve to be ejected in an uncontrolled or otherwise undesirable manner (e.g., in a sputter). In contrast, the reduced actuating pressure of the valve 200 can reduce the amount that air in the conduit 26B is compressed prior to the valve 200 opening, and thus can reduce or avoid such an uncontrolled or undesirable dispensation during priming.

Certain implementations of the valve 200 can reduce or avoid sticking problems found in certain other valve configurations. For example, in valves including a valve body that is pressed against a valve seat, a thin film of soap between the body and seat can encourage the body and seat to stick to each other (e.g., the thin film of soap can act as an adhesive), which can inhibit or prevent the valve from opening. Such an issue can be especially prevalent in designs in which the valve body must move generally against the flow of soap in order for the valve to open. In contrast, certain embodiments of the valve 200 are opened by deflecting the deflectable members 218, 220 an acute angle with respect to the direction of the flow of soap through the valve 200. Further, as certain embodiments of the valve 200 do not include a spring pressing a valve body against a valve seat with a thin film of soap therebetween, the occurrence, or at least the degree, of sticking can be reduced or avoided.

Figure 13:
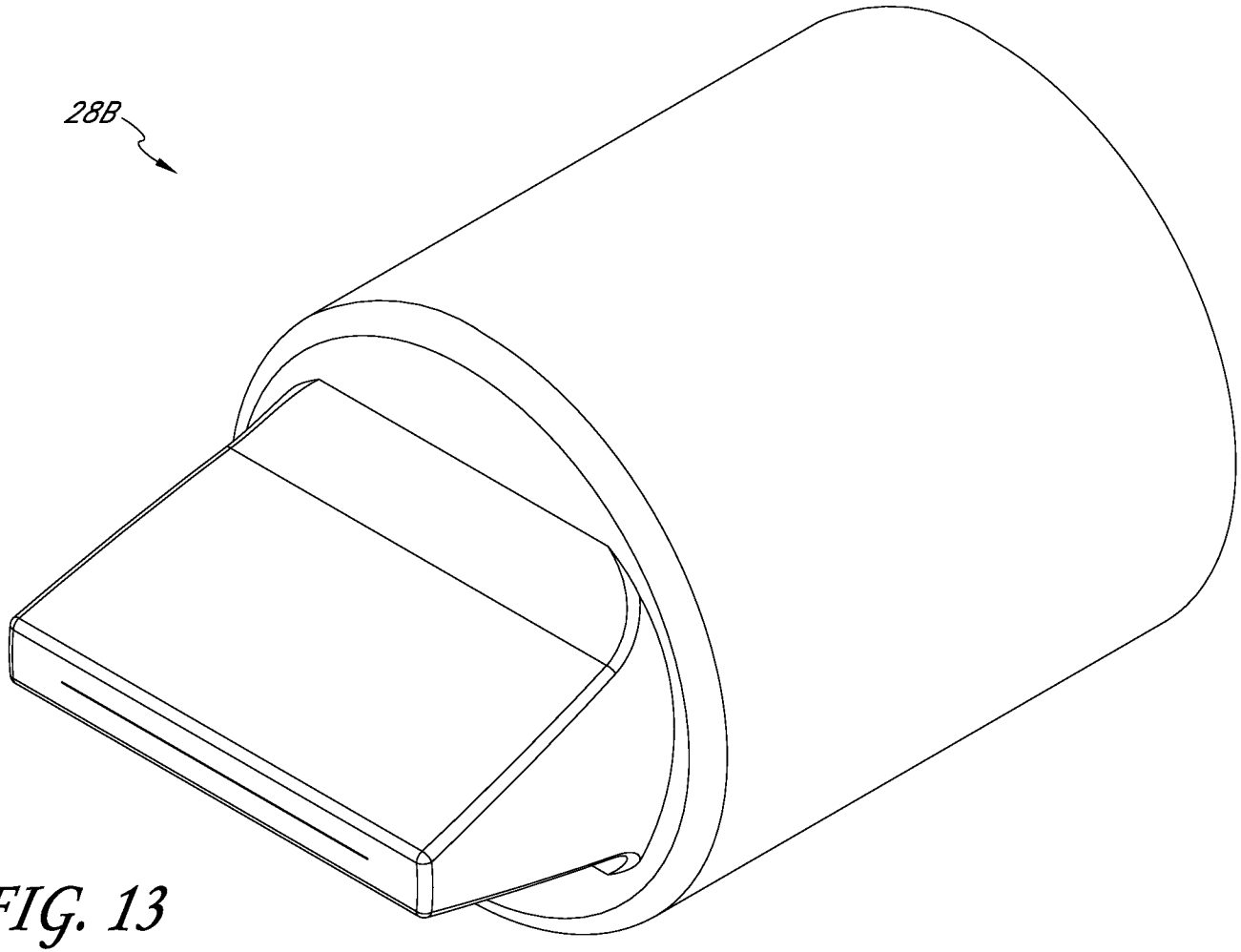
FIG. 13 illustrates a perspective view of the discharge nozzle of FIG. 10.
Figure 13A:
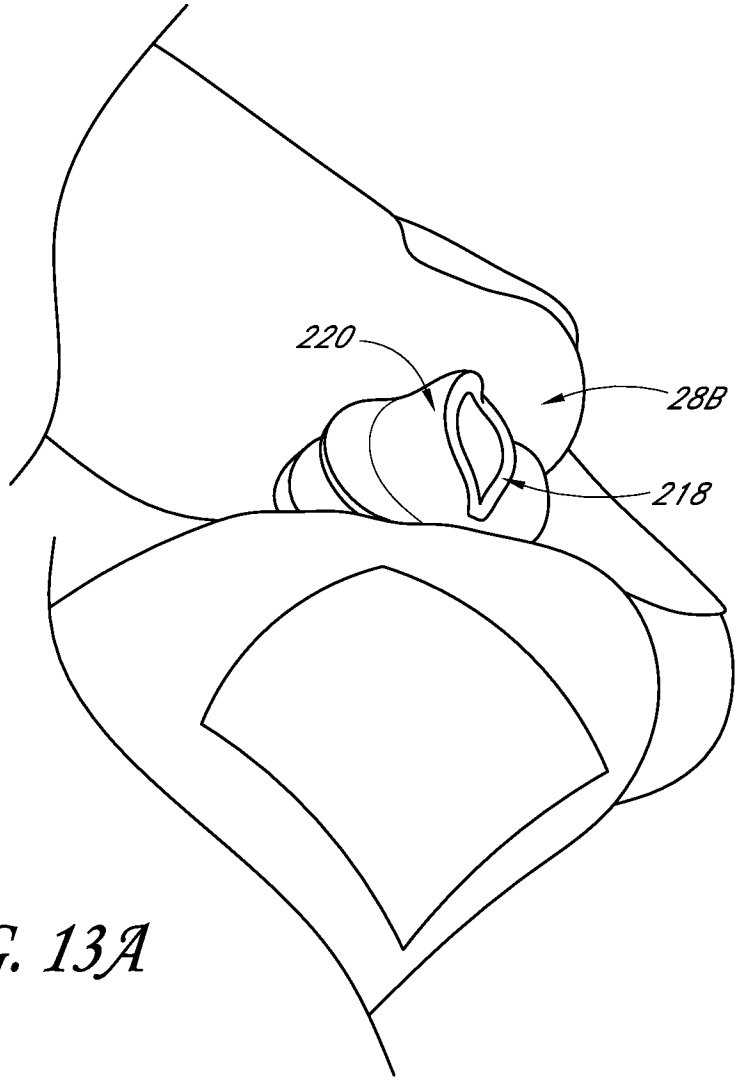
FIG. 13A illustrates a perspective view of the discharge nozzle of FIG. 13 in a compressed state squeezed between two fingers, showing the discharge nozzle in an open configuration.
Figure 14:
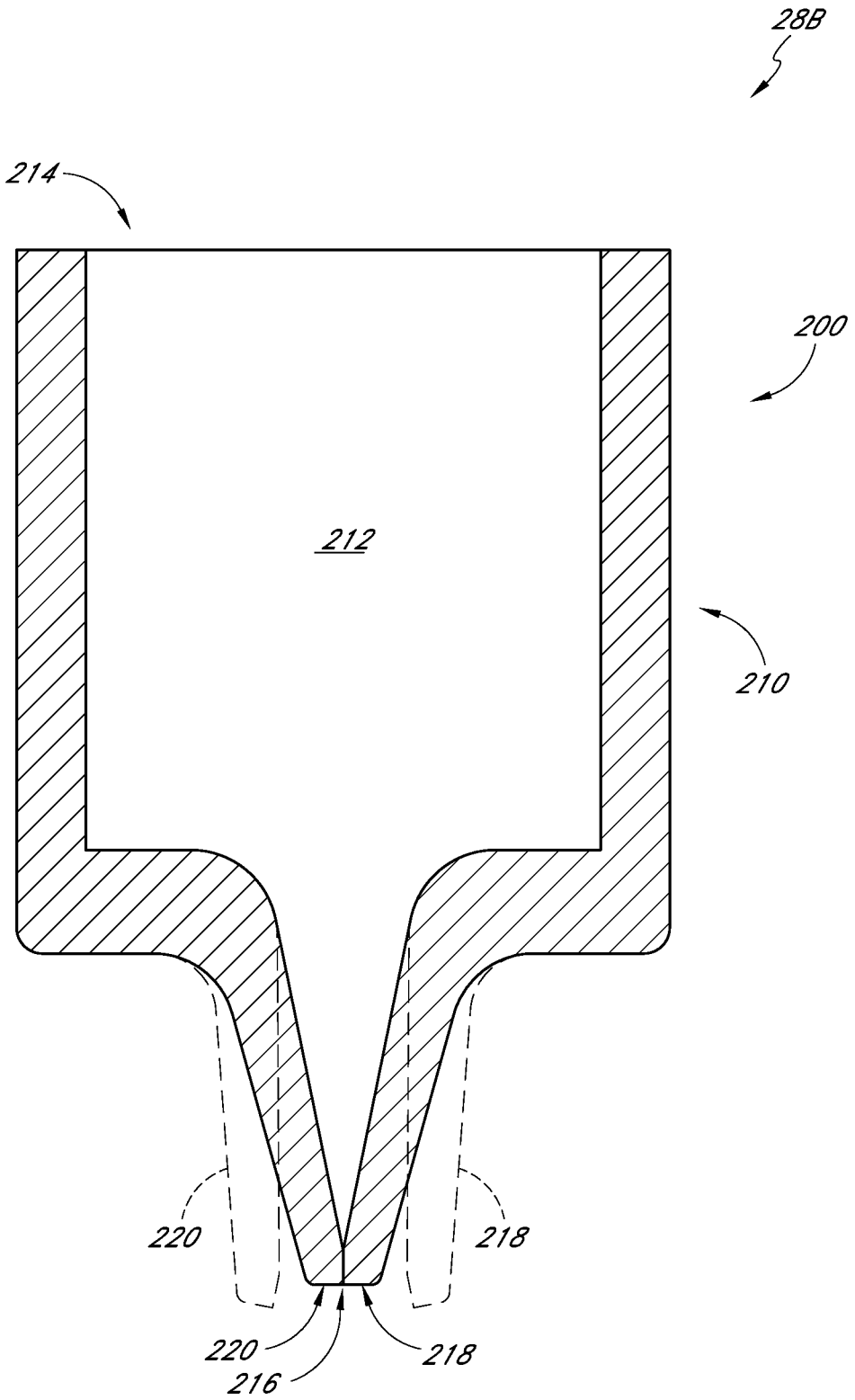
FIG. 14 illustrates a cross-sectional view of the discharge nozzle of FIG. 13.

FIG. 13 illustrates the valve 200 in a closed position, e.g., the deflectable members 218, 220 are in contact with each other thereby substantially closing the outlet end 216 so as to resist the outflow of soap in most circumstances of normal use until the valve 200 is opened. In contrast, FIG. 13A illustrates the valve 200 in an open position, e.g., the deflectable members 218, 220 have moved apart from each other, thereby opening a channel between the deflectable members 218, 220 through which fluid can flow. For example, in the open state, soap can pass from the inlet 214 and through the outlet 216, such as to be dispensed to a user's hands. As shown, the valve 200 can be opened by applying force on the valve 200 along an axis generally parallel with a line formed by the interface of the deflectable members 218, 220. Although FIG. 13A illustrates the valve 200 being squeezed, and thereby opened, by the fingers of a human hand, in the dispenser 10B, the valve 200 is typically opened in other ways, such as by pressurized liquid soap acting against the deflectable members 218, 220.

In a first state, such as when the pump 18B is not operating, ambient pressure acts against the outer surfaces of the deflectable members 218, 220, thereby pressing them toward each other and closing the outlet 216 of the valve 200. Such closure of the outlet can, for example, inhibit or prevent liquid soap L within the nozzle 28B from leaking past the deflectable members 218, 220, for example, under the influence of gravity. In a second state, such as when the pump 18B operates, liquid soap L is encouraged toward the inlet 214, which in turn generates pressure within the liquid soap L in the nozzle 28B. When the pressure of the soap in the nozzle 28B is greater than or equal to the cracking pressure of the valve 200, the liquid soap L can deflect the deflectable member 218, 220 and thereby be discharged out of the nozzle 28B. In some embodiments, the cracking pressure of the valve 200 is about 0.2 psi to about 0.3 psi greater than atmospheric pressure of the environment in which the dispenser 10B is located.

Figure 15:
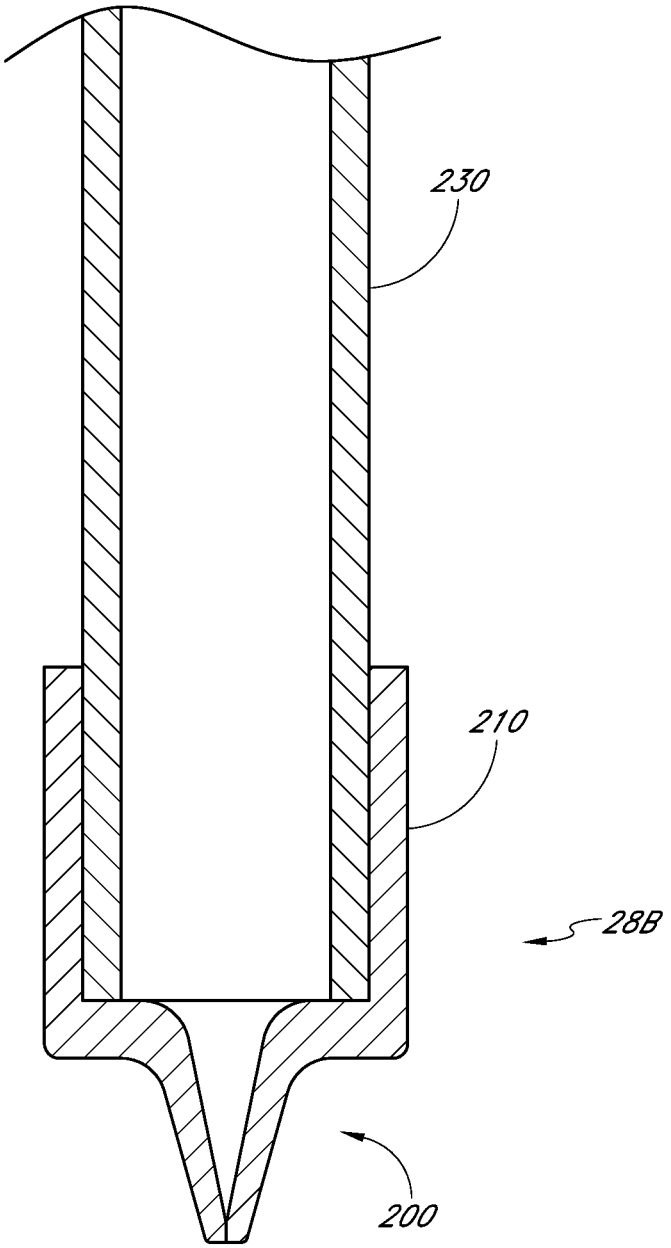
FIG. 15 illustrates a cross-sectional view of the discharge nozzle attached to a pipe.
Figure 16:
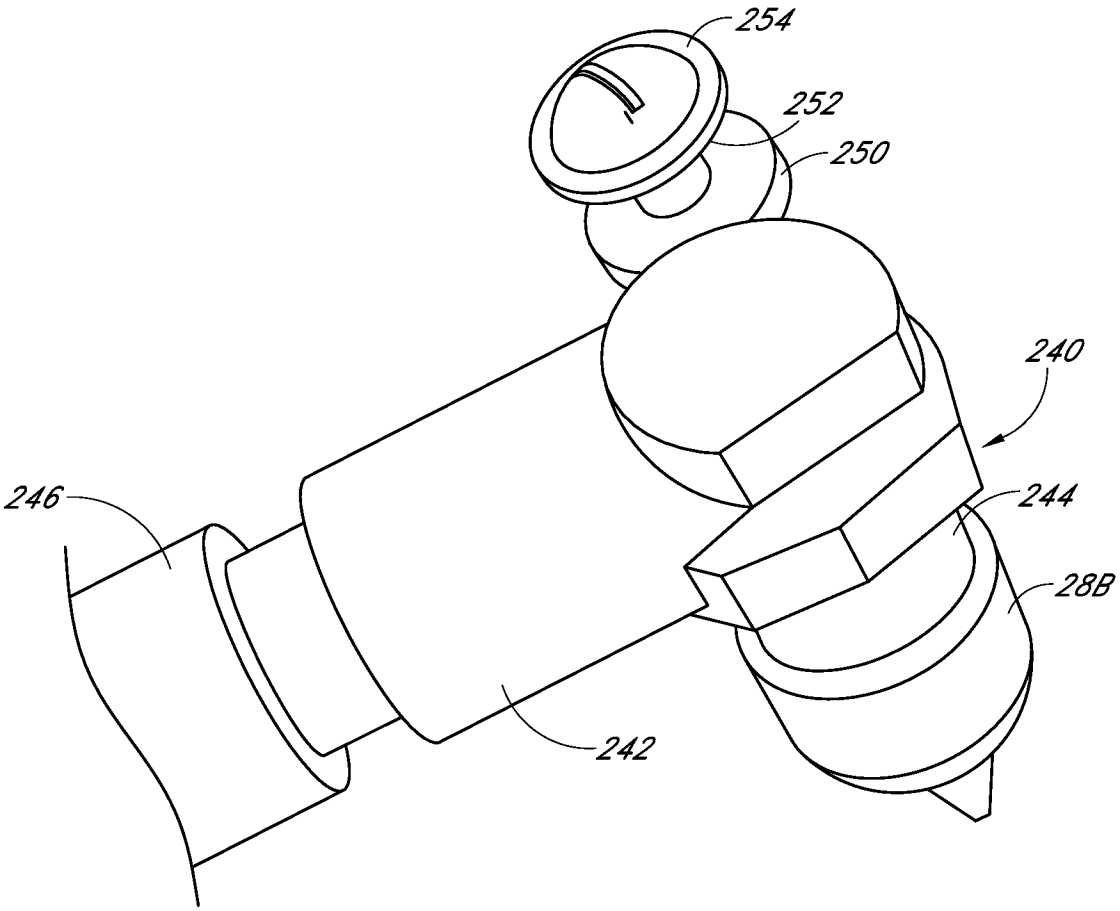
FIG. 16 illustrates a perspective view of the discharge nozzle coupled with a flange and an angled member.

FIGS. 15 and 16 illustrate some configurations in which the valve 200 can be applied to the dispenser 10B. FIG. 15 illustrates a straight connection configuration. In some such embodiments, the collar 210 of the valve 200 is fit over the outer surface of a liquid soap pipe 230, which can be in fluid communication with the reservoir 16B and/or the pump 18B. In some configurations, the collar 210 and the pipe 230 mate in substantially liquid-tight engagement to resist soap leakage. Thus, in certain embodiments, liquid soap L can pass from the reservoir 16B and/or the pump 18B, through the pipe 230, and be discharged out of the valve 200 in a direction parallel with the longitudinal axis of the conduit 230.

FIG. 16 illustrates a curved or angled connection between the valve 200 and the liquid soap dispensing system (e.g., a substantially 90° configuration). In some embodiments, an angled member 240 (e.g., an elbow, curve, angle, or otherwise) includes an inlet end 242 and an outlet end 244. The inlet end 242 of the angled member 240 is connected to a fluid supply source 246, which is in fluid communication with the reservoir 16B and/or the pump 18B. In some embodiments, the longitudinal axis of the inlet end 242 is angled (e.g., at least: about 15°, about 30°, about 60°, about 90°, values therebetween, and otherwise) relative to the outlet end 244 of the angled member 240. Thus, when the nozzle 28B is attached to the outlet 244 of the angled member 240, soap is discharged through the valve 200 at an angle (e.g., about 90°) relative to the inlet 242.

In some embodiments, the angled member 240 can include a mounting member, such as a flange 250. In the illustrated embodiment, the flange 250 includes an aperture 252. In some implementations, a fastener 254 (such as a threaded fastener, rivet, boss, hook, or otherwise) can be used to attach the angled member 240 and the housing 12B of the soap dispenser 10B.

Figure 17:
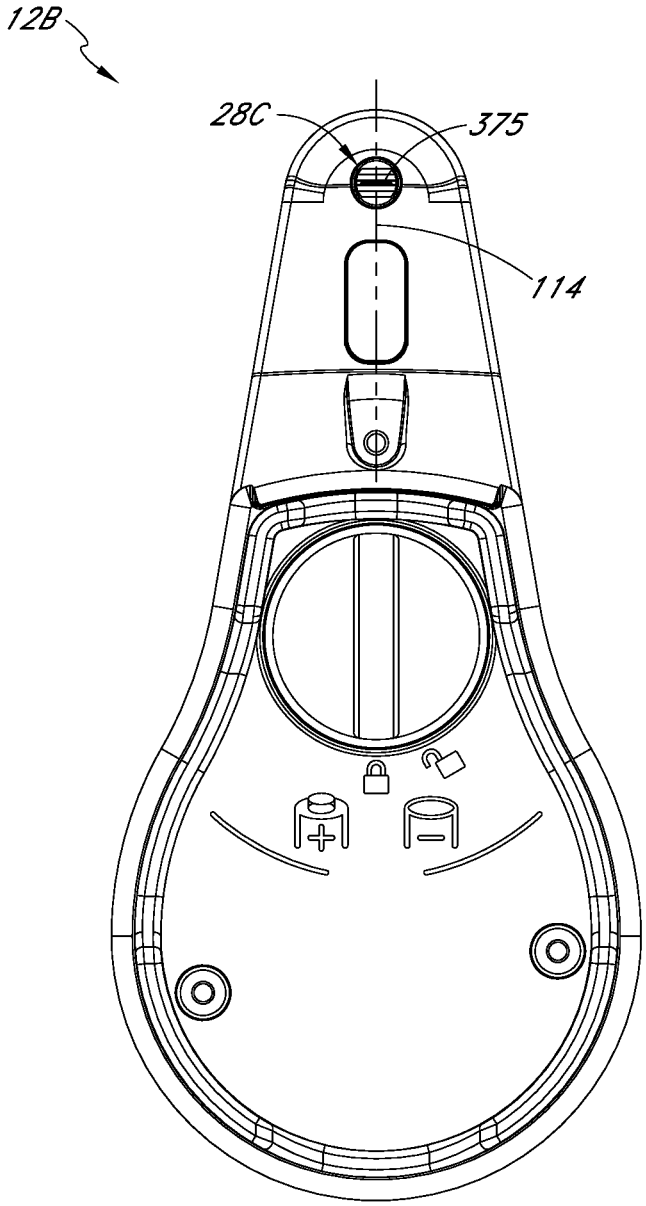
FIG. 17 illustrates a bottom plan view of the soap pump of FIG. 10 with another embodiment of a discharge nozzle.

FIG. 17 illustrates another embodiment of a nozzle 28C, which can be installed in the housing 12B. In some embodiments, the nozzle 28C protrudes from the housing 12B. For example, in certain embodiments, the nozzle 28C is at least partly visible to an observer outside the dispenser. In some embodiments, the nozzle 28C is oriented such that the nozzle outlet 375 is generally perpendicular to a front-to-back axis 114 (also illustrated in FIG. 4) of the housing 12B. In certain embodiments, the nozzle outlet 375 may be oriented such that it is not perpendicular to the axis 114.

Figure 18:
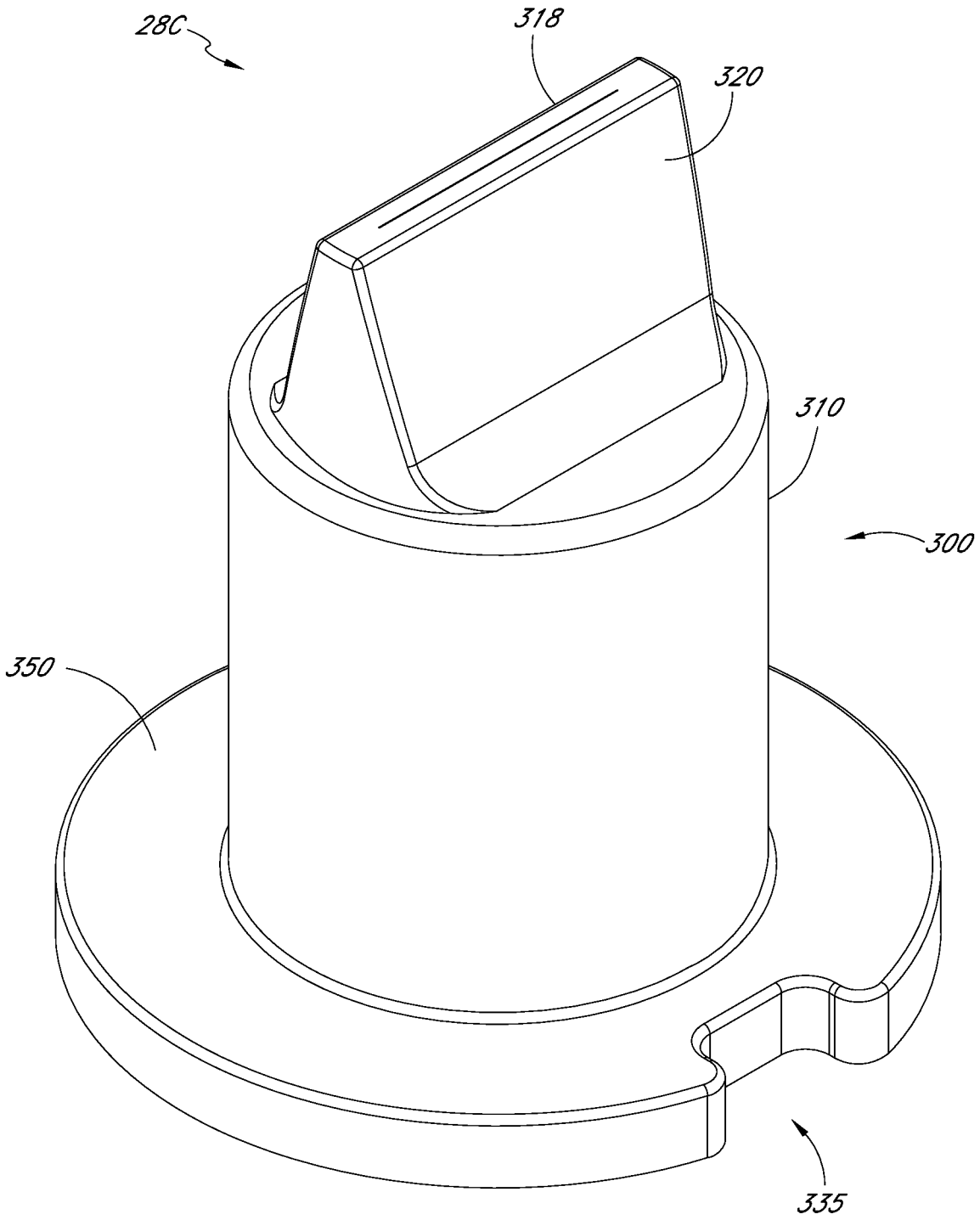
FIG. 18 illustrates a perspective view of the discharge nozzle of FIG. 17.
Figure 19:
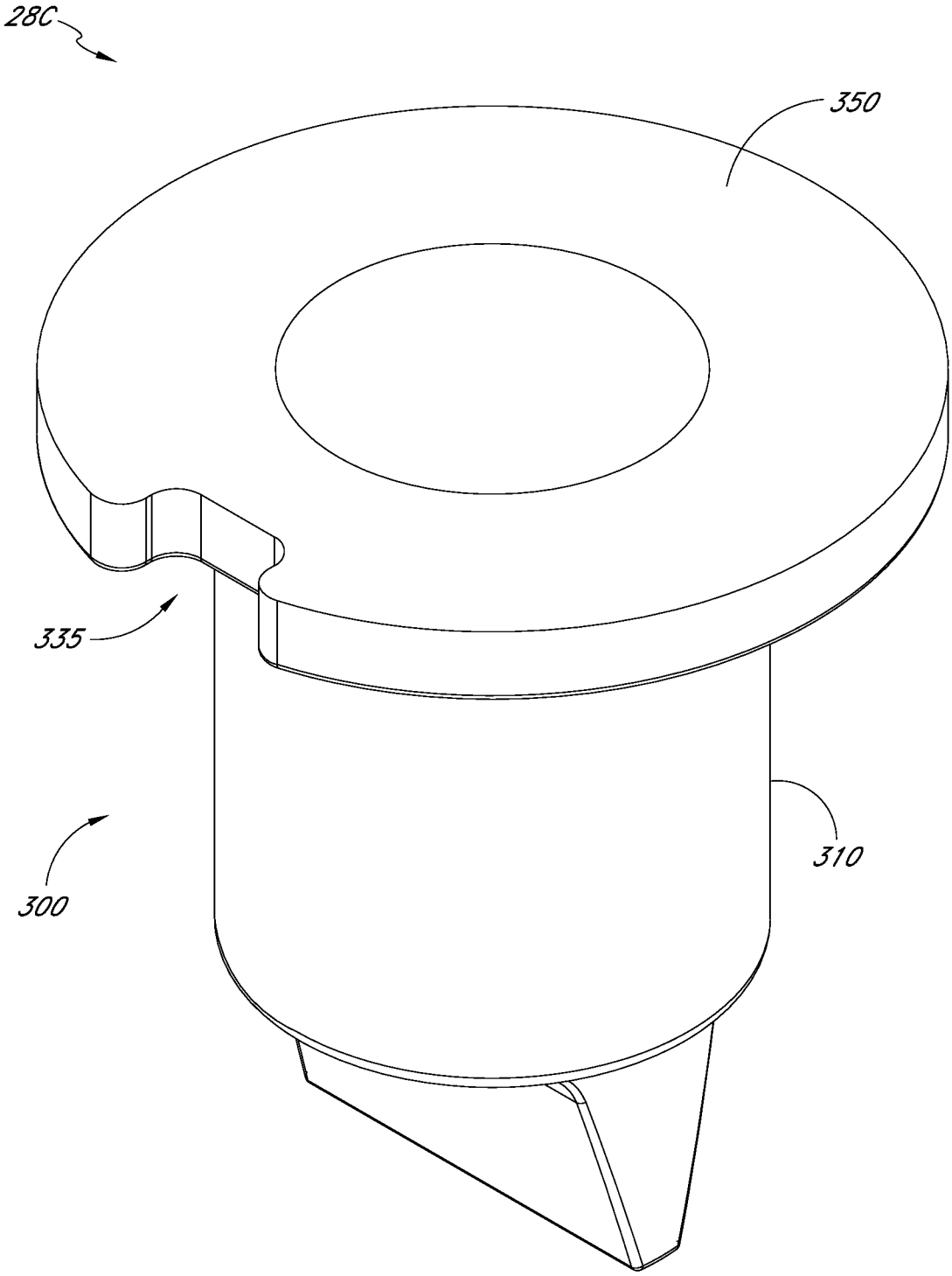
FIG. 19 illustrates another perspective view of the discharge nozzle of FIG. 18.

With reference to FIGS. 18 and 19, the nozzle 28C can be in the form of a valve 300. As noted above, such a configuration is sometimes referred to as a "duckbill valve." However, a duckbill valve is merely one type of deflectable member valve that can be used as the nozzle 28C. In some embodiments, the valve 300 can include an inlet collar 310, deflectable members 318, 320, and a valve flange 350. In some embodiments, the valve flange 350 can have one or more first positioners, such as an indentation 335. For example, as illustrated in FIGS. 18 and 19, the indentation 335 can be a single indentation. In other embodiments, the indentation 335 comprises a plurality of indentations. As shown, some embodiments of the inlet collar 310 are cylindrically shaped. Other embodiments of inlet collar 310 have various other shapes, such as rectangular or triangular prismatic.

FIGS. 17-19 illustrate the deflectable members 318, 320 in a generally closed position. In some variants, when the pump 18 is not operating, the deflectable members 318, 320 are pressed together, thereby closing the valve 300 and inhibiting or preventing liquid soap L in the nozzle 28C from leaking past the deflectable members 318, 320 (e.g., by the influence of gravity). In certain implementations, one or both of the deflectable members 318, 320 are biased toward the other, thereby pressing the deflectable members 318, 320 together when the pump 18 is not operating. In some embodiments, the deflectable members 318, 320 atmospheric pressure acts against the outer surfaces of the deflectable members 318, 320 to press the deflectable members 318, 320 together.

When the pump 18 operates and generates sufficient pressure within the liquid soap L in the nozzle 28C, the liquid soap L can open the nozzle 28C by deflecting the deflectable members 318, 320, thereby discharging the liquid soap from the nozzle 28C. As previously noted, the pressure differential (compared to ambient atmospheric pressure) at which the nozzle 28C begins to open can be referred to as the "cracking pressure." In some embodiments, the cracking pressure required to discharge the liquid soap L from the nozzle 28C is at least 0.2 psi and/or equal to or less than 0.3 psi above atmospheric pressure. In other embodiments, the cracking pressure required to discharge the liquid soap L from the nozzle 28C is at least 0.3 and/or equal to or less than 0.5 psi.

Figure 20:
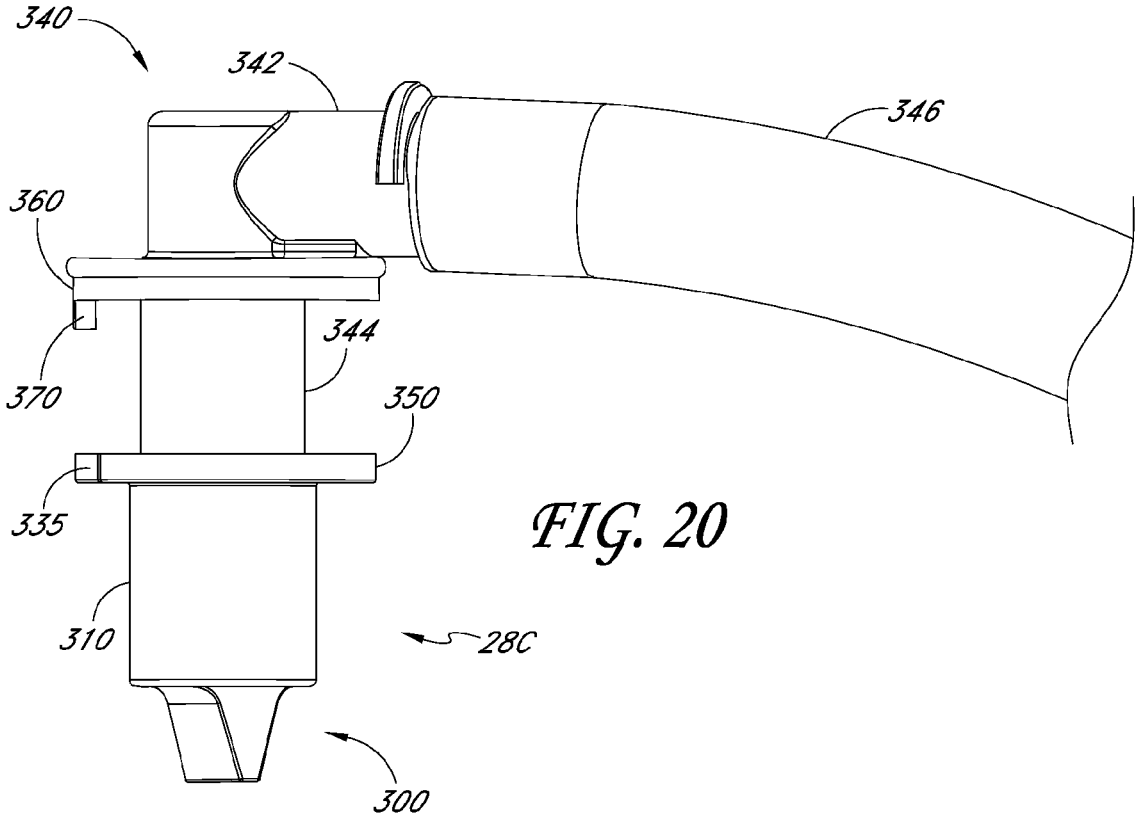
FIG. 20 illustrates a left side exploded view of the discharge nozzle of FIGS. 17-19 coupled with an angled member and a fluid supply source.
Figure 21:
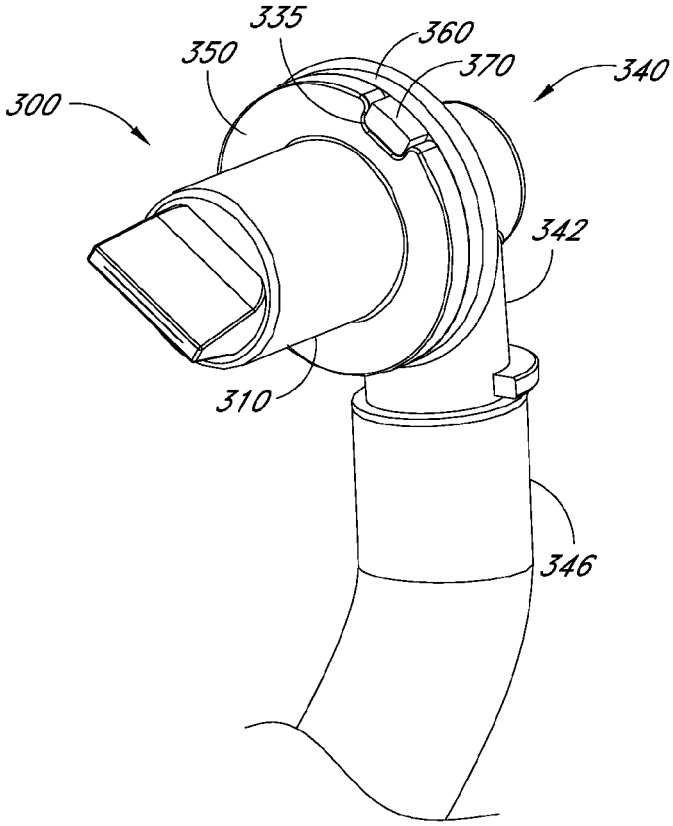
FIG. 21 illustrates a bottom left perspective view of the discharge nozzle, angled member, and fluid supply source of FIG. 20 in an assembled state.

FIGS. 20 and 21 illustrate a configuration in which the valve 300 can be applied to a liquid soap dispensing system. FIG. 20 illustrates the valve 300 and an angled member 340, such as an elbow of about 90°, in an unconnected state. As shown, the angled member 340 can include an inlet end 342 and an outlet end 344. The inlet end 342 can be connected to a fluid supply source 346, which can be in fluid communication with the reservoir 16B and/or pump 18B. The outlet end 344 of the angled member 340 can engage with the valve 300. In some embodiments, the angled member 340 can include a flange 360. The flange 360 can include one or more second positioners, such as protrusions 370.

As illustrated in the embodiment shown in FIG. 21, the valve 300 can be oriented such that the indentation 335 in the nozzle flange 350 generally aligns with the protrusion 370 on the flange 360. In this embodiment, the protrusion 370 can engage with and/or be received by the indentation 335. Such a configuration can, for example, inhibit or prevent rotation of the valve 300 with respect to the outlet end 344 of the angled member 340. Further, in some embodiments, the indentation 335 can ease manufacturing of the dispenser 10B, as the indentation 335 can facilitate orientation of the nozzle 28B with regard to the remainder of the dispenser 10B, thereby facilitating assembly. For example, some configurations of the indentation 335 orient the nozzle 28C such that the line of contact between the deflectable members 318, 320 is substantially transverse to the axis 114, which can facilitate dispensing soap into a user's hands in a desired pattern.

In some implementations, the pump 18 and/or actuator 34 are configured to temporarily (e.g., for less than or equal to about a second) reverse the flow of soap. For example, in embodiments having a gear pump, the rotation of the gears can be temporarily reversed, thereby drawing soap from the nozzle back toward the reservoir. Such a configuration can, for example, facilitate closing of the nozzle 28C. For instance, in embodiments having the valve 300 with first and second deflectable members 318, 320, such reversal of flow can encourage closing of the valve 300. Indeed, in implementations, reversal of flow can reduce the delay that between the intended cessation of dispensation of soap and the actual cessation of dispensation of soap from the nozzle 28C. In some embodiments, reversing the flow of soap encourages a tight seal between the first and second deflectable members 318, 320.

Figure 22:
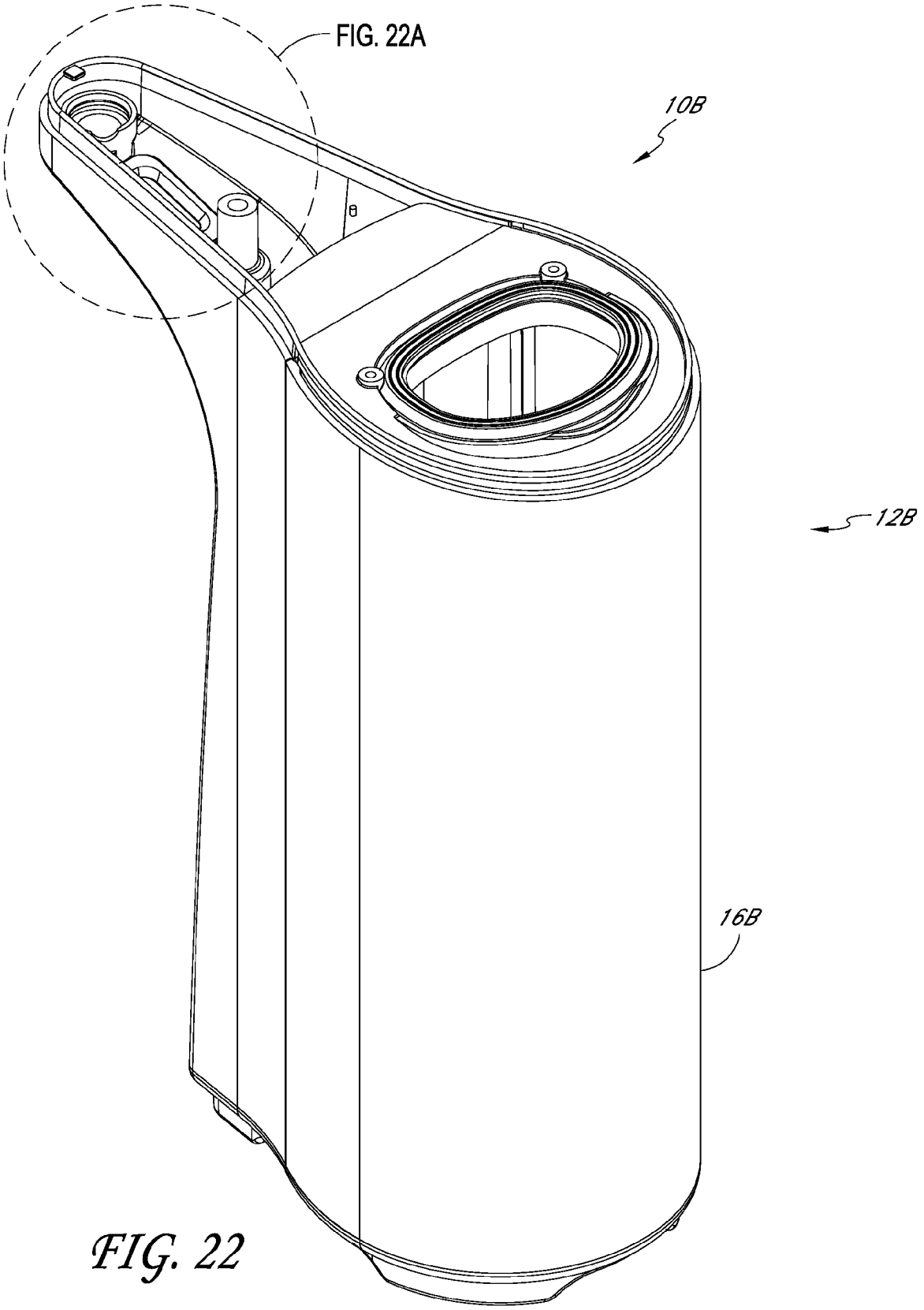
FIG. 22 illustrates top, left, rear perspective view of the soap pump of FIG. 10, with a top portion of a housing removed to expose certain components.
Figure 22A:
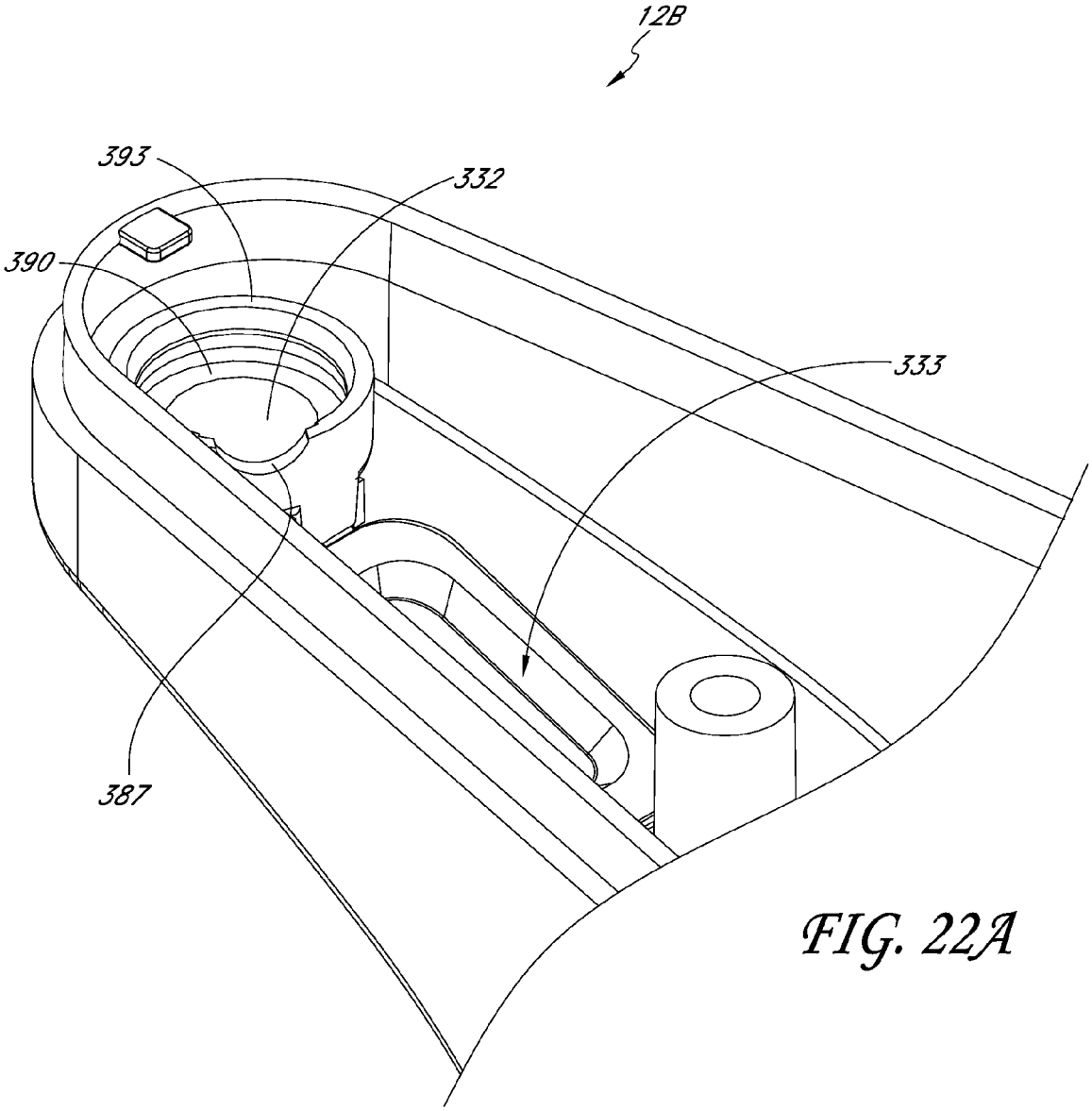
FIG. 22A illustrates a focused top, left, rear perspective view of a portion of the housing of FIG. 22.

As shown in FIG. 22, in some embodiments, the housing 12B can have an opening 332 in which the nozzle 28C can be at least partly received. In some embodiments, the opening 332 of the housing 12B can include a leak inhibiting structure, such as an annular protrusion 390. In some embodiments, the nozzle flange 350 of the nozzle 28C is pressed against the annular protrusion 390, thereby creating a substantially liquid-tight seal. The opening 332 of the housing 12B can also comprise a positioning structure, such as a ridge 393. In the embodiment shown in FIG. 22, the ridge 393 can include an orienting structure, such as a recess 387. In certain arrangements, the housing 12B includes one or more other apertures 333, such as a sensor device, as was discussed in further detail above.

Figure 23:
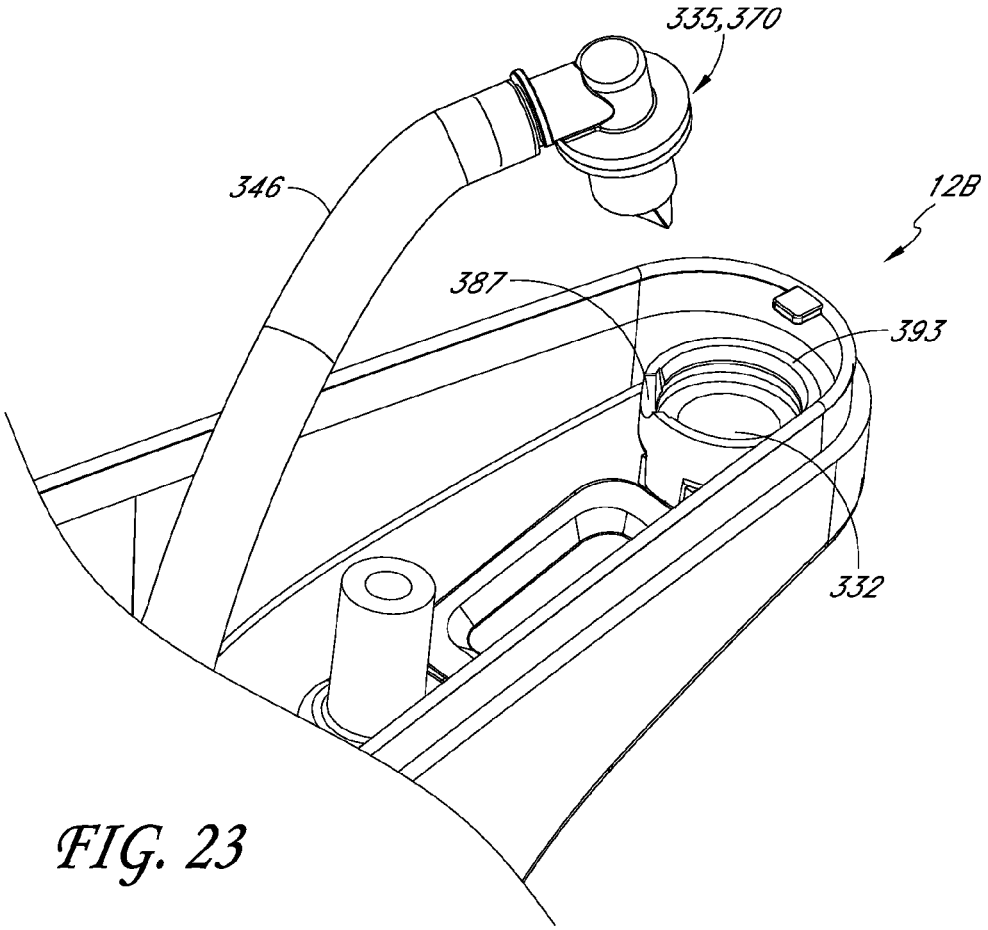
FIG. 23 illustrates a focused top, right, rear perspective exploded view of the housing of FIG. 22 and the discharge nozzle, angled member, and a fluid supply source of FIGS. 20 and 21.
Figure 23A:
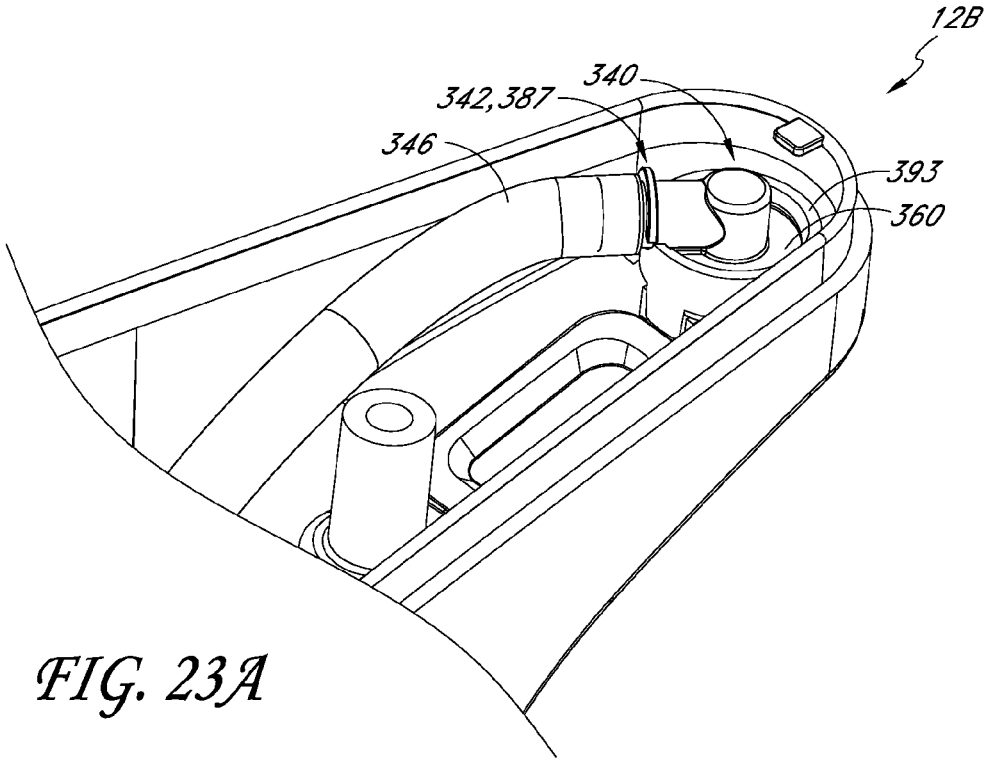
FIG. 23A illustrates a focused top, right, rear assembled perspective view of the housing of FIG. 22 and the discharge nozzle, angled member, and a fluid supply source of FIGS. 20 and 21.

FIG. 23 shows the housing 12B from FIG. 22 as well as the assembled nozzle 28C and angled member 340 of FIG. 21. The recess 387 in the ridge 393 can be sized to accept the inlet end 342 of the angled member 340 when at least a portion of the angled member 340 and the nozzle 28C are inserted into the opening 332 of the housing 12B. The recess 387 can, for example, inhibit or prevent the angled member 340 from rotating with respect to the housing 12B. In some embodiments, a combination of the recess 387 of the ridge 393 and the indentation 335 and protrusion 370 of the assembled nozzle 28C and angled member 340 can inhibit or prevent the nozzle 28C from rotating with respect to the housing 12B. FIG. 23A shows the assembled nozzle 28C and angled member 340 in an installed position in the housing 12B.

In some embodiments of the nozzle 28C, the geometry of the deflectable flap members 318, 320 can be designed to increase the cracking pressure necessary to open the nozzle outlet 375 of the nozzle 28C. Configurations like these can, for example, allow the valve 300 to withstand higher internal pressures before permitting a flow of fluid therethrough. Such an increased cracking pressure is desirable in certain applications (e.g., when some or all of the reservoir 16 is positioned higher than the nozzle 28C). In some instances, an increased cracking pressure facilitates faster and/or increased disbursement of soap.

Figure 24:
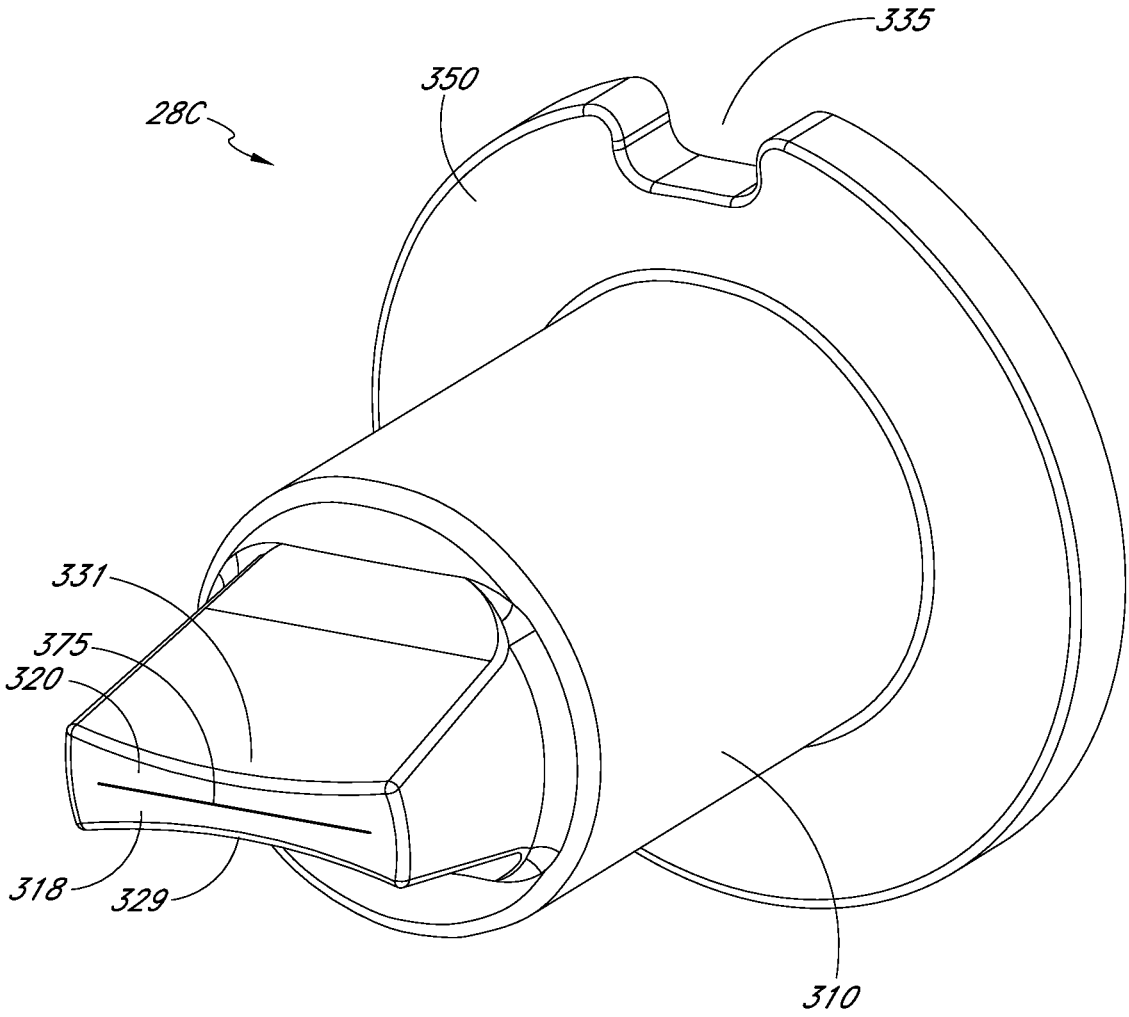
FIG. 24 illustrates a front, top, left perspective view of another embodiment of a discharge nozzle, including concave cutouts.
Figure 25A:
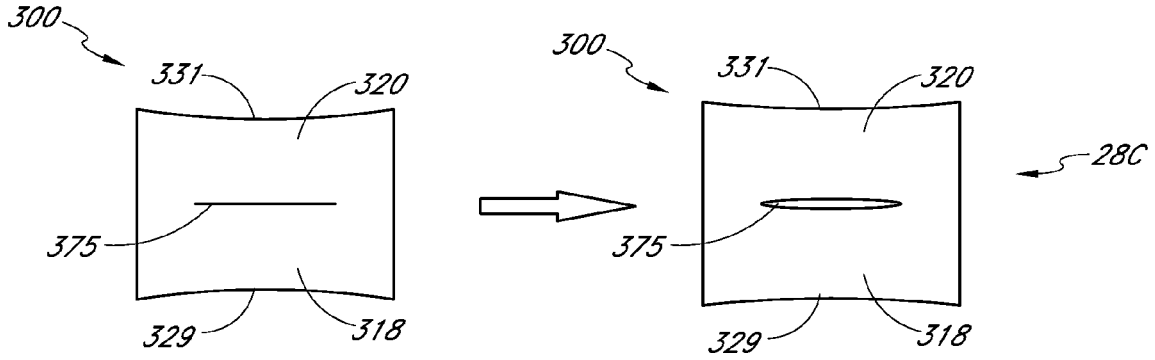
FIGS. 25A-C illustrate front views of outlets of three embodiments of discharge nozzles for a soap pump.

With reference to FIGS. 24 and 25A, in some embodiments, the deflectable members 318, 320 have biasing features, such as recesses 329, 331. Thus, in certain embodiments, the deflectable members 318, 320 have a generally hourglass shape in an end view. In some embodiments, the deflectable members 318, 320 with the recesses 329, 331 exhibit an increase in the bias between the deflectable members 318, 320 compared to deflectable members without such recesses. In some embodiments, the deflectable members 318, 320 can be configured such that the concavity the recesses 329, 331 produces or increases the bias of the deflectable members 318, 320 against each other.

In some embodiments of the nozzle 28C, the geometry of the deflectable members 318, 320 can be configured to decrease the cracking pressure needed to open the nozzle outlet 375 of the nozzle 28C. For example, the recesses 329, 331 can be configured such that they reduce the thickness of the deflectable members 318, 320 at about the midpoint of the outlet 375 as compared to other regions of the outlet 375 without greatly increasing the radius of concavity. As a result, in certain such implementations, the cracking pressure necessary to open the nozzle outlet 375 of the nozzle 28C may be reduced.

Figure 25B:
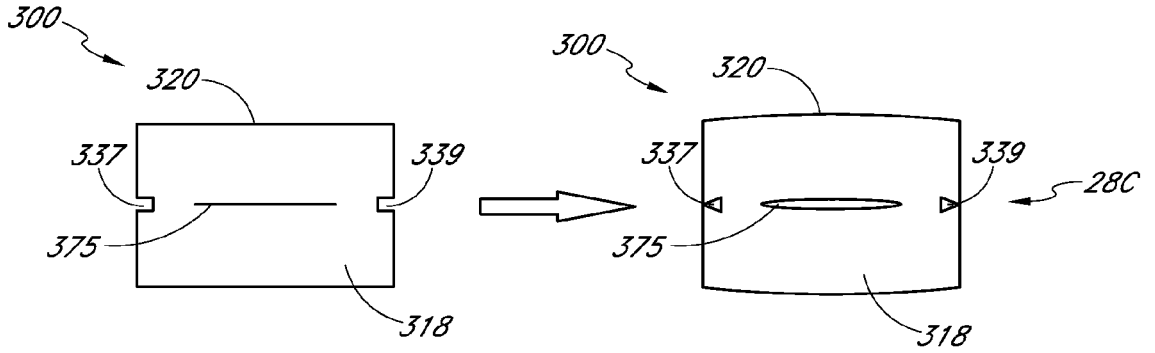

As shown in FIG. 25B, some embodiments of the nozzle 28C include one or more deformation-facilitating members, such as notches 337, 339, in the sides of the nozzle outlet 375. Notches 337, 339 can reduce the compressive force in the material in the vicinity of the notches 337, 339. Thus, the notches 337, 339 can allow the sides of the nozzle outlet 375 to deform more easily, thereby facilitating opening of the outlet 375. In some arrangements, the notches 337, 339 resiliently deform during the period that the outlet 375 is open, e.g., opposite sides of the notches can move toward each other. In certain such cases, the resiliently deformed notches 337, 339 can provide or increase a biasing effect, which can facilitate the nozzle outlet 375 returning to its original shape when the pressure on the soap (e.g., from the pump) eases. Such a configuration can, for example, allow the nozzle outlet 375 to close more quickly when the pump 18B ceases operation. FIG. 25B illustrates an example of this concept in which the opening of the nozzle outlet 375 causes the notches 337, 339 to reduce in size as the material surrounding the notches 337, 339 compresses.

Figure 25C:
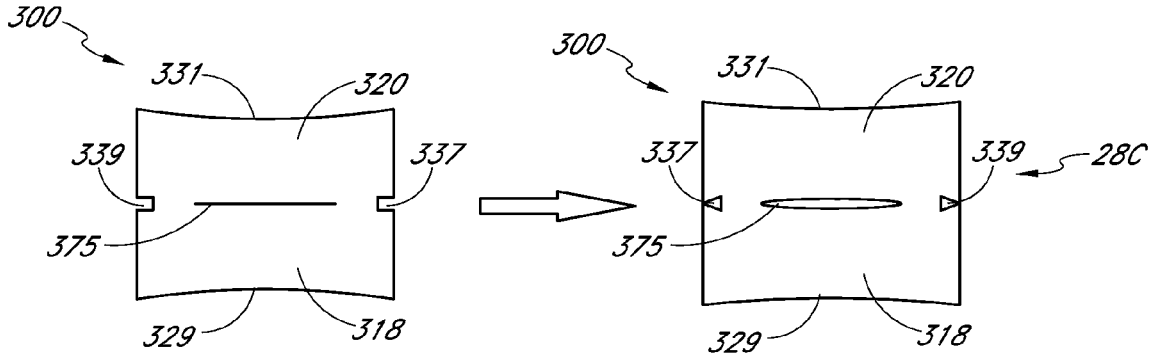

FIG. 25C illustrates a configuration wherein both notches 337, 339 and concave recesses 329, 331 are utilized for the nozzle outlet 375. In some embodiments, the concave recesses 329, 331 in the deflectable members 318, 320 produce or increase the bias of the deflectable members 318, 320 to a closed position. Indeed, in certain such instances, the concave recesses 329, 331 increase the cracking pressure of the nozzle 28C. However, when the cracking pressure is reached and the outlet 375 begins to open, the notches 337, 339 can facilitate such opening by reducing compressive forces and/or interference of material on the side of the nozzle 28C. Moreover, the resilient deflection of the notches 337, 339 can be biased to return to their original, undeflected position, thereby promoting closing of the opening. In certain such embodiments, closing of the nozzle opening 375 is further promoted by the previously described bias of the deflectable members 318, 320.

Figure 26:
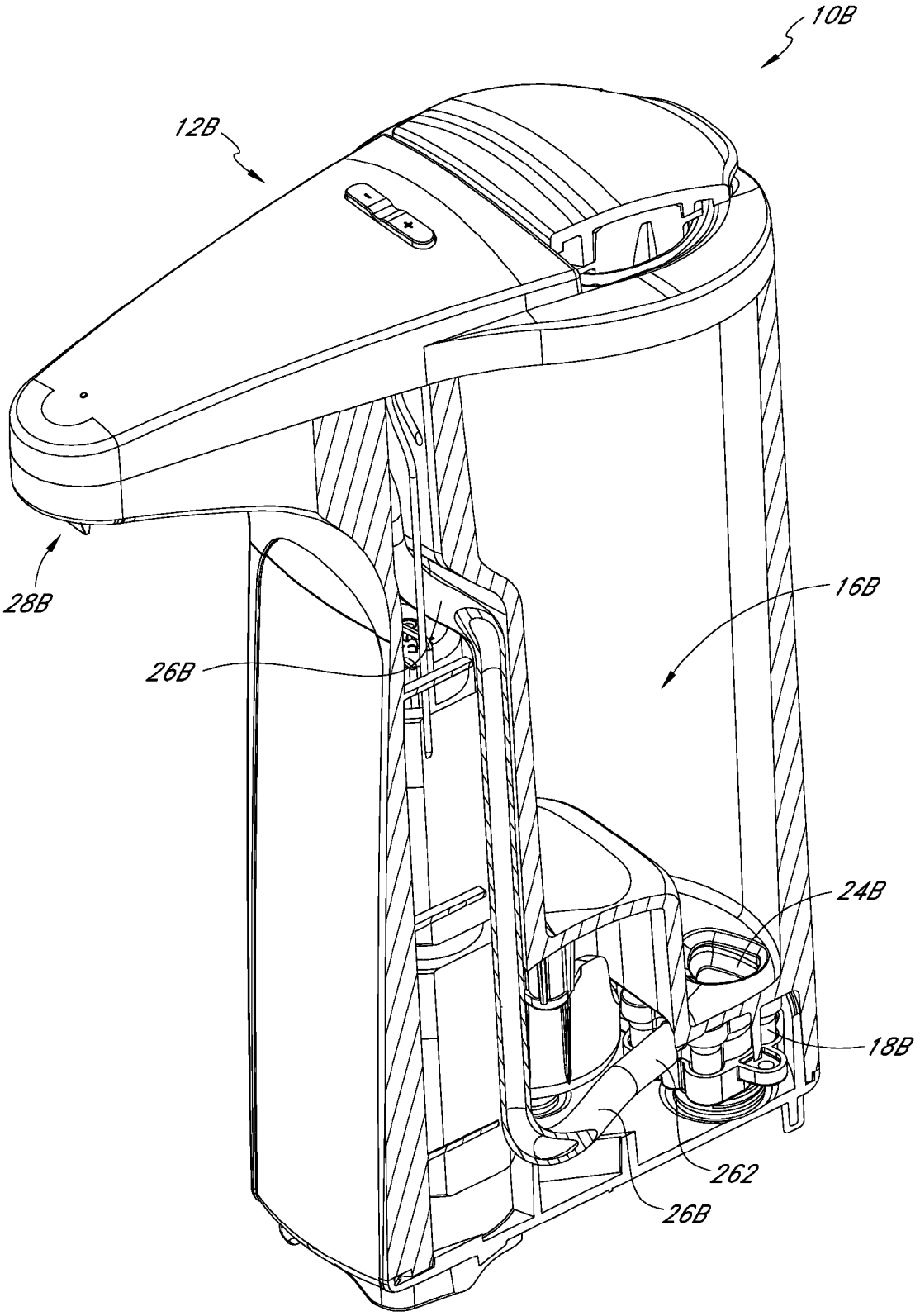
FIG. 26 illustrates a top, left, front perspective and partial cross-sectional view of the dispenser of FIG. 10, including a pump and a reservoir with an outlet.
Figure 27:
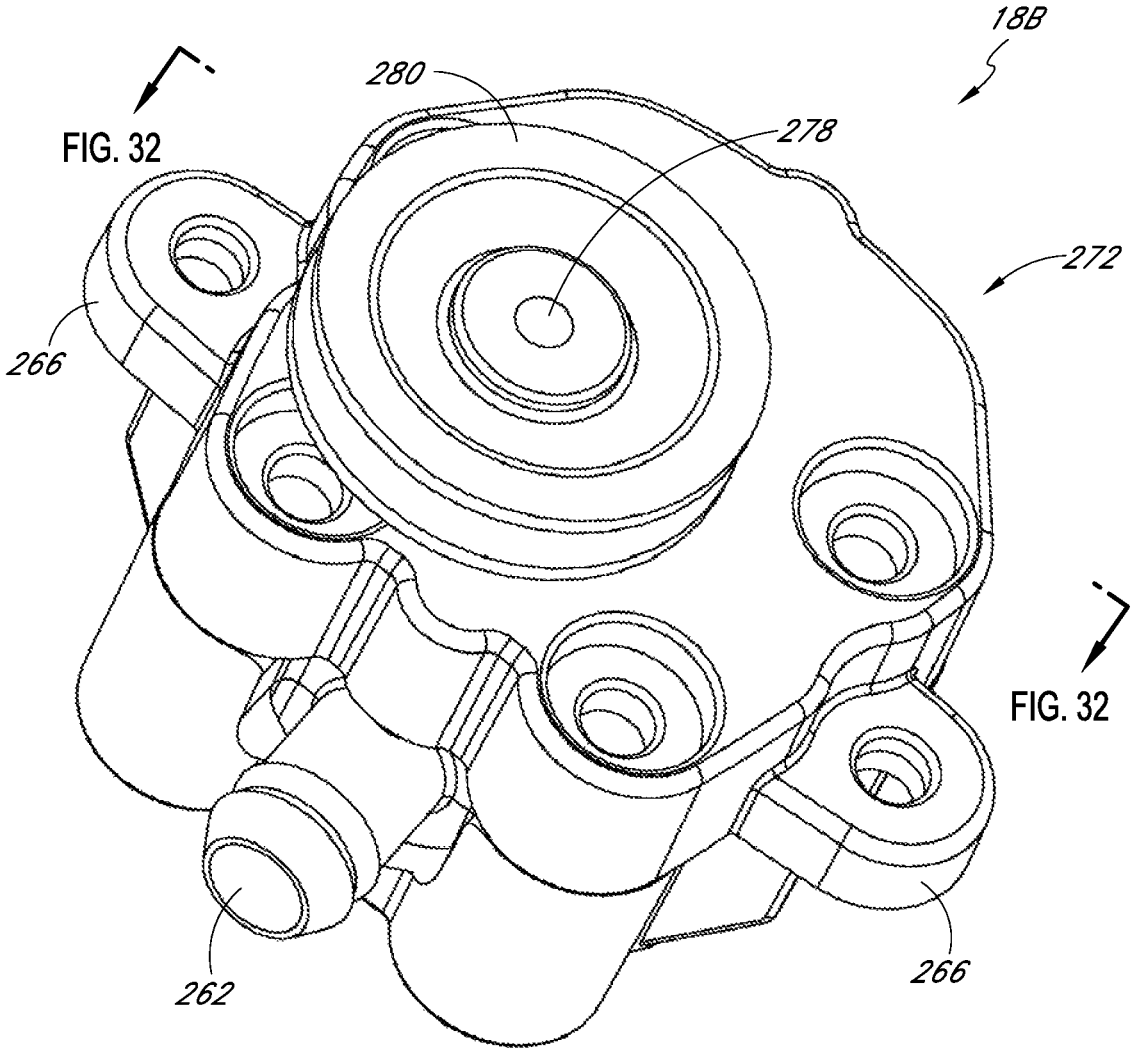
FIG. 27 illustrates a bottom front perspective view of the pump of FIG. 26.

With regard to FIG. 26, a top front perspective and partial cross-sectional view of the dispenser 10B is illustrated. As previously discussed, the dispenser 10B includes the reservoir 16B and pump 18B. As shown, the reservoir 16B can include an outlet 24B, which can be in fluid communication with the pump 18B. Thus, soap can flow between the reservoir 16B and the outlet 24B (e.g., by force of gravity). As discussed in further detail above, the pump 18B can drive the soap to the nozzle 28B via the conduit 26B, in order to be dispensed as desired.

As shown in FIGS. 27-29A, the pump 18B can include a pump body 272 having an outlet 262 and an inlet 263. In certain embodiments, the pump body 272 includes an upper member 264 and a lower member 265. Typically, the members 264, 265 are configured to mate together (e.g., with adhesive, fasteners, a snap fit connection, or otherwise). The pump body 272 can have one or more arms 266 or the like that are configured to, for example, facilitate mounting the pump body 272 in the housing 12B. Various materials can be used to form the pump body 272, such as metal, plastic, or otherwise. In some embodiments, the pump body 272 comprises a polymer, such as a polypropelene, polyoxymethylene, Delrin®, or otherwise.

In some embodiments, the pump body 272 houses a driven gear 270 and a slave gear 270'. In certain variants, the gears 270, 270' are substantially identical. In some embodiments, the gears 270, 270' are not identical. In certain implementations, the gears 270, 270' are configured to rotate in an oval and/or partially figure-eight-shaped space. As shown, certain embodiments of the pump body 272 include a chamber 273 in communication with the inlet 263. The chamber 273 can, for example, provide a staging location for liquid soap L between the reservoir 16B and the gears 270, 270'.

In certain implementations, a seal (e.g., made of rubber, silicone, or otherwise) is positioned between the upper and lower members 264, 265. Such a configuration can, for example, inhibit soap leaking from the pump body 272 and/or reduce the likelihood of air infiltrating the pump body 272 (which in turn could lead to drying of the soap and impede the operation of the pump 18B). In some embodiments, the seal is generally positioned along the periphery of the pump body 272.

Similar to the discussion above in connection with FIG. 9, in some embodiments, the pump body 272 includes a drive shaft aperture 274 (not shown). A gasket 276 (not shown) can be configured to form a seal against the aperture 274 and a drive shaft 278. One end of the drive shaft 278 can be connected to a driven sheave 280. The other end of the drive shaft 278 can extend through the gasket 276, the aperture 274, and engage with one of the driven gear 270. In some embodiments, the slave gear 270' can engage a boss 279.

In certain implementations, the pump body aperture or opening 263 of the pump body 272 is in fluid communication with the reservoir 16, thereby allowing liquid soap L to flow into the pump body 272 via the opening 263. However, in certain arrangements, air can be present in the pump body 272. For example, air is generally present in the pump body 272 during or at least before priming of the pump. In some cases, air can form a bubble that is retained in the pump body 272 and may interfere with the ability of liquid soap L to flow into the pump body 272. Such interference can be exacerbated if the opening 263 is too small to allow the bubble to escape (e.g., due to surface tension and frictional forces). Thus, in some embodiments, the opening 263 is configured to allow air in the pump body 272 to escape. For example, the opening 263 can be configured (e.g., can have a sufficient size and shape) to allow a bubble formed by air present in the pump body 272 to readily pass through the opening 263, such as during priming of the pump. For example, in some embodiments, the cross-sectional area of the opening 263 (e.g., taken generally in the plane of dimensions 293, 294 (see FIG. 29A)) is generally about the same size as, or is larger than, or is substantially larger than, the cross-sectional area of the upper region of the gear 270, or of a tooth 269 of the gear 270, and/or of a hole 267 of the gear 270 for receiving the drive shaft 278. In some implementations, the pump body 272 is configured so as to facilitate the flow of the liquid soap L through the opening 263. In certain embodiments, the opening 263 is configured so as to not retain an air bubble in the pump body 272.

In some embodiments, the opening 263 is configured to facilitate the liquid soap L flowing into the staging chamber, such as by force of gravity. As the liquid soap L generally can be rather viscous (e.g., between about 100 and about 2,500 centipoise), the surface tension of the liquid soap L may allow the soap to resist the force of gravity in certain arrangements. For example, when certain kinds of liquid soap are disposed directly over a hole, the surface tension of the soap may be sufficient to counteract the effect of gravity acting to urge the soap through the hole. In a soap dispenser, such a configuration can result in the soap being inhibited from reaching the pump, which can result in, for example, difficulty in priming the pump, reduced soap dispensation volume, and/or increased pump wear.

Certain embodiments of the pump dispenser 10B are configured to reduce the likelihood of, or avoid, such surface tension issues. For example, in some implementations, the opening 263 is sufficiently sized and shaped so as to facilitate gravity overcoming the surface tension of the soap. In certain variants, a first dimension 293 (e.g., a distance parallel with a centerline CL of the outlet 262) of the opening 263 is greater than or equal to about: 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, values in between, or otherwise. In some implementations, a second dimension 294 (e.g., a distance perpendicular to the centerline of the outlet 262) of the opening 263 is greater than or equal to about: 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, values in between, or otherwise. In certain embodiments, the first dimension 293 of the opening 263 is greater than the second dimension 294 of the opening 263. For example, the ratio of the first dimension 293 to the second dimension 294 can be at least about three to about two. In some embodiments, the ratio of the first dimension 293 to the second dimension 294 can be about two to about one. In certain variants of the opening 263, the ratio of the first dimension 293 to the second dimension 294 can be at least about five to about four. In some variants, the sum of the first and second dimensions 293 and 294 is greater than or equal to about: 10 mm, 12 mm, 14 mm, 16 mm, 18 mm, 20 mm, 25 mm, 30 mm, 35 mm, 40 mm, 45 mm, 50 mm, 55 mm, 60 mm, values in between, or otherwise. In some implementations, the opening 263 is configured to receive a cylinder with a diameter that is greater than or equal to about: 4 mm, 6 mm, 8 mm, 10 mm, 12 mm, 14 mm, 16 mm, 18 mm, 20 mm, values in between, or otherwise.

In certain embodiments, the opening 263 opens directly into the chamber 273. In some embodiments, the opening 263 opens directly into a second chamber 273' (see FIG. 32) that houses the gears 270, 270'. Such a configuration can, for example, facilitate the liquid soap L flowing into contact with the gears 270, 270', which in turn can facilitate priming of the dispenser 10B. In some variants, when the pump body 272 is viewed from a top plan view, a portion of at least one of the gears 270, 270' is visible though the opening 263.

Some methods of priming the dispenser 10B include providing the liquid soap L in fluid communication with the pump body 272 and allowing air (e.g., some or all) in the pump body 272 to escape the pump body 272. For example, some embodiments are configured to allow the air to escape from the pump body 272 via the opening 263. As previously noted, the opening 263 can be configured to inhibit or avoid the formation and/or trapping of an air bubble that would obstruct (e.g., partially or totally) the opening 263. Certain implementations are configured so as to allow some or all of the air to escape from the pump body 272 via other apertures (e.g., apertures in the sides of the top, bottom, and/or sides of the pump body 272. Some embodiments are configured such that some or all of the air can escape from the pump body 272 via the outlet 262. Some embodiments of the method of priming include allowing the liquid soap L to enter the pump body 272. In certain embodiments, the liquid soap L is at a higher elevation than some or all of the pump body 272, which can facilitate the liquid soap L being drawn into the pump body 272 by force of gravity.

Certain configurations of the opening 263 can, for example, facilitate the passage of air (e.g., a bubble) through the opening 263, thereby facilitating equilibrium between the pump 18 and the reservoir 16B and/or assisting in priming the pump 18. In some embodiments, the opening 263 has a generally triangular shape. In other embodiments, the opening 263 has a generally square, elliptical, circular, rectangular, or other regular or irregular polygonal shape. As illustrated in FIG. 29A, in certain embodiments, the opening 263 includes a sloped or angled surface (e.g., about 45°) that is wider in cross-section near the exterior than near the interior of the pump body 272. For example, in some variants, an inner periphery of the opening 263 is not coplanar with an outer periphery of the opening 263.

Figure 28:
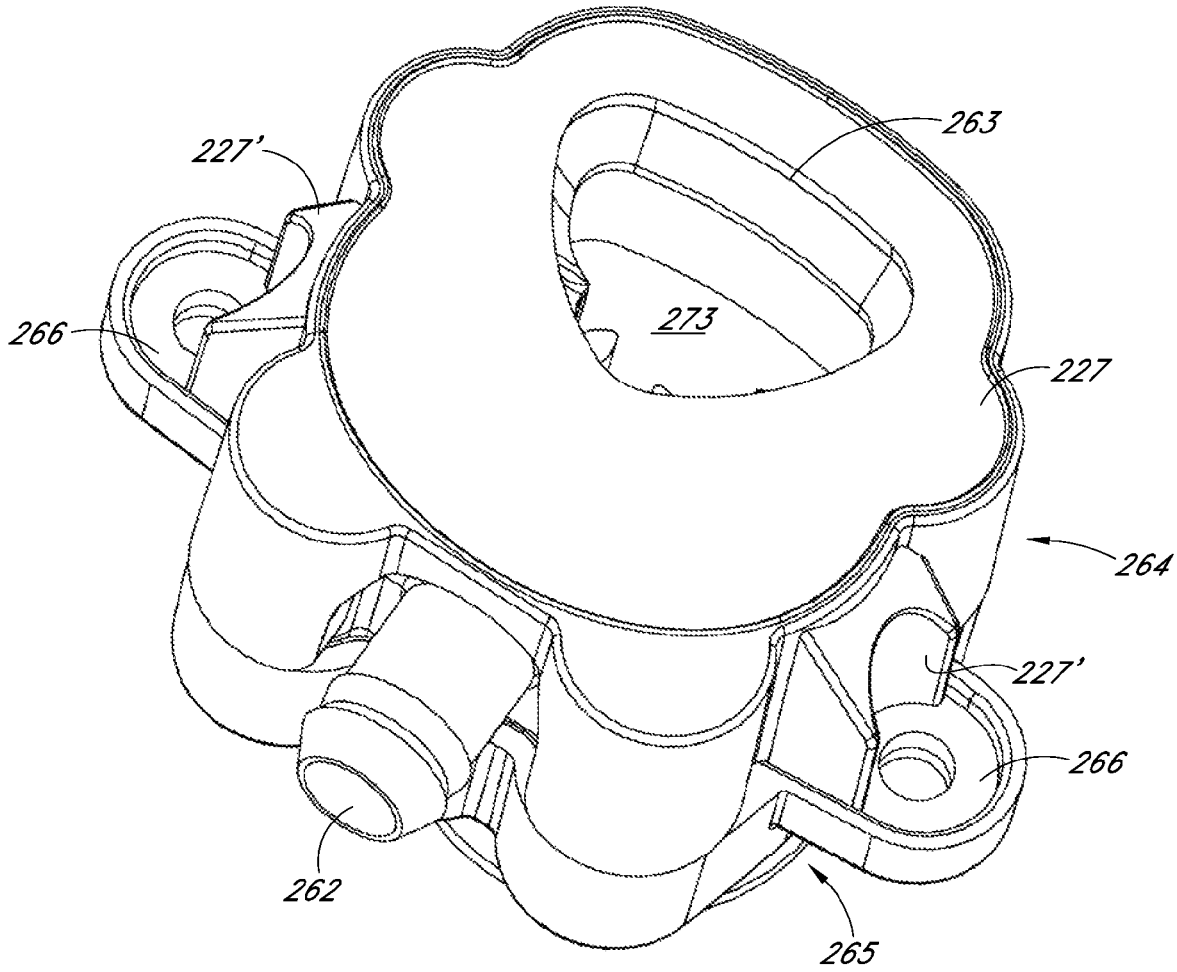
FIG. 28 illustrates a top front perspective view of the pump of FIG. 26.
Figure 29:
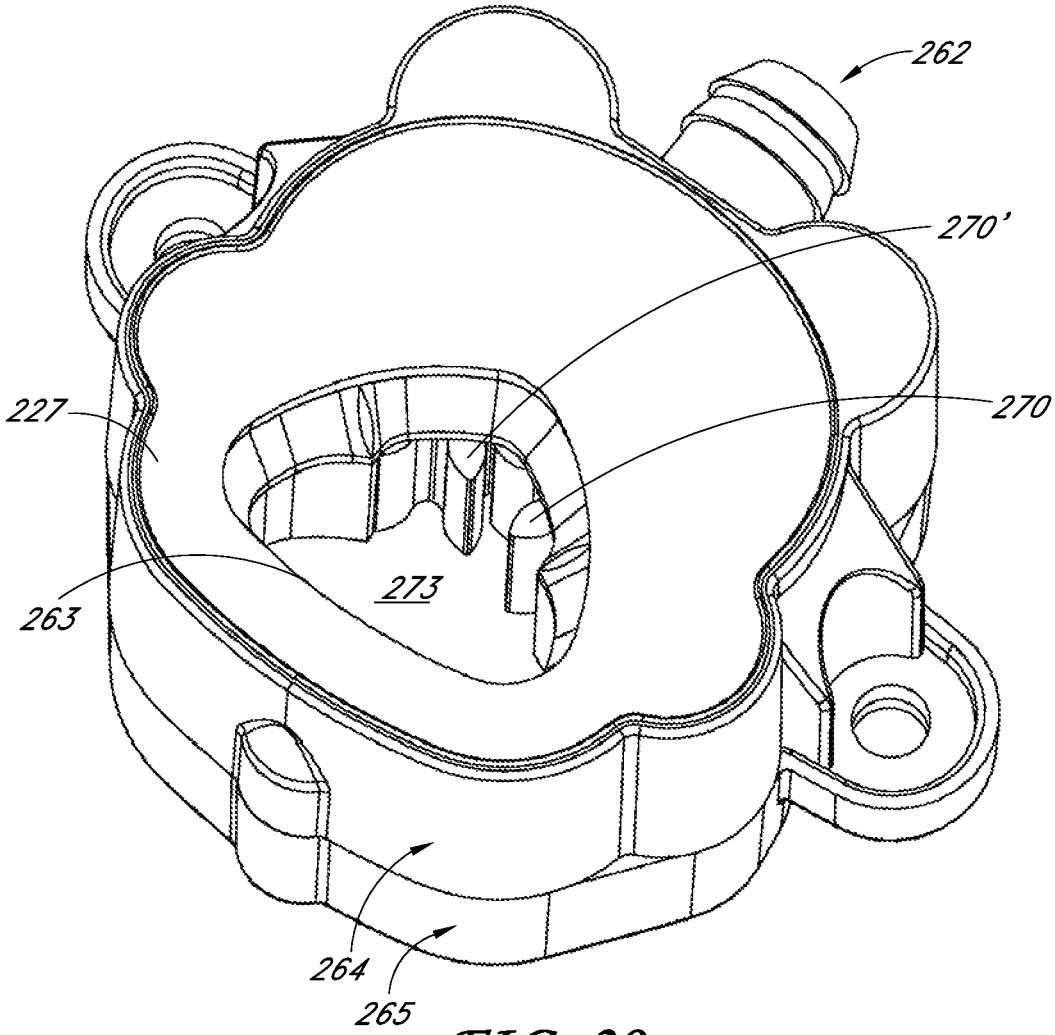
FIG. 29 illustrates top rear perspective view of the pump of FIG. 26, the pump having an upper member, a lower member, and gears.
Figure 29A:
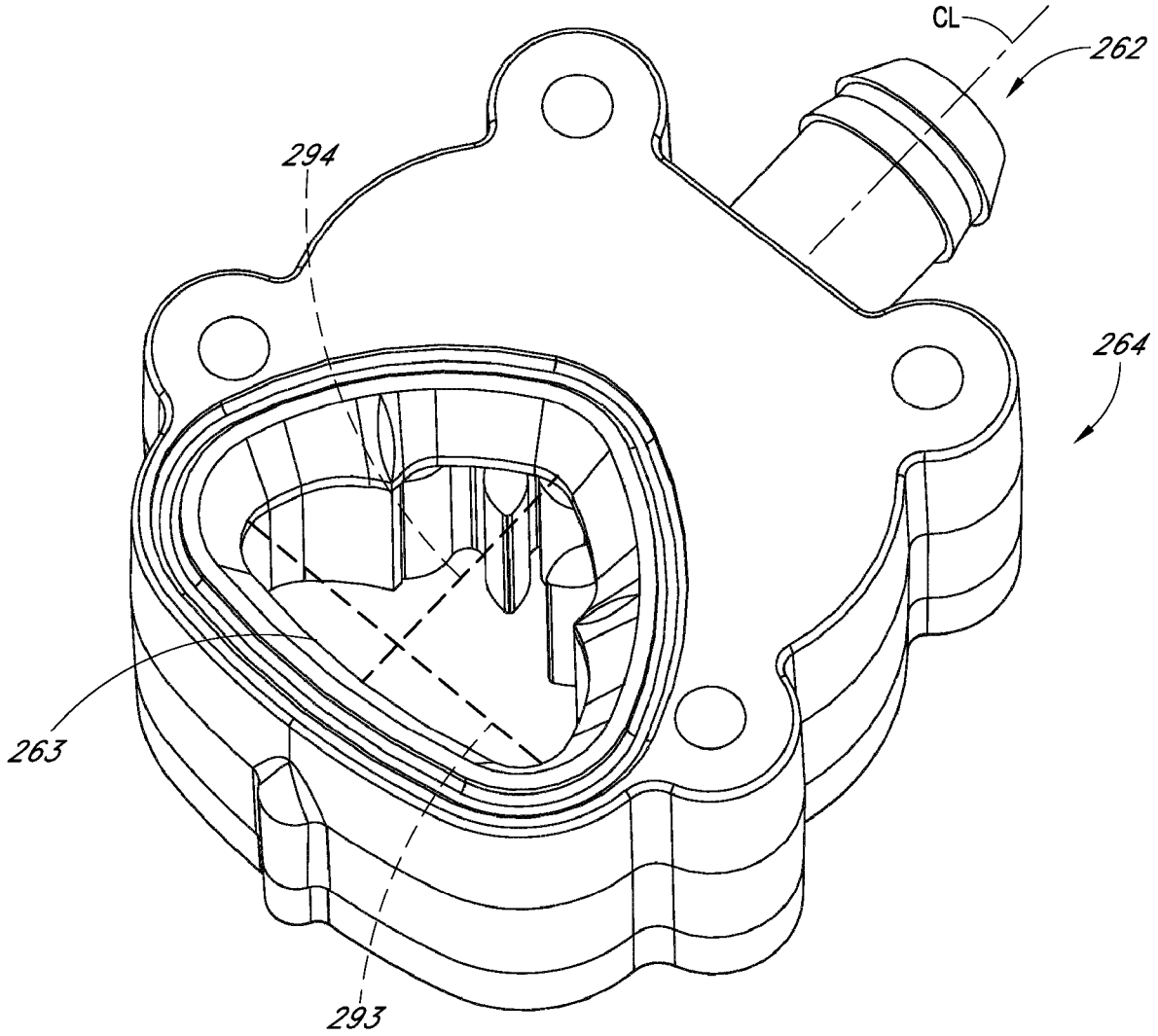
FIG. 29A illustrates a top rear perspective view of the upper member of FIG. 29.

As illustrated in FIGS. 28 and 29, some embodiments include a flexible cushion 227 (e.g., made of rubber, silicone, foam, or otherwise), that can be positioned on, over, or along some or all of the upper member 264 of the pump body 272. Such a configuration can, for example, reduce the amount of noise from the pump 18B that is emitted into the ambient environment. In some embodiments, the cushion 227 is configured to reduce, inhibit, or prevent the transmission of vibration from the pump body 272 to other portions of the dispenser (e.g., the reservoir 16B or otherwise) or the surface on which the dispenser rests (e.g., a countertop). In certain embodiments, the cushion 227 is configured to substantially conform to the shape of the pump body 272. As shown, the cushion can include a void configured to correspond with the opening 163. In certain embodiments, the cushion 227 includes notched projections 227' configured to correspond with the arms 266, which can, e.g., provide clearance for a fastener.

As previously discussed, the pump body 272 can include gears 270, 270', which can be configured to matingly engage. As will be discussed in further detail below, certain embodiments are configured to enhance the mating engagement of the gears 270, 270', which in turn can provide increased pumping power (e.g., the pressure generated by the mating of the gears 270, 270') and/or increase efficiency (e.g., by reducing the amount of soap that passes between the gears and back into the chamber 273).

Figure 30:
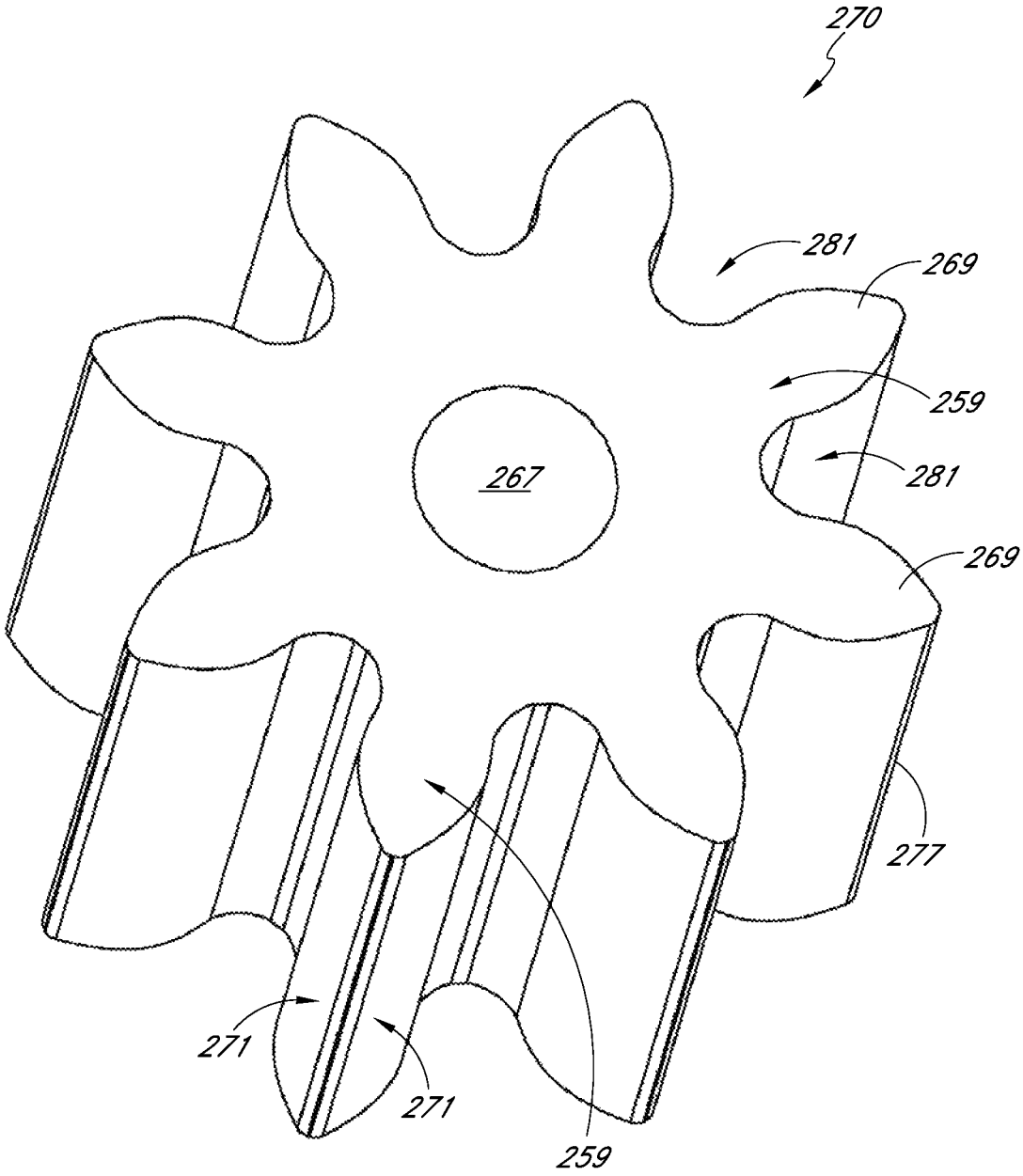
FIG. 30 illustrates a perspective view of one of the gears of FIG. 29.
Figure 31:
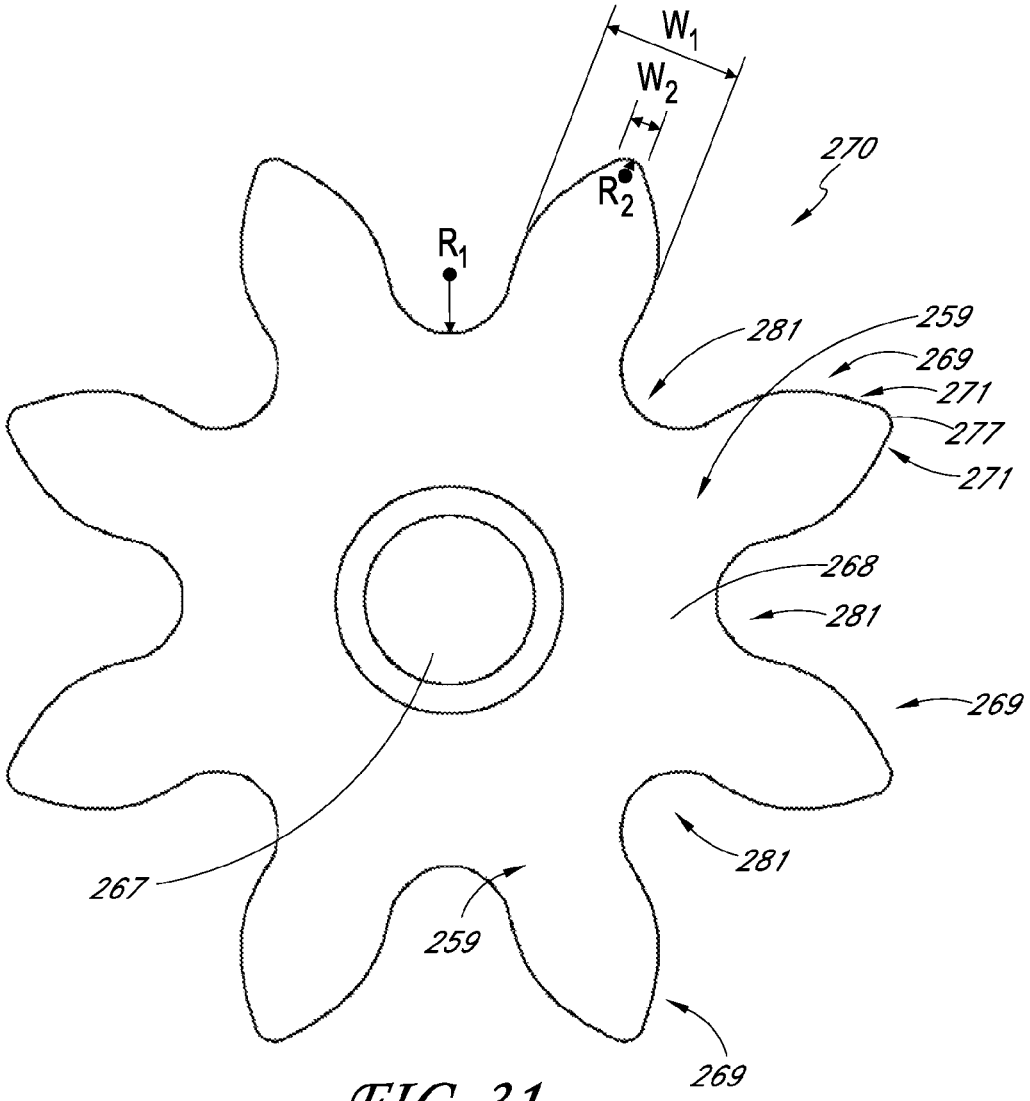
FIG. 31 illustrates a top plan view of the gear of FIG. 30, the gear including teeth.

With regard to FIGS. 30 and 31, an embodiment of the driven gear 270 is illustrated. Typically, the slave gear 270' is substantially similar or identical to the driven gear 270. As shown, the driven gear 270 includes a hole 267 (e.g., to receive the drive shaft 278) and a central portion 268 with a plurality of teeth 269 around the periphery. In certain implementations, adjacent teeth 269 are separated by a root 281. In some embodiments, the root 281 has a root radius R1, which can reduce stress concentrations, facilitate mating of the gears 270, or otherwise. In some embodiments, each of the teeth 269 includes a base 259, flanks 271, and a tip 277.

Figure 31A:
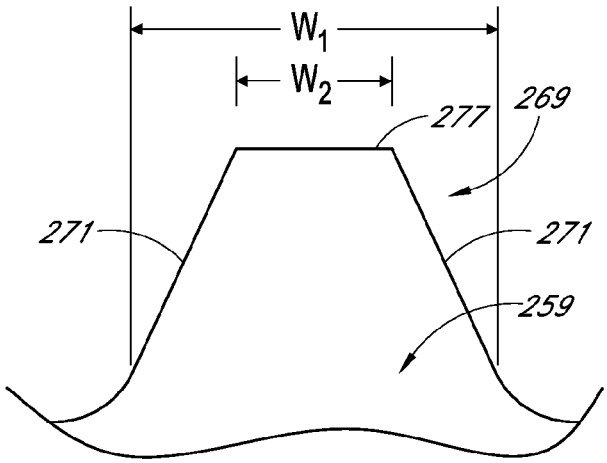
FIG. 31A illustrates a focused view of an alternate configuration of the teeth of the gear of FIG. 31.

In certain embodiments, one or more of the teeth 269 include a tooth width W1. The tooth width W1 is generally determined at the widest part of the tooth. In some embodiments, such as illustrated in FIG. 31, the tooth width W1 is determined at a location intermediate the base 259 and the tip 277. In other embodiments, such as in the frustoconically shaped tooth shown in FIG. 31A, the first width W1 is determined at or near the base 259.

Each of the teeth 269 can further include a tip width W2. The tip width W2 is generally the distance between the radially-outward end of the flanks 271. In some embodiments, the tip 277 comprises a relatively flat section (see FIGS. 9 and 31A) and the tip width W2 is about the distance of this flat section. Typically, W2 is less than W1. For example, in some embodiments, W2 is less than or equal to: about ¼ of W1. In some embodiments, the ratio of W2 to W1 is about 1:5, about 1:7.5, about 1:10, about 1:12.5, about 1:15, about 1:20, about 1:25, about 1:30, about 1:35, about 1:40, values in between, or otherwise.

In other embodiments, such as is shown in FIG. 31, the tip 277 is a section that is pointed (e.g., rounded, chamfered, or the like). In some such embodiments, the tip width W2 is the distance between the respective locations in which the radially-outward end of the flank 271 terminates and the radius, chamfer, or the like begins. For example, in embodiments that have a tip 277 with a tip radius R2, the tip width W2 is typically about twice the tip radius R2.

In some embodiments, the tip radius R2 of the tip 277 is less than the root radius R1. Such a configuration can, for example, provide a pointed tip 277 and facilitate engagement of the teeth 269 during operation of the pump 18B. In some embodiments, the tip radius R2 is less than or equal to: about ½ of the root radius R1, about ⅓ of the root radius R1, about ¼ of the root radius R1, about ⅛ of the root radius R1, about 1/10 of the root radius R1, about 1/16 of the root radius R1, about 1/20 of the root radius R1, about 1/30 of the root radius R1, about 1/40 of the root radius R1, about 1/50 of the root radius R1, values in between, or otherwise.

In certain embodiments, the tip 277 forms a substantially sharp or pointed peak. For example, in some embodiments, a slanted left side of a tooth and a generally oppositely slanted right side of the tooth can each converge at approximately the same point on the end of the tooth. In some embodiments, the tip radius R2 can be less than or equal to: about 0.5 mm, about 0.4 mm, about 0.3 mm, about 0.2 mm, about 0.1 mm, about 0.05 mm, about zero, values in between, or otherwise. Certain conventional wisdom discouraged the use of gears having substantially sharp and/or pointed tips because, for example, such tips could be prone to breaking. Further, substantially sharp and/or pointed tips could be thought to wear more quickly than tips that are flattened.

Figure 32:
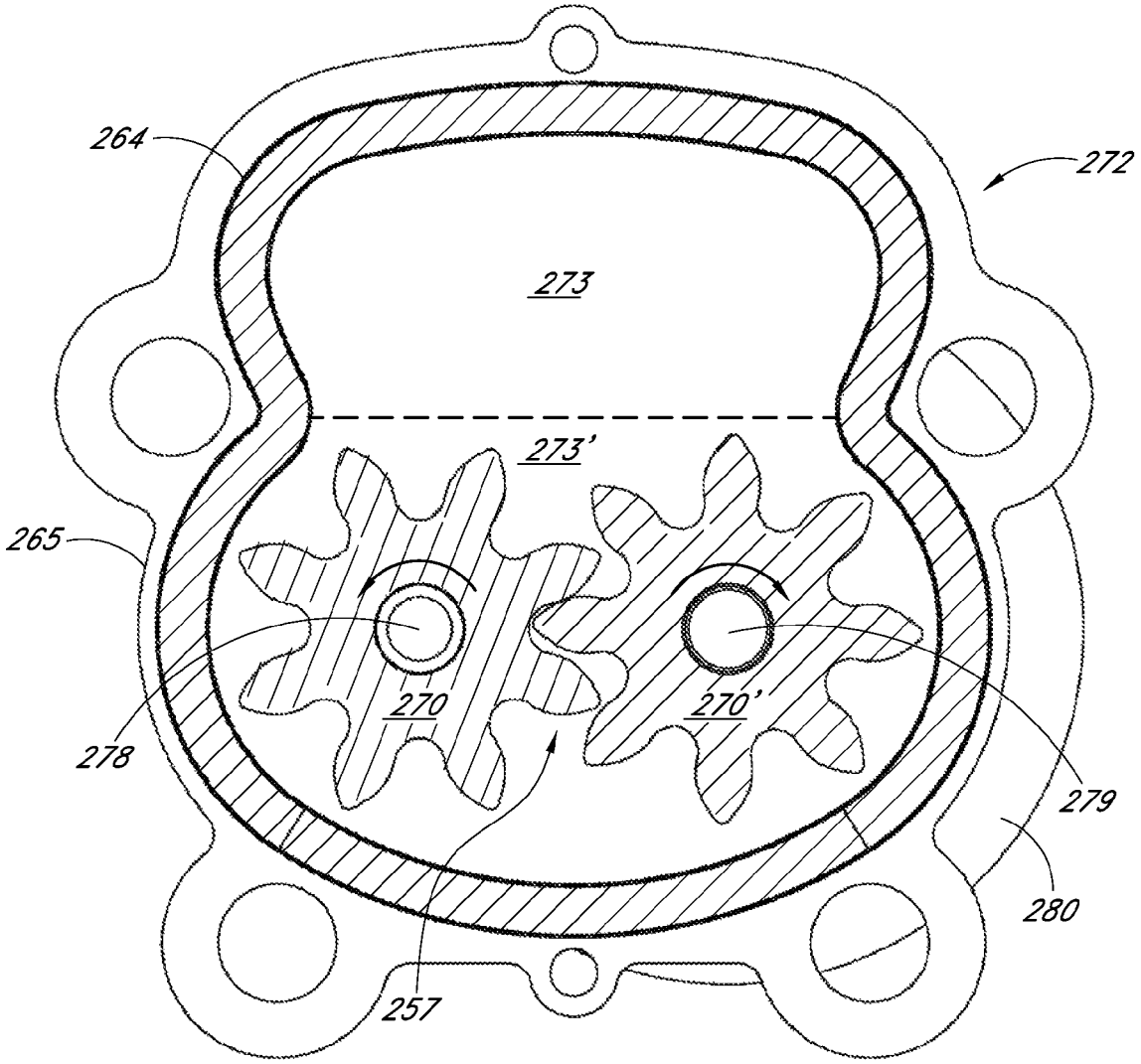
FIG. 32 illustrates a top cross-sectional view of the pump of FIG. 27, along the line 32-32.

However, employing gears with substantially sharp and/or pointed tips in a soap dispenser can provide substantial benefits. For example, the tip 277 being pointed can, for example, increase the pumping ability (e.g., the pressure generated by the mating of the gears 270, 270') of the pump 18B. As shown in FIG. 32, the gears 270, 270' of the pump 18B can be configured to rotate into contact with, or very close to, one another. Typically, as the gears engage, the volume between the tip 277 of one gear and the root 281 of the other gear decreases. Such a decrease in volume can result in an increased pressure area 257, which in turn can encourage fluid (e.g., soap) to flow toward the outlet 262. In general, the more fully the teeth 269 of the gears 270, 270' engage each other, the greater the increase in pressure in the area 257. In certain embodiments, gears with teeth 269 having pointed tips 277 more fully engage (e.g., have a greater percent of contact with) the mating teeth compared to, for example, gears with teeth 269 having flat tips 277. For example, certain embodiments of the pointed tips 277 project further toward the root 281 than the flat tips 277. At least due to such increased engagement, certain embodiments of the gears 270, 270' having teeth 269 with pointed tip 277 can facilitate increasing the pressure in the increased pressure area 257.

In some instances, a pointed tip 277 can increase the efficiency of the pump 18B. In embodiments having a flat tip 277, soap can be trapped or otherwise disposed between the flat tip 277 of one gear and the root 281 of the mating gear, which can result in soap being carried through the mating portion of the gears 270, 270' and back into the chamber 273, rather than the soap being expelled out the pump outlet 262. In contrast, a pointed tip 277 can allow the gears 270, 270' to more fully engage. For example, the pointed tip 277 can reduce the volume available for soap to be present between the tip 277 of one gear and the root 281 of the mating gear tip 277. Thus, the likelihood and/or the volume of soap carried through the mating portion of the gears 270, 270' and back into the chamber 273 can be reduced, thereby increasing the efficiency of the pump 18B.

As previously noted, the pump body 272 can include the chamber 273, which can be in communication with inlet 263. Further, in some embodiments, the pump body 272 also includes the second chamber 273'. The second chamber 273' can house the gears 270, 270' and can be in communication with the inlet 262, outlet 262, and/or chamber 273. As shown in FIG. 32, in certain embodiments, together the chambers 273, 273' form an overall figure-eight shape. Such a configuration can, for example, provide space for staging soap in the pump body 272 and space for housing and operation of the gears. In some embodiments, the chamber 273 is smaller than the second chamber 273'. In certain implementations, the chamber 273 holds less soap than the second chamber 273'. In other embodiments, the chamber 273 holds about as much soap as the second chamber 273'.

In some embodiments, the passage between the chamber 273 and the second chamber 273' is configured such that the liquid soap L can readily pass therethrough. For example, in some variants, the passage between the chamber 273 and the second chamber 273' is configured such that the weight of liquid soap L in the chamber 273 overcomes the surface tension of the liquid soap L and thus moves the soap into a portion of the second chamber 273'. Accordingly, the passage can be configured so as to reduce or avoid the chance of surface tension of the soap inhibiting the soap from reaching the gears 270, 270'. In certain embodiments, the width of the passage (indicated by the dashed line in FIG. 32) is greater than or equal to the first dimension 293 and/or the second dimension 294 of the opening 263.

Although the soap dispenser has been disclosed in the context of certain embodiments and examples, it will be understood by those skilled in the art that the soap dispenser extends beyond the specifically disclosed embodiments to other alternative embodiments and/or uses of the embodiments and certain modifications and equivalents thereof. For example, some embodiments can be configured to use a fluid other than soap, e.g., hand sanitizer, shampoo, hair conditioner, skin moisturizer or other lotions, toothpaste, or other fluids. It should be understood that various features and aspects of the disclosed embodiments can be combined with or substituted for one another in order to form varying modes of the soap dispenser. Accordingly, it is intended that the scope of the soap dispenser herein-disclosed should not be limited by the particular disclosed embodiments described above, but should be determined only by a fair reading of the claims that follow.

The following is claimed:

1. A portable soap dispenser, comprising:

a housing;

a reservoir that is configured to store a volume of liquid soap;

a fluid passage comprising an inlet and an outlet;

a motor configured to a drive a pump in fluid communication with the reservoir, the pump configured to encourage a flow of the liquid soap into the inlet and out of the outlet of the fluid passage;

a staging chamber in fluid communication with and upstream of the pump, the staging chamber configured to receive a primed volume of the liquid soap, to retain the primed volume of the liquid soap when the motor is not driving the pump, and to dispense at least a portion of the primed volume of the liquid soap to the pump when the motor is driving the pump; and a nozzle in fluid communication with the outlet of the fluid passage, the nozzle being supported by the housing and projecting outward from the housing so as to be at least partly visible to an observer outside of the dispenser;

wherein the nozzle comprises a flange and a duckbill valve, the flange being configured to mate with an annular surface of the housing, thereby forming a generally liquid tight seal therebetween, the duckbill valve including a first deflectable member and a second deflectable member with a slit therebetween, the first deflectable member and the second deflectable member being biased toward each other, thereby inhibiting the liquid soap from being dispensed from the dispenser until the bias has been overcome.

2. The portable soap dispenser of claim 1, further comprising the liquid soap.

3. The portable soap dispenser of claim 1, wherein the first and second deflectable members, when viewed along the slit, form a generally hourglass shape.

4. The portable soap dispenser of claim 3, wherein the first and second deflectable members are configured such that the generally hourglass shape increases the bias between the first and second deflectable members.

5. The portable soap dispenser of claim 1, wherein at least one of the first and second deflectable members further comprises a notch generally aligned with the slit, the notch configured to facilitate overcoming the bias of the first and second deflectable members.

6. The portable soap dispenser of claim 1, wherein the nozzle further comprises an indentation and the fluid passage further comprises a protrusion, the indentation being configured to receive at least a portion of the protrusion, thereby orienting the nozzle with respect to the fluid passage.

7. The portable soap dispenser of claim 6, wherein the fluid passage further comprises an angled member and the housing further comprises a recess, the recess being configured to receive at least a portion of the angled member, thereby orienting the fluid passage and the nozzle with respect to the housing.

8. The portable soap dispenser of claim 1, wherein the dispenser comprises a front and a back with a front-to-back axis therebetween, the nozzle being positioned at or near the front of the dispenser and the slit being oriented substantially perpendicular to the front-to-back axis.

9. The portable soap dispenser of claim 1, wherein after an amount of the liquid soap has been dispensed, the pump is configured to temporarily reverse the flow of the liquid soap, thereby drawing an amount of the liquid soap in the nozzle toward the outlet of the fluid passage and facilitating closure of the duckbill valve.

10. The portable soap dispenser of claim 1, wherein the housing comprises a body portion and an upper portion cantilevered from the body portion, the body portion including the reservoir, the nozzle projecting downwardly from an end of the upper portion.

11. The portable soap dispenser of claim 1, further comprising a vent in fluid communication with the volume of liquid soap in the reservoir, the vent being configured to allow air to pass therethrough.

12. The portable soap dispenser of claim 1, further comprising a pump body comprising the staging chamber and the pump.

13. The portable soap dispenser of claim 12, wherein the pump body further comprises a second chamber, the chamber and the second chamber together forming an overall figure-eight shape.

14. The portable soap dispenser of claim 12, wherein the pump body further comprises an upper member having an opening that is in fluid communication with the chamber and with the reservoir, the opening being narrower than the chamber.

15. The portable soap dispenser of claim 14, wherein the opening is generally triangular in shape.

16. A soap dispenser, comprising:

a housing;

a reservoir that is configured to store a volume of viscous liquid soap;

a fluid passage comprising an inlet and an outlet;

a motor disposed in the housing;

a pump mechanism configured to be driven by the motor, the pump mechanism disposed in a pump body;

a staging chamber in fluid communication with the pump mechanism and the reservoir, the staging chamber positioned between the reservoir and the pump mechanism; and a pump body aperture in fluid communication with the reservoir and the staging chamber, the pump body aperture being configured such that surface tension of the viscous liquid soap is overcome by the force of gravity, thereby facilitating a flow of the viscous liquid soap into the staging chamber;

wherein the staging chamber is configured to receive a primed volume of the viscous liquid soap, to retain the primed volume of the viscous liquid soap for a period of time in which the dispenser is not dispensing the viscous liquid soap, and to dispense at least a portion of the primed volume of the viscous liquid soap to the pump mechanism during a priming operation of the dispenser.

17. The soap dispenser of claim 16, wherein the pump body aperture is configured to inhibit trapping of an air bubble within the staging chamber that impedes the viscous liquid soap from flowing through the pump body aperture and into the staging chamber.

18. The soap dispenser of claim 16, further comprising the viscous liquid soap.

19. The soap dispenser of claim 16, wherein:

the pump mechanism further comprises a pump outlet having a centerline; and the pump body aperture further comprises a first dimension and a second dimension, the second dimension being generally parallel with the centerline and the first dimension being substantially perpendicular to the centerline, the first dimension being greater than the second dimension.

20. The soap dispenser of claim 16, further comprising a flexible cushion configured to inhibit noise emitted by the pump mechanism from being transmitted into the ambient environment, the flexible cushion comprising a void configured to correspond with the pump body aperture.

21. The soap dispenser of claim 16, wherein the pump body aperture is connected directly with the reservoir.

22. The soap dispenser of claim 16, wherein some or all of the reservoir is positioned at a higher elevation than the pump body aperture.

23. The soap dispenser of claim 16, further comprising a vent in fluid communication with the volume of liquid soap in the reservoir, the vent being configured to allow air to pass therethrough.

24. The soap dispenser of claim 16, wherein the pump body comprises the staging chamber.

25. The soap dispenser of claim 24, wherein the pump body further comprises a second chamber, the chamber and the second chamber together forming an overall figure-eight shape.

26. The soap dispenser of claim 24, wherein the pump body further comprises an upper body member and a lower body member configured to mate, thereby forming the pump body.

27. A soap dispenser, comprising:

a housing;

a reservoir configured to store a volume of liquid soap;

a fluid passage comprising a fluid inlet and a fluid outlet;

a pump body comprising a pump inlet and a pump outlet;

a gear pump assembly positioned in the pump body, the gear pump assembly comprising a first gear and a second gear, each of the first and second gears comprising a plurality of teeth, each of the teeth having a tip with a substantially pointed peak;

a motor positioned in the housing, the motor configured to rotate the first gear, the first gear being configured to matingly engage the second gear such that rotation of the first gear results in rotation of the second gear, the first and second gears thereby cooperating to encourage a flow of the liquid soap into the pump body via the pump inlet and out of the pump body via the pump outlet; and a staging chamber in fluid communication with the gear pump, the staging chamber configured to receive a primed volume of the liquid soap, to retain the primed volume of the liquid soap for a period of time, and to dispense at least a portion of the primed volume of the liquid soap to the gear pump during operation of the motor.

28. The soap dispenser of claim 27, wherein the substantially pointed peak comprises a tip radius, the tip radius being less than or equal to about 0.5 mm.

29. The soap dispenser of claim 27, wherein each of the first and second gears comprise a root intermediate adjacent pairs of the teeth, the tip radius being less than or equal to about 1/20 of the root radius.

30. The soap dispenser of claim 27, wherein each of the teeth comprise a tooth width and a tip width, at least one of the teeth having a tip width that is less than or equal to about 1/10 of the tooth width.

31. The soap dispenser of claim 27, wherein the first and second gears are substantially identical.

32. The soap dispenser of claim 27, further comprising a duckbill valve in fluid communication with the pump outlet, the duckbill valve being supported by the housing and projecting outward from the housing so as to be at least partly visible to an observer outside of the dispenser.

33. The soap dispenser of claim 27, further comprising a vent in fluid communication with the reservoir, the vent being configured to allow air to pass therethrough.

* * * * *